US009435571B2

(12) United States Patent
Ghoshal et al.

(10) Patent No.: US 9,435,571 B2
(45) Date of Patent: Sep. 6, 2016

(54) METHOD AND APPARATUS FOR SWITCHED THERMOELECTRIC COOLING OF FLUIDS

(75) Inventors: Uttam Ghoshal, Austin, TX (US); Ayan Guha, Austin, TX (US); James Borak, Dale, TX (US)

(73) Assignee: Sheetak Inc., Austin, TX (US)

( * ) Notice: Subject to any disclaimer, the term of this patent is extended or adjusted under 35 U.S.C. 154(b) by 562 days.

(21) Appl. No.: 12/736,049

(22) PCT Filed: Mar. 3, 2009

(86) PCT No.: PCT/US2009/001348

§ 371 (c)(1),
(2), (4) Date: Sep. 2, 2010

(87) PCT Pub. No.: WO2009/111008

PCT Pub. Date: Sep. 11, 2009

(65) Prior Publication Data

US 2011/0016886 A1 Jan. 27, 2011

Related U.S. Application Data

(60) Provisional application No. 61/205,114, filed on Jan. 15, 2009, provisional application No. 61/197,223, filed on Oct. 24, 2008, provisional application No. 61/137,411, filed on Jul. 30, 2008, provisional application No. 61/068,173, filed on Mar. 5, 2008.

(51) Int. Cl.
*F25B 21/02* (2006.01)
*F25D 19/00* (2006.01)

(52) U.S. Cl.
CPC ..... *F25B 21/02* (2013.01); *F25B 2321/025* (2013.01); *F25B 2321/0212* (2013.01); *F25D 19/006* (2013.01)

(58) Field of Classification Search
CPC ..... F25D 19/006; F25B 21/02; F25B 2321/0212; F25B 2321/025
USPC ..... 62/3.2, 3.6, 3.7, 125, 129, 49.1, 79, 62/3.64; 136/201
See application file for complete search history.

(56) References Cited

U.S. PATENT DOCUMENTS 3,276,720 A 10/1966 Rich
3,428,496 A 2/1969 Lockwood (Continued)

FOREIGN PATENT DOCUMENTS

CN 2189726 A 2/1995
CN 1154467 A 7/1997

(Continued)

OTHER PUBLICATIONS

Notification of First Office Action from the State Intellectual Property Office of P.R.C. mailed Mar. 26, 2012 corresponding to Chinese patent application Serial No. 200980107943.1(15 pages) with English translation (19 pages); national phase application of PCT No. PCT/US2009/001348.

(Continued)

*Primary Examiner* — Len Tran
*Assistant Examiner* — Ana Vazquez
(74) *Attorney, Agent, or Firm* — Strasburger & Price, LLP

(57) ABSTRACT

A method and system for efficiently cooling a fluid is provided. A cooling system includes a first chamber containing a first fluid, and a second chamber connected to the first chamber and containing a second fluid. The cooling system further includes one or more thermoelectric devices for cooling the second fluid in the second chamber, and a first body that acts as a thermal diode. The first body enables unidirectional transfer of heat from the thermoelectric devices to the first fluid. Further, the cooling system can be installed with one or more phase change materials or heat pipes that enhance the cooling efficiency of the cooling system. The thermoelectric devices are switched on for a certain time period, after which they are switched off and on repeatedly in cycles, depending on the temperature of the second fluid.

16 Claims, 51 Drawing Sheets

(56) References Cited

U.S. PATENT DOCUMENTS

| | | | | |
|---|---|---|---|---|
| 3,480,846 | A | | 11/1969 | Mathes |
| 3,735,806 | A | | 5/1973 | Kirkpatrick |
| 3,826,957 | A | | 7/1974 | McLaughlin et al. |
| 3,955,554 | A | | 5/1976 | Collie |
| 4,049,469 | A | | 9/1977 | Kolomoets |
| 4,271,681 | A | * | 6/1981 | Schertz ..... 62/260 |
| 4,288,854 | A | | 9/1981 | Burroughs |
| 4,322,737 | A | | 3/1982 | Sliwa |
| 4,448,028 | A | | 5/1984 | Chao |
| 4,583,361 | A | * | 4/1986 | Genovese ..... 60/39.462 |
| 4,698,541 | A | | 10/1987 | Bar-Cohen |
| 4,819,011 | A | | 4/1989 | Yokota |
| 5,051,146 | A | | 9/1991 | Kapolnek |
| 5,207,674 | A | | 5/1993 | Hamilton |
| 5,367,879 | A | | 11/1994 | Doke |
| 5,387,849 | A | | 2/1995 | Sridharan |
| 5,501,076 | A | | 3/1996 | Sharp |
| 5,579,830 | A | | 12/1996 | Giammaruti |
| 5,604,757 | A | * | 2/1997 | Liang et al. ..... 372/38.04 |
| 5,711,155 | A | | 1/1998 | DeVilbiss |
| 5,737,923 | A | | 4/1998 | Gilley |
| 5,782,094 | A | | 7/1998 | Freeman |
| 5,959,341 | A | | 9/1999 | Tsuno |
| 6,003,319 | A | | 12/1999 | Gilley |
| 6,084,772 | A | * | 7/2000 | Pell et al. ..... 361/699 |
| 6,164,076 | A | | 12/2000 | Chu |
| 6,288,321 | B1 | | 9/2001 | Fleurial |
| 6,329,721 | B1 | | 12/2001 | DiGiacomo |
| 6,338,251 | B1 | | 1/2002 | Ghoshal |
| 6,370,884 | B1 | | 4/2002 | Kelada |
| 6,415,612 | B1 | | 7/2002 | Pokharna |
| 6,492,585 | B1 | | 12/2002 | Zamboni |
| 6,583,350 | B1 | | 6/2003 | Gee |
| 6,740,600 | B2 | | 5/2004 | Ghoshal |
| 6,883,329 | B1 | | 4/2005 | Martling |
| 7,032,389 | B2 | | 4/2006 | Cauchy |
| 7,131,286 | B2 | | 11/2006 | Ghoshal |
| 7,342,169 | B2 | | 3/2008 | Venkatasubramania |
| 7,356,277 | B2 | | 4/2008 | Iijima |
| 7,448,222 | B2 | | 11/2008 | Bormann |
| 7,483,130 | B2 | | 1/2009 | Baumberg |
| 7,763,792 | B2 | | 7/2010 | Sharp |
| 8,075,150 | B2 | | 12/2011 | Maruyama |
| 8,168,879 | B2 | | 5/2012 | Chen |
| 2003/0029174 | A1 | | 2/2003 | Lee |
| 2003/0041892 | A1 | | 3/2003 | Fleurial |
| 2004/0173257 | A1 | | 9/2004 | Rogers |
| 2005/0051205 | A1 | | 3/2005 | Mook |
| 2005/0051208 | A1 | | 3/2005 | Mount |
| 2005/0126184 | A1 | | 6/2005 | Cauchy |
| 2005/0150535 | A1 | | 7/2005 | Samavedam |
| 2005/0150536 | A1 | | 7/2005 | Ngai |
| 2005/0150539 | A1 | | 7/2005 | Ghoshal |
| 2005/0160752 | A1 | | 7/2005 | Ghoshal |
| 2005/0210884 | A1 | | 9/2005 | Tuskiewicz |
| 2005/0257532 | A1 | | 11/2005 | Ikeda |
| 2005/0274120 | A1 | | 12/2005 | Quisenberry |
| 2006/0011776 | A1 | | 1/2006 | Maurer |
| 2006/0076046 | A1 | | 4/2006 | Ghoshal |
| 2006/0082971 | A1 | | 4/2006 | Artman |
| 2006/0117761 | A1 | | 6/2006 | Bormann |
| 2006/0137360 | A1 | | 6/2006 | Ghoshal |
| 2006/0255341 | A1 | | 11/2006 | Pinnington |
| 2006/0266043 | A1 | | 11/2006 | Jerome |
| 2007/0090892 | A1 | | 4/2007 | Larson |
| 2007/0107764 | A1 | | 5/2007 | Kanatzidis |
| 2007/0137687 | A1 | | 6/2007 | Tanielian |
| 2007/0221266 | A1 | | 9/2007 | Davies |
| 2007/0251569 | A1 | | 11/2007 | Shan |
| 2007/0257751 | A1 | | 11/2007 | Jarno |
| 2007/0261730 | A1 | | 11/2007 | Seker |
| 2007/0289622 | A1 | | 12/2007 | Hecht |
| 2008/0020946 | A1 | | 1/2008 | Venkatasubramania |
| 2008/0035312 | A1 | | 2/2008 | Filippone |
| 2008/0053509 | A1 | | 3/2008 | Flitsch |
| 2008/0083446 | A1 | | 4/2008 | Chakraborty |
| 2008/0117761 | A1 | | 5/2008 | Hwang |
| 2008/0121263 | A1 | | 5/2008 | Schutte |
| 2008/0149159 | A1 | * | 6/2008 | Logan et al. ..... 136/205 |
| 2008/0173343 | A1 | | 7/2008 | Kanno |
| 2008/0184710 | A1 | * | 8/2008 | DeVilbiss ..... 62/3.2 |
| 2008/0289677 | A1 | | 11/2008 | Bell |
| 2008/0295879 | A1 | | 12/2008 | Atanackovic |
| 2009/0005779 | A1 | | 1/2009 | Falkenstein |
| 2009/0049845 | A1 | * | 2/2009 | McStravick et al. ..... 62/3.62 |
| 2009/0109621 | A1 | | 4/2009 | Cheng |
| 2009/0322221 | A1 | | 12/2009 | Makansi |
| 2010/0108117 | A1 | | 5/2010 | Hamano |
| 2010/0126555 | A1 | | 5/2010 | Maxton |
| 2010/0154854 | A1 | | 6/2010 | Lee |
| 2010/0186794 | A1 | | 7/2010 | Chen |
| 2010/0193001 | A1 | | 8/2010 | Hirono |
| 2010/0230071 | A1 | | 9/2010 | Slater |
| 2010/0233763 | A1 | | 9/2010 | Shigeura |
| 2010/0313576 | A1 | | 12/2010 | Goenka |
| 2011/0000224 | A1 | | 1/2011 | Ghoshal |
| 2011/0016886 | A1 | | 1/2011 | Ghoshal |
| 2011/0100410 | A1 | | 5/2011 | Takahashi |
| 2011/0107765 | A1 | | 5/2011 | Valeev |
| 2012/0048322 | A1 | | 3/2012 | Ghoshal |
| 2012/0085316 | A1 | | 4/2012 | Chen |

FOREIGN PATENT DOCUMENTS

| | | | | |
|---|---|---|---|---|
| CN | 1259648 | A | | 7/2000 |
| CN | 2593130 | A | | 12/2003 |
| CN | 1478307 | A | | 2/2004 |
| CN | 1680766 | A | | 10/2005 |
| CN | 1845316 | A | | 10/2006 |
| CN | 101344344 | A | | 1/2009 |
| JP | H181481 | A | | 5/1989 |
| JP | 08014723 | | | 1/1996 |
| JP | 08014723 | A | * | 1/1996 |
| JP | 11233838 | | | 8/1999 |
| JP | 2003-343986 | A | | 12/2003 |
| JP | 200471969 | | | 3/2004 |
| JP | 2007100992 | A | | 4/2007 |
| JP | 20071748043 | A | | 7/2007 |
| WO | 0247177 | | | 6/2002 |
| WO | 2006119305 | A2 | | 11/2006 |
| WO | 2009111008 | A1 | | 9/2009 |
| WO | 2010012718 | A1 | | 4/2010 |
| WO | 2011008280 | A1 | | 1/2011 |
| WO | 2011044115 | A2 | | 4/2011 |
| WO | 2012038917 | A2 | | 3/2012 |

OTHER PUBLICATIONS

"Heat Control Filters" (2001). Newport Corporation.

Written Opinion of the International Search Authority for International Application No. PCT/US2009/001542, mailed May 5, 2009 (5 pages).

Notification of First Office Action from the State Intellectual Property Office of P.R.C. mailed Mar. 28, 2012 corresponding to Chinese patent application Serial No. 200980107943.1 (15 pages), with English translation (19 pages); national phase application of PCT No. PCT/US2009/001348.

PCT International Search Report for International Application No. PCT/US2012/060498 mailed Jan. 2, 2013(2 pages).

International Search Report from the International Searching Authority Korea (US) for International Application No. PCT/US10/01981 mailed Sep. 15, 2010, corresponding to U.S. Appl. No. 13/496,291, published as US2012-0192574 A1 on Aug. 2, 2012 (2 pages).

Extended European Search Report for European Application No. EP10800160 dated Jun. 4, 2014 (7 pages).

Narayanaswamy, A. and Chen, Gang; 'Thermal emission control with one-dimensional metallodielectric photonic crystals'; Physical Review B 70, 125101—Published Sep. 2, 2004; Entire document; Retrieved on Oct. 7, 2013 from the Internet <URL:http://prb.aps.org/abstract/PRB/v70/i12/e1251 01 > <DOI: 10.11 03/PhysRevB.70.1251 01 >; (3 pages).

(56) References Cited

OTHER PUBLICATIONS

Notification of First Office from the State Intellectual Property Office of People's Republic of China dated Nov. 27, 2012 corresponding to Chinese Patent Application No. 200980109712.4, with English translation (21 pages).
Notification of Reexamination from the State Intellectual Property Office of the People's Republic of China dated Jun. 19, 2014 corresponding to Chinese Patent Application No. 200980109712.4 and English translation of same (15 pages).
Notification of the First Office Action from the State Intellectual Property Office of People's Republic of China dated Dec. 15, 2014 corresponding to Chinese Patent Application No. 201310325610.4; with English translation (30 pages).
Notification of the Second Office Action from the State Intellectual Property Office of People's Republic of China dated Feb. 8, 2013 corresponding to Chinese Patent Application No. 200980107943.1; with English translation (9 pages).
Notification of the Second Office Action from the State Intellectual Property Office of People's Republic of China dated Jan. 28, 2014 corresponding to Chinese Patent Application No. 201080038724.5; Attorneys: Wu, Huanfang and Tian, Junfeng, with English translation (29 pages).
Notification of Third Office from the State Intellectual Property Office of People's Republic of China dated Sep. 4, 2014 corresponding to Chinese Patent Application No. 201080038724.5, with English translation (10 pages).
PCT International Preliminary Report on Patentability for International Application No. PCT/US09/01348 dated Sep. 7, 2010 (6 pages).
PCT International Preliminary Report on Patentability for International Application No. PCT/US09/01542 dated Sep. 21, 2010 (6 pages).
PCT International Preliminary Report on Patentability for International Application No. PCT/US11/00061 dated Jul. 16, 2013 (10 pages).
PCT International Preliminary Report on Patentability for International Application No. PCT/US12/60498 dated Apr. 22, 2014 (7 pages).
PCT International Search Report for International Application No. PCT/ US09/01348 dated Apr. 29, 2009 (2 pages).
PCT International Search Report for International Application No. PCT/US09/01542 dated May 5, 2009 (2 pages).
PCT International Search Report for International Application No. PCT/ US10/01981 dated Sep. 15, 2010 (2 pages).
PCT International Search Report for International Application No. PCT/US10/02464 dated Nov. 5, 2010 (2 pages).
PCT International Search Report for International Application No. PCT/US11/00061 dated May 19, 2011 (4 pages).
PCT International Search Report for International Application No. PCT/US11/01914 dated Apr. 2, 2012 (2 pages).
PCT International Search Report for International Application No. PCT/US12/36252 dated Aug. 7, 2012 (3 pages).
PCT International Search Report for International Application No. PCT/US13/35986 dated Jul. 28, 2014 (5 pages).
PCT International Search Report for International Application No. PCT/ US2013/40097 dated Sep. 10, 2013 (2 pages).
PCT Written Opinion of the International Search Authority for International Application No. PCT/US13/35986 dated Jul. 28, 2014 (11 pages).
PCT Written Opinion of the International Searching Authority for International Application No. PCT/US09/01348 dated Apr. 29, 2009 (5 pages).
PCT Written Opinion of the International Searching Authority for International Application No. PCT/US09/01542 dated May 5, 2009 (5 pages).
PCT Written Opinion of the International Searching Authority for International Application No. PCT/US10/01981 dated Sep. 15, 2010 (7 pages).
PCT Written Opinion of the International Searching Authority for International Application No. PCT/US10/02464 dated Nov. 5, 2010 (5 pages).
PCT Written Opinion of the International Searching Authority for International Application No. PCT/US11/00061 dated May 19, 2011 (9 pages).
PCT Written Opinion of the International Searching Authority for International Application No. PCT/US11/01914 dated Apr. 2, 2012 (8 pages).
PCT Written Opinion of the International Searching Authority for International Application No. PCT/US12/36252 dated Aug. 7, 2012 (5 pages).
PCT Written Opinion of the International Searching Authority for International Application No. PCT/US12/60498 dated Jan. 2, 2013 (6 pages).
PCT Written Opinion of the International Searching Authority for International Application No. PCT/US13/40097 dated Sep. 10, 2013 (28 pages).
Response to Notification of the First Office Action from the State Intellectual Property Office of People's Republic of China dated Oct. 12, 2012 corresponding to Chinese Patent Application No. 2009/0107943.1; with English translation (21 pages).
Response to Notification of the Second Office Action from the State Intellectual Property Office of People's Republic of China dated Sep. 30, 2013 corresponding to Chinese Patent Application No. 201080038724.5; with English translation (18 pages).
Response to Notification of the Second Office Action from the State Intellectual Property Office of People's Republic of China dated Apr. 18, 2013 corresponding to Chinese Patent Application No. 200980107943.1; with English translation (17 pages).
Ferrotec, Thermoelectric Technical Reference—Basic Principles of Thermoelectric Materials, https://thermal.ferrotec.com/technology/thermoelectric/thermalRef02Copyright 2001-2015 (2 pages).
Kennedy, C. E., Review of Mid-To High-Temperature Solar Selective Absorber Materials, Technical Report, Jul. 2002; Retrieved from the Internet URL: http://large.stanford.edu/publications/power/references/troughnet/solarfield/docs/31267.pdf.
Laird Technologies—Innovative Technology for a Connected World, Thermoelectric Handbook, "Product Information Assembly Information Performance and Properties", Copyright 2010 (19 pages).
PCT International Search Report for International Application No. PCT/US13/41132 dated Oct. 29, 2013 (5 pages).
PCT International Search Report for International Application No. PCT/US2013/077444 dated Apr. 30, 2014 (2 pages).
PCT Written Opinion of the International Search Authority for International Application No. PCT/US2013/77444 dated Apr. 30, 2014 (16 pages).
PCT Written Opinion of the International Searching Authority for International Application No. PCT/US13/41132 dated Oct. 29, 2013 (17 pages).
Response to Notification of the First Office Action from the State Intellectual Property Office of People's Republic of China dated Jun. 15, 2015 corresponding to Chinese Patent Application No. 2013103256104; with English translation (5 pages).
Notification of Third Office from the State Intellectual Property Office of People's Republic of China dated Apr. 25, 2016 corresponding to Chinese Patent Application No. 201310325610.4, with English translation (15 pages).

* cited by examiner

METHOD AND APPARATUS FOR SWITCHED THERMOELECTRIC COOLING OF FLUIDS

CROSS-REFERENCE TO RELATED APPLICATIONS

This application claims priority to the following U.S. Provisional Applications: U.S. Provisional App. No. 61/205,114, with a filing date of Jan. 15, 2009; U.S. Provisional App. No. 61/197,223, with a filing date of Oct. 24, 2008; U.S. Provisional App. No. 61/137,411, with a filing date of Jul. 30, 2008; and U.S. Provisional App. No. 61/068,173 with a filing date of Mar. 5, 2008. The disclosures of each of the applications cited in this paragraph are hereby incorporated by reference in their entireties.

BACKGROUND

The present invention generally relates to the field of cooling systems. More specifically, it relates to efficient fluid cooling systems and a method for their operation.

Various types of cooling systems are available commercially. Examples of these cooling systems include, but are not limited to, vapor compression systems and thermoelectric cooling systems. Conventional vapor compression systems use chlorofluorocarbons (CFC) refrigerants such as Freon, hydrochloroflurocarbon (HCFC) refrigerants such as R134, or hydrofluorocarbons (HFC) refrigerants such as R410 for cooling purposes. However, the use of CFC refrigerants is being phased out because they pose a threat to the environment. The CFC refrigerants, when exposed to the atmosphere, cause depletion in the ozone layer. This is a major threat to the environment, since the absence of the ozone layer increases the amount of ultraviolet radiation on the earth, which in turn may affect the health of humans and animals. Further, these refrigerants (CFC, HCFC and HFC) contribute to global warming by absorbing infrared radiation. In fact, they can absorb about 1,000 to 2,000 times more infrared radiation than carbon dioxide. In addition to being a potential threat to the environment, the vapor compression systems using these refrigerants are heavy, create noise, and vibrate when in use.

Thermoelectric cooling systems are reliable, lightweight, and an environment-friendly alternative to traditional vapor compression systems. Conventional thermoelectric cooling systems use one or more thermoelectric couples in conjunction with a DC power source. When these thermoelectric cooling systems are switched off, heat flows through the thermoelectric couples, thereby warming the cooled chamber to ambient temperature. As a result, to maintain a cold chamber at a desired temperature, conventional thermoelectric cooling systems need to be switched on for long intervals of time, which increases power consumption. Thus, conventional thermoelectric cooling systems are inefficient for cold storage purposes.

In the last decade, efforts made to increase the coefficient of performance (COP) of the thermoelectric devices included using improved materials, such as nano-structured bismuth telluride bulk materials, in the thermoelectric devices. However, the improved COP of the thermoelectric devices using such improved materials is limited to less than one at room temperature. Another attempt to increase the COP included methods for reducing the temperature differential across the thermoelectric devices by using improved heat exchangers and properly optimized currents. These methods also have limited COP enhancements and all the advantages are lost when steady-state temperatures are attained. Therefore, the performance of the thermoelectric cooling systems is still not as efficient as that of the vapor compression refrigeration systems.

Improved devices are required that can regulate heat flow through the thermoelectric couples efficiently.

Accordingly, there is a need for a power-efficient and eco-friendly cooling system.

SUMMARY

In an embodiment of the present invention, a cooling system is provided. The cooling system includes a first chamber containing a first fluid, and a second chamber connected to the first chamber and containing a second fluid. The cooling system further includes a thermoelectric device for cooling the second fluid in the second chamber, and a first body that acts as a thermal diode. One end of the first body is connected to a heat sink of the thermoelectric device, and the other end is connected to the first chamber.

When the thermoelectric device is switched on, the temperature of a hot side of the thermoelectric device is higher than the temperature of the first fluid, and the first body acts as a thermal conductor. Therefore, heat is transferred from the second chamber to the first fluid in the first chamber. When the thermoelectric device is turned off, the first body acts as a thermal insulator and prevents backflow of heat into the second fluid in the second chamber. Thus, the first body has a directional dependency on the flow of the heat.

The heat dissipated at the heat sink of the thermoelectric device is transferred to the first fluid through the first body. The first fluid has a greater heat capacity than that of the second fluid. Consequently, the temperature of the first fluid remains essentially constant when the thermoelectric device is turned on.

According to an embodiment of the present invention, the first body includes a first conductor and a second conductor. The first conductor and the second conductor enable the first body to absorb heat from the hot side of the thermoelectric device and transfer it to the first fluid in the first chamber efficiently. The first body also includes one or more insulating sections between the conductors. The first body includes a fluid reservoir that stores a working fluid inside the first body. The working fluid transfers heat from the first conductor to the second conductor. In one embodiment, the first body also includes an insulator block, which prevents the working fluid from contacting the second conductor. Thus, the insulator block prevents any reverse flow of the heat from the second conductor to the first conductor through direct contact with the fluid reservoir.

According to another embodiment of the present invention, one or more thermal capacitors, such as phase change materials (alternatively referred to as a phase change material), are provided in either or both of the first and the second chamber of the cooling system. The installation of the phase change materials in the cooling system helps in limiting the temperature differential between the first chamber and the second chamber of the cooling system, which increases the efficiency of the cooling system. Further, the phase change materials maintain the second fluid within a desired temperature range.

In another embodiment of the present invention, the cooling system includes a cooling brick, which contains a thermoelectric cooler module, a vapor diode, and a switching circuit (alternatively referred to as a circuit). In accordance with various embodiments of the present invention, the cooling brick is used in cooling systems such as refrigerators, portable coolers, and water dispensers.

In an embodiment of the present invention, the switching circuit is provided. The switching circuit senses the temperature of a fluid and switches the cooling brick on when the temperature of the fluid is higher than an upper limit of temperature. Similarly, when the temperature of the fluid is lower than a lower limit of temperature, the switching circuit switches the cooling brick off. Thus, the switching circuit maintains the temperature of the fluid within a predefined range.

In another embodiment of the present invention, a symmetric vapor diode is provided. The symmetric vapor diode includes a first surface and a second surface, which are similar in structure. The first surface and second surface are connected to hot sides of thermoelectric devices. The symmetric vapor diode can conduct higher heat flux as compared with asymmetrical vapor diodes due to symmetry.

In another embodiment of the present invention, a mixed fluid vapor diode is provided which contains two asymmetric vapor diodes in parallel. A first asymmetric vapor diode contains a first working fluid that has a low boiling point. A second asymmetric vapor diode contains a second working fluid that has a high boiling point. The mixed fluid vapor diode is efficient at low temperature as well as high temperature.

In yet another embodiment of the present invention, a split thermoelectric cooling device containing a cooling chamber, to which a primary thermoelectric device and a secondary thermoelectric device are connected, is provided. The primary thermoelectric device is connected to a primary thermal diode that dissipates the heat extracted by the primary thermoelectric device to the ambient. The primary thermoelectric device is switched on and off based on the temperature of the cooling chamber. The secondary thermoelectric device is kept in a switched on mode to overcome the heat leakage into the cooling chamber. In an embodiment, the split thermoelectric cooling device further comprises a secondary thermal diode connected to the secondary thermoelectric device.

In another embodiment, a louvred heat sink is provided which allows directional flow of heat through the heat sink and acts as a thermal diode.

In another embodiment of the present invention, a two-stage thermoelectric cooling device is provided with multi-stage thermoelectric coolers such as two primary thermoelectric devices and two secondary thermoelectric devices.

In another embodiment of the present invention, a method for operating a thermoelectric cooling system comprising the first fluid, the second fluid, the thermoelectric device and the thermal diode is provided. The method comprises checking the temperature of the second fluid and switching on the thermoelectric device when the temperature of the second fluid is equal to or more than the upper limit of the temperature. Furthermore, the method comprises switching off the thermoelectric device when the temperature of the second fluid is equal to or less than the lower limit of the temperature.

BRIEF DESCRIPTION OF THE DRAWINGS

The preferred embodiments of the present invention will hereinafter be described in conjunction with the appended drawings, provided to illustrate and not to limit the present invention, wherein like designations denote like elements, and in which.

DETAILED DESCRIPTION OF THE INVENTION

Before describing the embodiments in detail, in accordance with the present invention, it should be observed that these embodiments reside primarily in the method and apparatus for cooling of fluids. Accordingly, the method steps and the system components have been represented to show only those specific details that are pertinent for an understanding of the embodiments of the present invention, and not the details that will be apparent to those with ordinary skill in the art.

Figure 1:
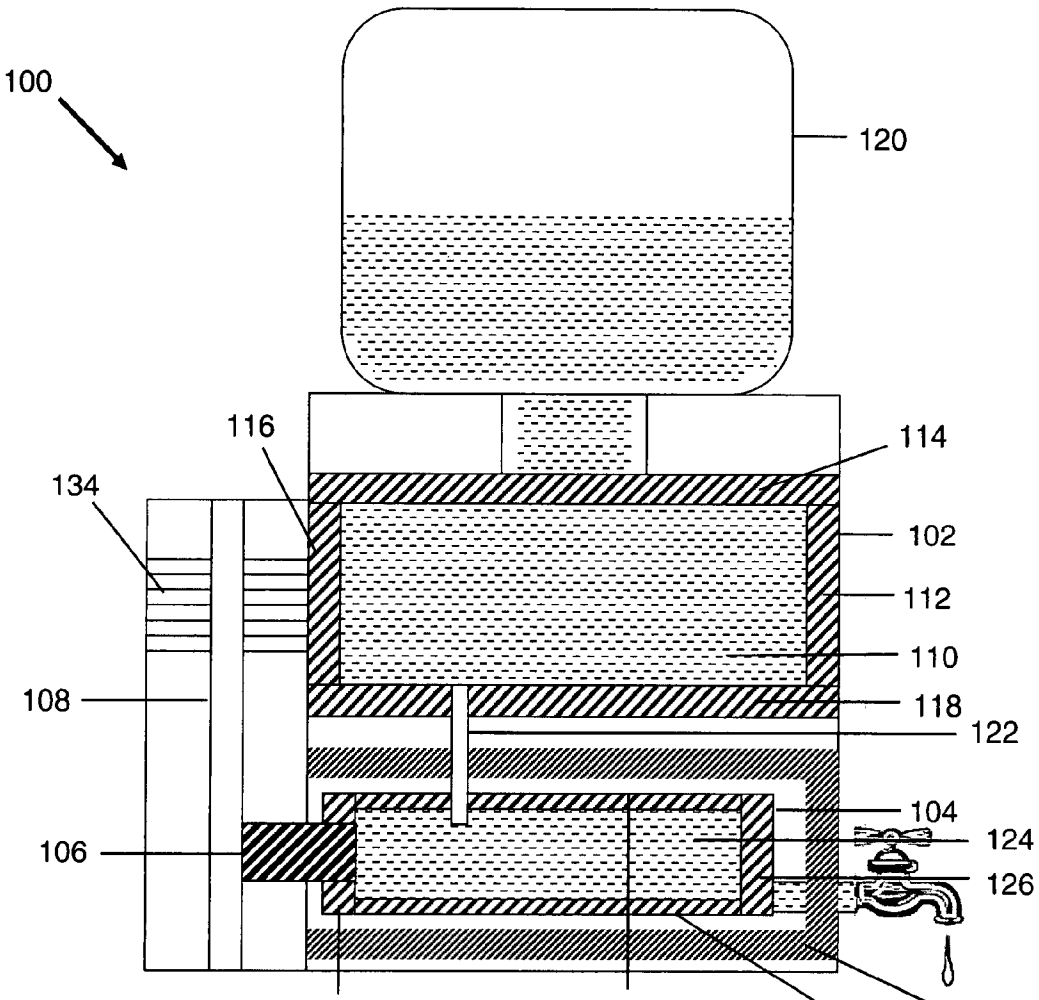
FIG. 1 to FIG. 22 illustrate schematic cross-sectional views of cooling systems, in accordance with various embodiments of the present invention.

FIG. 1 illustrates a cross-sectional view of a cooling system 100, in accordance with an embodiment of the present invention. Cooling system 100 includes a first chamber 102, a second chamber 104, a thermoelectric device 106, and a first body 108.

In cooling system 100, first chamber 102 contains a fluid to be cooled, hereinafter referred to as a first fluid 110. First fluid 110 is contained within walls 112, 114, 116 and 118 of first chamber 102. The fluid may be supplied to first chamber 102 through various methods, for example, through a fluid pipe, a fluid container, etc. In accordance with the present embodiment, first chamber 102 is shown to receive first fluid 110 from a fluid container 120. In an exemplary embodiment of the present invention, first fluid 110 is water. First chamber 102 provides first fluid 110 to second chamber 104 through a fluid pipe 122.

The fluid is cooled in second chamber 104. For the purpose of this description, the fluid in second chamber 104 is referred to as a second fluid 124. Second fluid 124 is contained within insulating walls 126, 128, 130, and 132 of second chamber 104. Insulating walls 126, 128, 130, and 132 isolate second fluid 124 from the ambient and prevent it from warming when thermoelectric device 106 is turned off. In accordance with various embodiments, insulating walls 126, 128, 130, and 132 are made of a material with low thermal conductivity, for example, polyurethane, plastic foams, and so forth. Thermoelectric device 106, which is present in cooling system 100, is used to cool second fluid 124 in second chamber 104. Typically, when a DC current flows through thermoelectric device 106, thermoelectric device 106 extracts heat from second chamber 104, thereby making second fluid 124 cooler, and dissipates the extracted heat and the joule heat of the thermoelectric device to an end of first body 108 connected to thermoelectric device 106, which is referred to as a heat sink (alternatively referred to as a hot side). In an exemplary embodiment, thermoelectric device 106 is a thermoelectric cooler. In accordance with various embodiments of the present invention, thermoelectric device 106 cools second fluid 124, which is present in second chamber 104, and dissipates the extracted heat and the joule heat of thermoelectric device 106 to the heat sink present at the end of thermoelectric device 106. As a result, second fluid 124 attains a lower temperature than first fluid 110.

In accordance with an embodiment, the typical temperature differential between first fluid 110 and second fluid 124 varies from 20 degrees centigrade to 25 degrees centigrade. Cooling system 100 enhances the cooling efficiency by maintaining a low temperature differential. For the purpose of this description, only two chambers have been shown. However, it will be apparent to a person skilled in the art that cooling system 100 may include more than two chambers, and the cooling scheme can be cascaded to cool the fluids to lower temperatures. In addition, thermoelectric device 106 can be a multi-stage thermoelectric cooler or a combination of multiple thermoelectric devices.

In accordance with various embodiments, the heat sink of thermoelectric device 106 is connected to first body 108, which includes a first end and a second end. The first end is mechanically connected to the heat sink of thermoelectric device 106, while the second end is mechanically connected to first chamber 102 in a manner such that first body 108 enables the transfer of heat dissipated at the heat sink of thermoelectric device 106 to first fluid 110 in first chamber 102. In accordance with an embodiment, the second end includes conducting parts 134 that enable the transfer of heat to first fluid 110. First body 108 acts as a thermal conductor when the temperature of the heat sink of thermoelectric device 106 is higher than the temperature of first fluid 110, thereby enabling a flow of heat from thermoelectric device 106 to first fluid 110. Alternatively, first body 108 acts as a thermal insulator when the temperature of first fluid 110 is higher than the temperature of the heat sink of thermoelectric device 106, thus preventing the flow of heat from first fluid 110 to the heat sink of thermoelectric device 106. Consequently, first body 108 has a directional dependency on the flow of heat. In various embodiments of the present invention, first fluid 110 and second fluid 124 are water. Since water has a high-specific heat capacity, as compared with other liquids, it is most suitable to maintain a constant temperature in first chamber 102. Additionally, the volume of first fluid 110 in first chamber 102 is greater than the volume of second fluid 124 in second chamber 104. Thus, first fluid 110 in first chamber 102 has a higher heat-carrying capacity than second fluid 124 in second chamber 104. Consequently, the temperature of first fluid 110 is relatively constant when thermoelectric device 106 is turned on.

First body 108 comprises one or more insulating sections, such as an insulator (described in detail in conjunction with FIG. 38) to prevent the transfer of heat from the heat sink of thermoelectric device 106 to second fluid 124. The insulator of first body 108 can be made of a thermally insulating material, such as machinable ceramics and thin stainless steel tubes. When thermoelectric device 106 is turned off, first body 108 acts as a thermal insulator and prevents the temperature of second fluid 124 from increasing.

In accordance with an embodiment, second chamber 104 is enclosed by an insulating wall 136. Insulating wall 136 helps in preventing the transfer of heat from the ambient to second fluid 124, thereby maintaining second fluid 124 within a constant temperature range. In an exemplary embodiment, the constant temperature range is between 5 degrees centigrade and 8 degrees centigrade. In accordance with various embodiments, insulating wall 136 is made of a material with low thermal conductivity. Typical examples of materials with low thermal conductivity include polyurethane and plastic foam.

Figure 2:
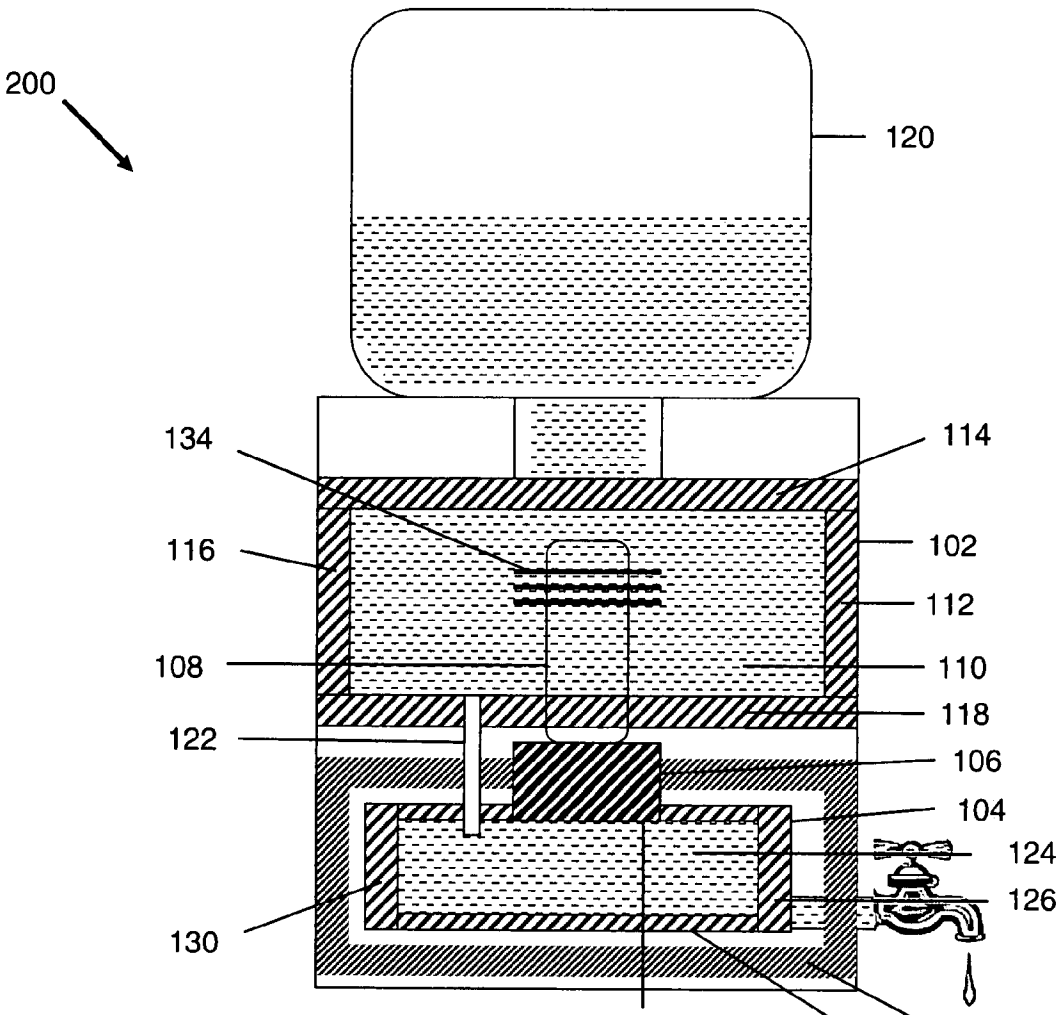

FIG. 2 illustrates a cross-sectional view of a cooling system 200, in accordance with another embodiment of the present invention. Cooling system 200 includes first chamber 102, second chamber 104, and thermoelectric device 106, as described in reference with FIG. 1.

In accordance with this embodiment, cooling system 200 includes a varied arrangement of thermoelectric device 106. In accordance with this arrangement, the first end of first body 108 is mechanically connected to the heat sink of thermoelectric device 106, and the second end is mechanically connected to first chamber 102. Further, the second end is inside first chamber 102 and is exposed to first fluid 110 to transfer heat into first fluid 110. Furthermore, the second end includes conducting parts 134 that enable the transfer of heat to first fluid 110.

The advantage of this embodiment is that it facilitates an effective transfer of heat from the heat sink of thermoelectric device 106 to first fluid 110 in first chamber 102. To prevent the reverse flow of heat, the insulator (described in detail in conjunction with FIG. 38) of first body 108 is provided at the interface of first chamber 102 and second chamber 104.

Figure 3:
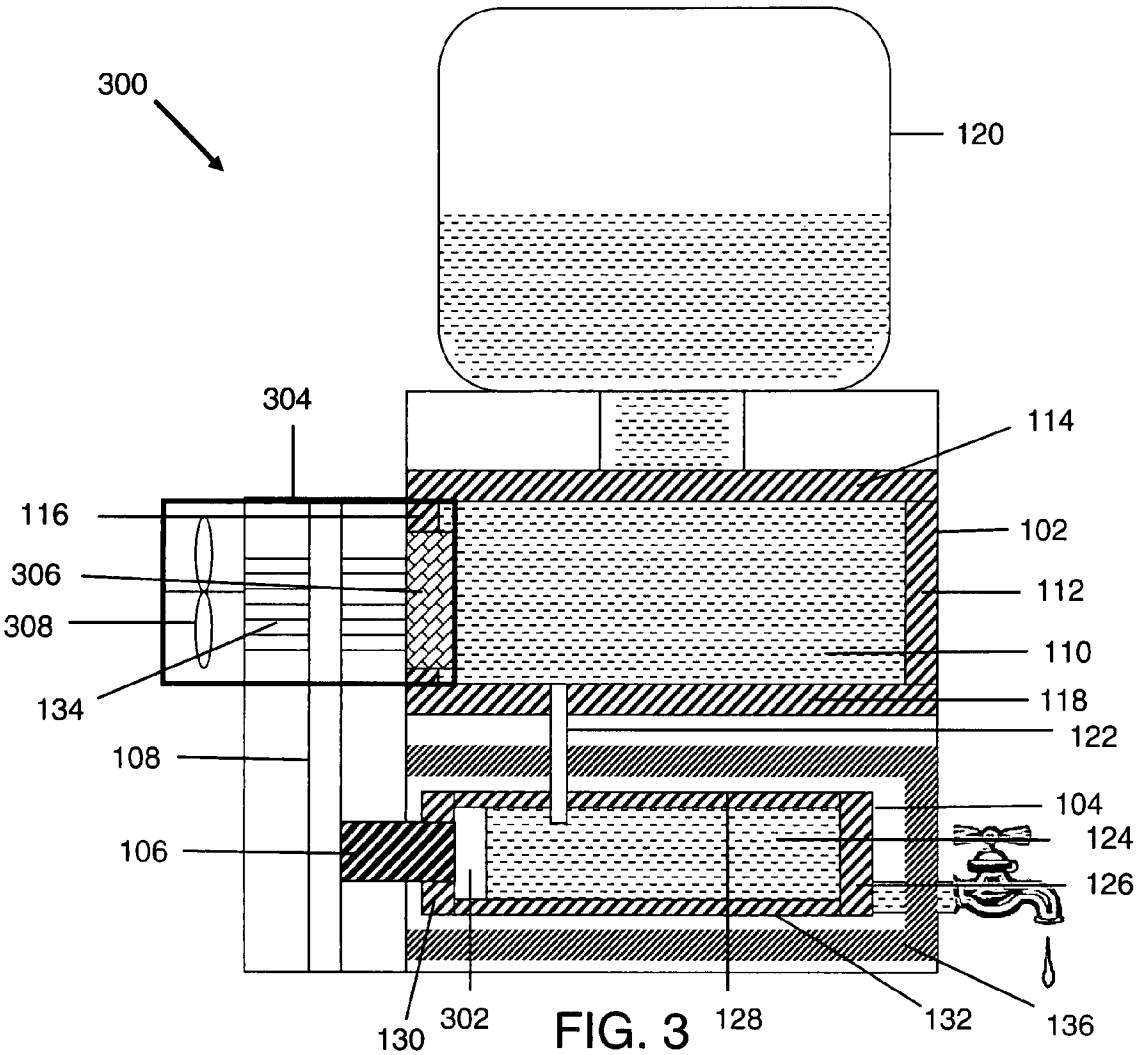

FIG. 3 illustrates a cross-sectional view of a cooling system 300, in accordance with yet another embodiment of the present invention. Cooling system 300 includes, in addition to the elements described with reference to FIG. 1, a phase change material (PCM) 302 and an evaporative cooling device 304.

In accordance with an embodiment, PCM 302 is present in second chamber 104. Also, PCM 302 is adjacent to a cold end of thermoelectric device 106, thus maintaining second fluid 124 in second chamber 104 within a constant temperature range. In an exemplary embodiment, PCM 302 is a package of blue-ice PCM. In another exemplary embodiment, PCM 302 is made of paraffin. Typical examples of paraffin that are used to make PCM 302 include eicosane and docosane. In another exemplary embodiment, PCM 302 is made of salt hydrates. Magnesium sulfate heptahydrate is an example of a typical salt hydrate that is used to make PCM 302. In yet another exemplary embodiment, PCM 302 is made of liquid metals. Typical examples of liquid metals that are used to make PCM 302 include, but are not limited to, gallium indium and tin alloys.

In accordance with another embodiment of the present invention, evaporative cooling device 304 is provided for first chamber 102. Evaporative cooling device 304 cools first fluid 110 in first chamber 102. Typically, an evaporative cooling device cools a fluid body by enabling a part of the fluid from the fluid body to evaporate to the ambient environment, thereby absorbing latent heat from the fluid body. In accordance with another embodiment, first fluid 110 seeps from first chamber 102 through a porous plate 306. In an exemplary embodiment of the present invention, the porous plate is made of ceramic. The porous plate helps in the transfer of the fluid from first chamber 102 to the ambient environment. The seeped fluid is evaporated by using an air fan 308, thereby rendering the desired cooling effect. In another exemplary embodiment, evaporative cooling device 304 is made of a disposable and replaceable porous paper mesh. Evaporative cooling device 304 can also serve as a humidifier in a dry environment.

By using PCM 302, this arrangement facilitates long duty cycles for thermoelectric device 106, thereby increasing its efficiency. The efficiency further increases due to the presence of evaporative cooling device 304, which helps in lowering the temperature of first fluid 110 and creates a lower temperature differential across thermoelectric device 106. Since a lower temperature differential improves the efficiency, the operation of thermoelectric device 106 is more efficient in this embodiment. In accordance with an exemplary embodiment, the resulting temperature differential across thermoelectric device 106 due to the use of evaporative cooling device 304 is about 15 degrees centigrade.

Figure 4:
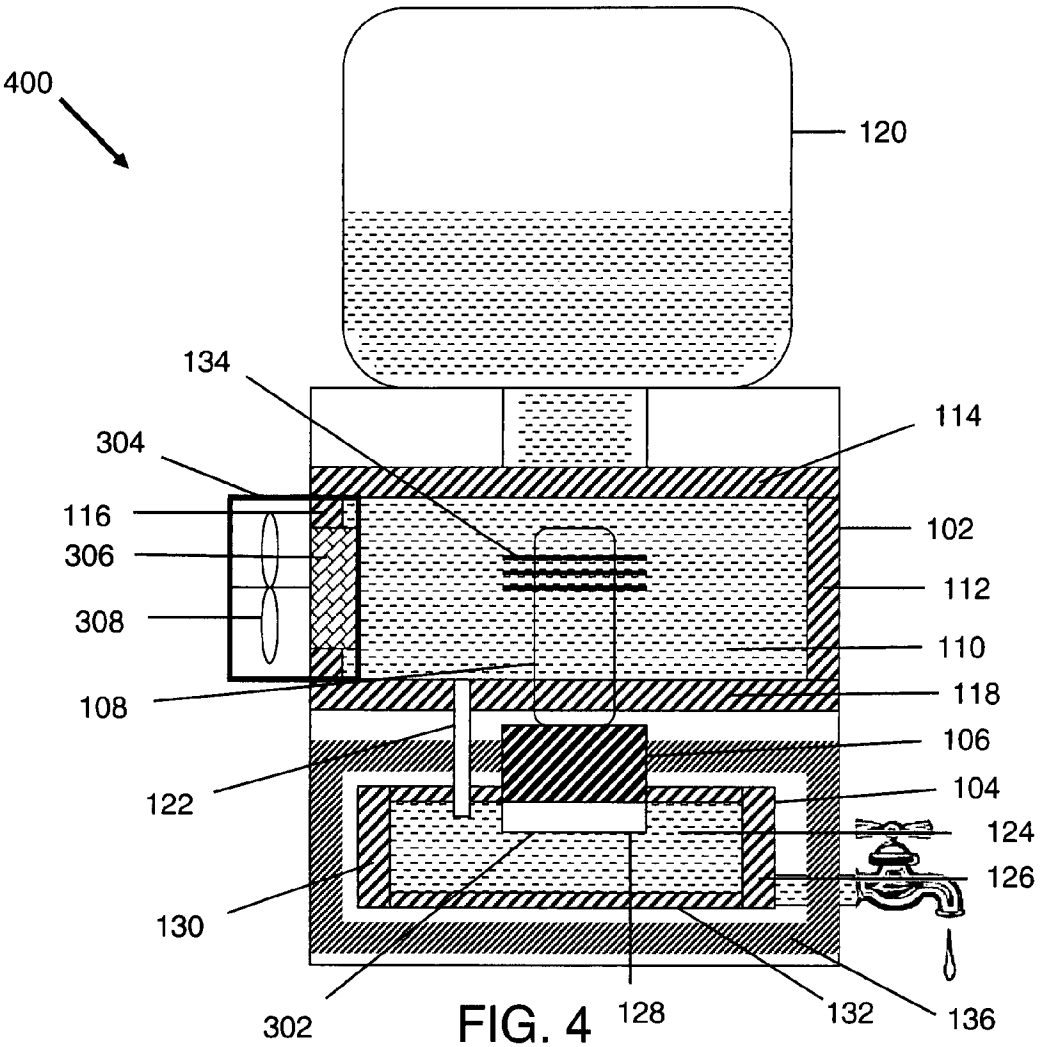

FIG. 4 illustrates a cross-sectional view of a cooling system 400, in accordance with yet another embodiment of the present invention. Cooling system 400 includes the elements described with reference to FIG. 2 and FIG. 3, however, with a varied arrangement of thermoelectric device 106 and PCM 302. In accordance with this arrangement, the first end of first body 108 is mechanically connected to the heat sink of thermoelectric device 106, and the second end of first body 108 is mechanically connected to first chamber 102 to transfer heat into first fluid 110. In accordance with this embodiment, PCM 302 is located on the upper portion of second chamber 104 and is in contact with thermoelectric device 106. In accordance with an embodiment of the present invention, cooling system 400 includes evaporative cooling device 304 to cool first fluid 110.

Figure 5:
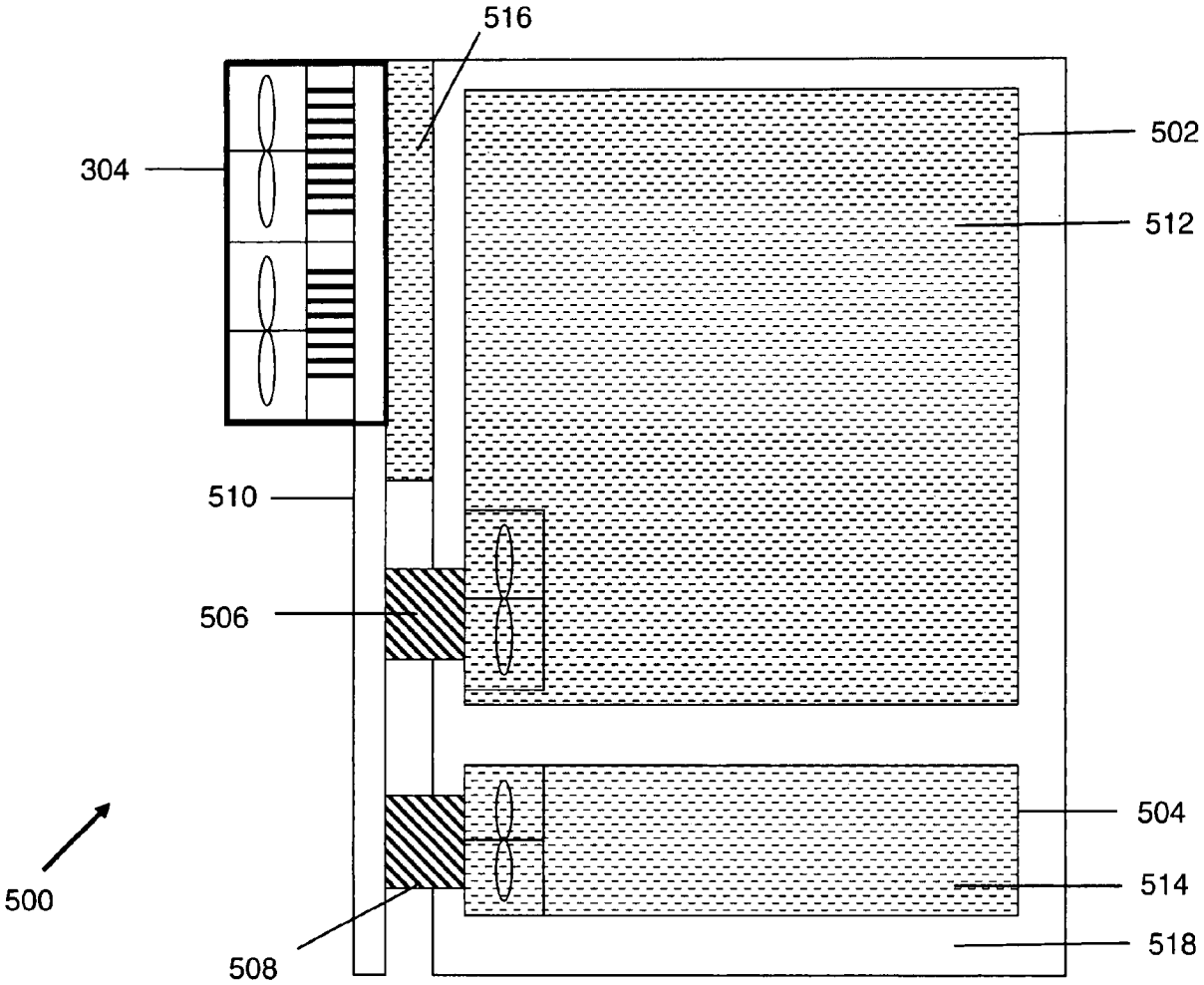

FIG. 5 illustrates a cross-sectional view of a cooling system 500, in accordance with yet another embodiment of the present invention. Cooling system 500 includes a refrigerator part 502, a freezer part 504, a first cooler 506, a second cooler 508, and a second body 510.

In accordance with an embodiment, refrigerator part 502 includes a first output fluid 512 to be cooled. Freezer part 504 is thermally isolated from refrigerator part 502, and includes a second output fluid 514. In an exemplary embodiment, first output fluid 512 and second output fluid 514 are air. First cooler 506 that is present in refrigerator part 502 cools first output fluid 512. Further, second cooler 508 that is present in freezer part 504 cools second output fluid 514. In another exemplary embodiment, either or both of first cooler 506 and second cooler 508 are two-stage thermoelectric cooling systems. In addition, according to an arrangement, both first cooler 506 and second cooler 508 are connected to second body 510.

Second body 510 is a system of thermal conductors with a directional heat flow. Second body 510 includes a first end and a second end. The first end of second body 510 is mechanically connected to the heat sinks of first cooler 506 and second cooler 508. Further, the second end of second body 510 is mechanically connected to a water reservoir 516. The presence of water reservoir 516 improves the efficiency of the cooling system. However, it should be apparent to a person skilled in the art that the present invention may be used in vapor compressor systems where a condensing coil is immersed or is in contact with such a water reservoir. Second body 510 enables the transfer of heat dissipated at the heat sinks of first cooler 506 and second cooler 508 to water reservoir 516 when thermoelectric coolers 506 and 508 are switched on. Further, second body 510 comprises an insulator (described in detail with reference to FIG. 38). The directional property of second body 510 prevents the transfer of heat from water reservoir 516 to the heat sinks of first cooler 506 and second cooler 508. The working of second body 510 is similar to the working of first body 108, which is described in detail in conjunction with FIG. 38.

In accordance with another embodiment, freezer part 504 is enclosed in an insulating wall 518. Further, insulating wall 518 helps in preventing the transfer of heat from the ambient environment to second output fluid 514, thereby maintaining second output fluid 514 within a desired range of temperature.

In accordance with yet another embodiment of the present invention, evaporative cooling device 304 is provided to cool water reservoir 516. Since the heat from first cooler 506 and second cooler 508 is dissipated in water reservoir 516, evaporative cooling device 304 maintains water reservoir 516 within a desired range of temperature.

Figure 6:
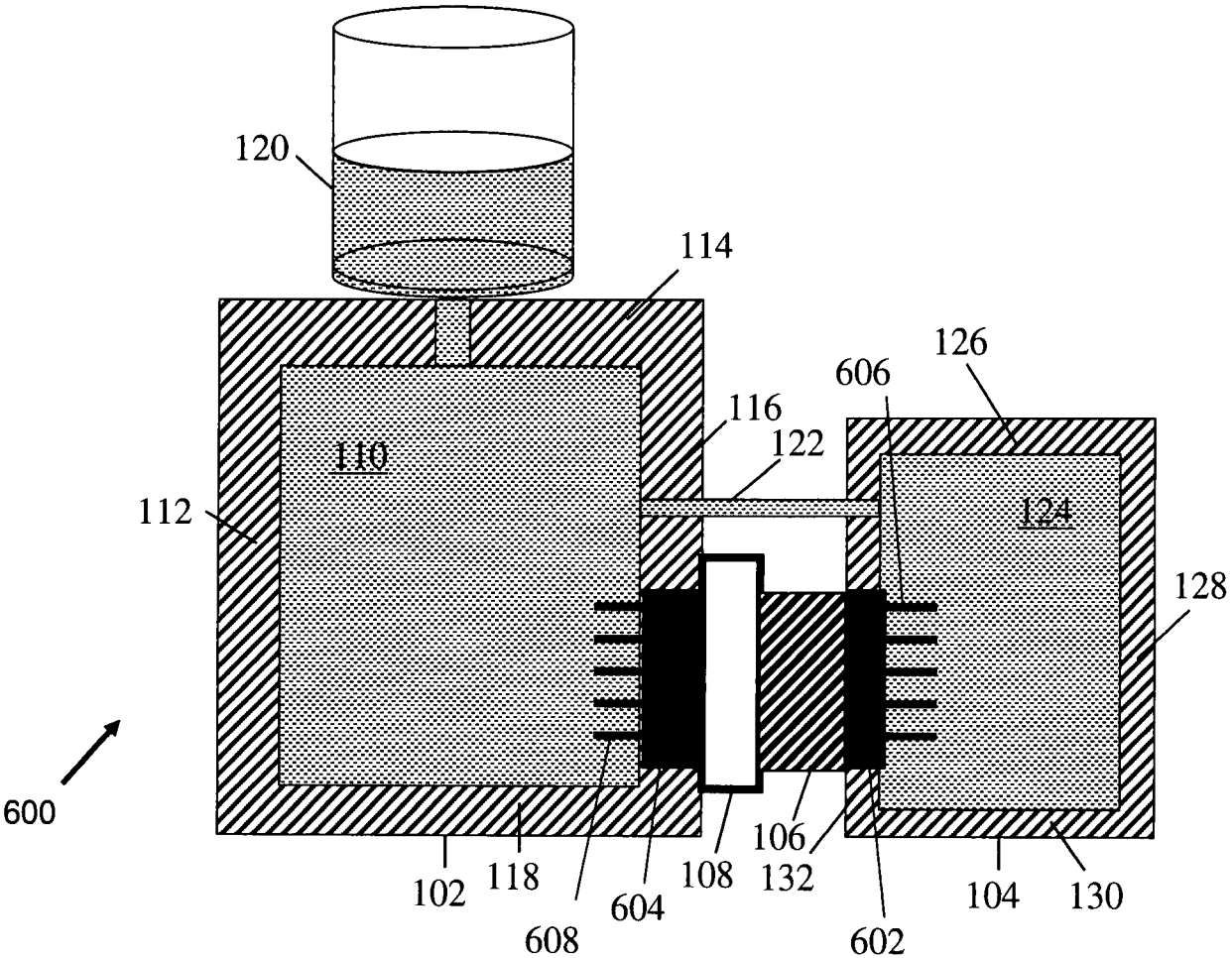

FIG. 6 illustrates a cross-sectional view of a cooling system 600, in accordance with yet another embodiment of the present invention.

In accordance with an embodiment of the invention, first chamber 102 is referred to as a warm water reservoir and second chamber 104 is referred to as a cold water reservoir. In addition to the elements mentioned in conjunction with FIG. 1, cooling system 600 contains a first metal block 602, a cold sink 606, a second metal block 604, and a heat sink 608.

In an embodiment, both first chamber 102 and second chamber 104 are placed on the same elevation. In this arrangement, first fluid 110 flows through fluid pipe 122 with the aid of hydrostatic pressure. In another embodiment of the invention, where fluid container 120 is at a lower elevation than first chamber 102 and second chamber 104, an external pump and a flexible tube supply water to first chamber 102.

In an exemplary embodiment, first fluid 110 is maintained within the temperature range of 25 degrees Celsius to 30 degrees Celsius. Further, in an embodiment of the present invention, thermoelectric device 106 maintains second fluid 124 within a desired temperature range, typically between 5 degrees Celsius and 8 degrees Celsius.

In accordance with the various embodiments of the invention, first body 108 is a thermal diode, and thermoelectric device 106 is a thermoelectric cooler. A first end of first body 108 is mechanically connected, with a high performance thermal interface material (not shown) in between, to the hot side of thermoelectric device 106, which further is connected through first metal block 602 and cold sink 606 to second chamber 104. Similarly, a second end of first body 108 is mechanically connected, with highly conductive thermal interface material (not shown), to first chamber 102 through second metal block 604 and heat sink 608. This ensures efficient transfer of heat through first body 108, thereby cooling second fluid 124 in second chamber 104. Typical examples of high performance thermal interface materials include, but are not limited to, thermal epoxies, high density ceramic-based thermal compounds, and low temperature solders.

In accordance with various embodiments of the invention, the orientation of first chamber 102 with respect to second chamber 104 is shown to be horizontal. However, it will be apparent to a person skilled in the art that in other embodiments of the present invention, the orientation of first chamber 102 with respect to second chamber 104 can be vertical or any other possibly inclined arrangements.

Figure 7:
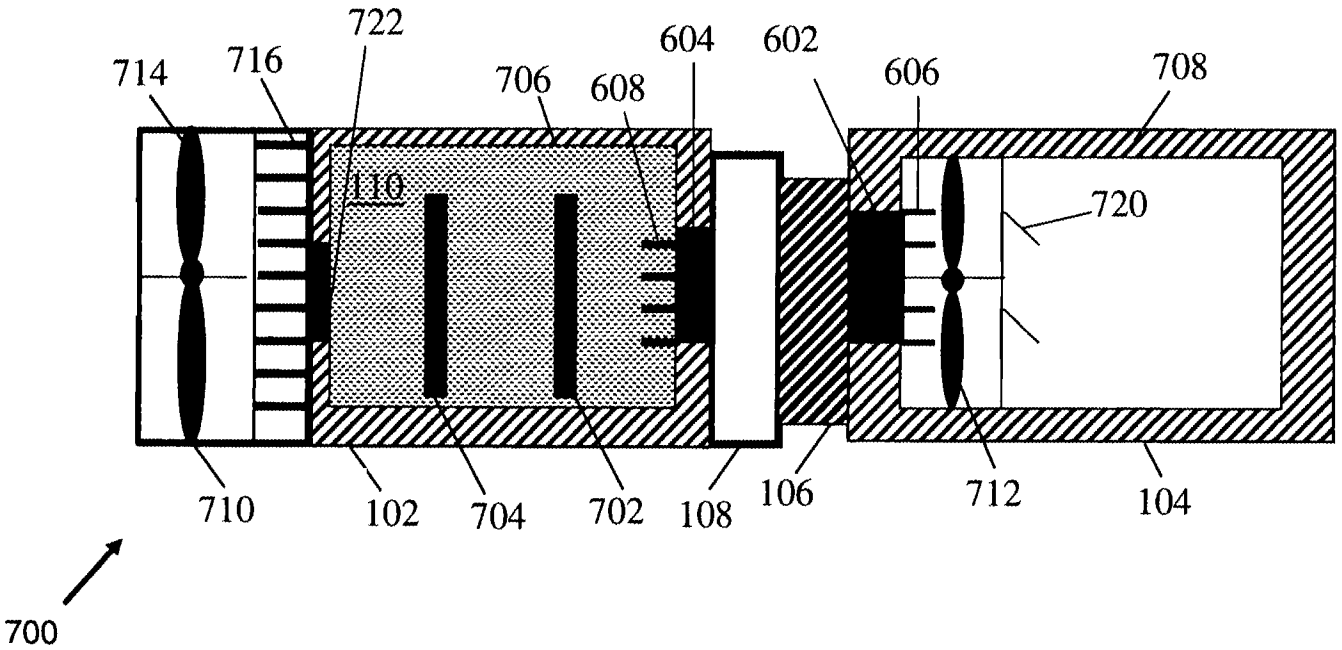

FIG. 7 illustrates a cross-sectional view of a cooling system 700, in accordance with yet another embodiment of the present invention. Cooling system 700 includes, in addition to the elements described with reference to FIG. 6, one or more phase change materials (PCM) 702 and 704, a wall 706, an insulating wall 708, air fans 712 and 714, a heat sink 716, louvers 720, and a metal block 722.

In accordance with this embodiment, cooling system 700 includes PCM 702 and PCM 704, which are provided in first chamber 102. According to an embodiment of the present invention, first chamber 102 is a water reservoir and second chamber 104 is a portable refrigerator. In an embodiment of the invention, the water reservoir with its high specific heat capacity acts as a thermal capacitor.

PCM 702 and PCM 704 have a high latent heat of fusion, which is absorbed or released when the material undergoes a phase change at a certain temperature. Such latent heat storage systems can maintain the temperature of first chamber 102 within a desired temperature range. Typically, the latent heat of fusion of PCM 702 and PCM 704 is greater than 250 KJ/Kg. Examples of the materials that are used as PCM 702 and PCM 704 include inorganic hydrated salts, paraffin, hydrocarbons, and the like. By using different phase change materials singly or in combination, the phase transition temperature can be set at any temperature within a range of 18 degrees Celsius to 35 degrees Celsius. According to the various embodiments of the invention, the temperature of first fluid 110 in first chamber 102 is limited to close to the room temperature by using PCM 702 and PCM 704. For better thermal contact with the fluid, the phase change materials can be packaged in aluminum (or other metal) cylinders that can be provided in first chamber 102. PCMs 702 and 704 can also have conductor structures that distribute heat within the package and increase the effective thermal conductance and the Biot number. It will be apparent to a person skilled in the art that even though only two PCMs 702 and 704 are described herein, a single PCM or more than two PCMs can also be used in first chamber 102, to maintain the temperature of first fluid 110 within a given range.

It will also be apparent to a person skilled in the art that even though PCMs are shown in first chamber 102, one or more PCMs can be provided in second chamber 104, to maintain the temperature of second fluid 124 within a given range. According to an embodiment of the invention, multiple PCMs, including blue ice, can be used for maintaining sub-ambient temperatures in second chamber 104. Typically, the use of PCMs enables maintaining the temperature of first fluid 110 in first chamber 102 and second fluid 124 in second chamber 104 within a given range.

In accordance with the present embodiment of the invention, insulating wall 708 covers second chamber 104 and prevents any exchange of heat between the cooling system 700 and the environment.

In accordance with an embodiment, a heat rejection device 710 is provided with first chamber 102. Heat rejection device 710 cools first fluid 110 in first chamber 102 through metal block 722 and heat sink 716. Heat sink 716 is cooled by air fan 714. In addition, air fan 712 is present in second chamber 104. Thermoelectric device 106 cools cold sink 606 while air fan 712 cools second chamber 104 by moving air through cold sink 606. The absence of air fan 712 may result in a high temperature gradient inside second chamber 104 with very cold air near cold sink 606 and warm air at the other end of second chamber 104. When thermoelectric device 106 is turned off and a small amount of heat leaks into second chamber 104, air fan 712 can be turned off to isolate the rest of second chamber 104. When air fan 712 is turned off, louvers 720 in front of air fan 712 can shut; thereby further isolating cold sink 606 from second chamber 104. Louvers 720 enhance the thermal diode action of cooling system 700.

By using PCM 702 and PCM 704, the hot side of thermoelectric device 106 is maintained close to room temperature when thermoelectric device 106 is activated, and first body 108 reduces the heat leakage to second chamber 104 when the thermoelectric device 106 is turned off. This arrangement enables smaller temperature differentials across thermoelectric device 106 and ensures smaller duty cycles for thermoelectric device 106, thereby increasing its energy efficiency significantly.

Figure 8:
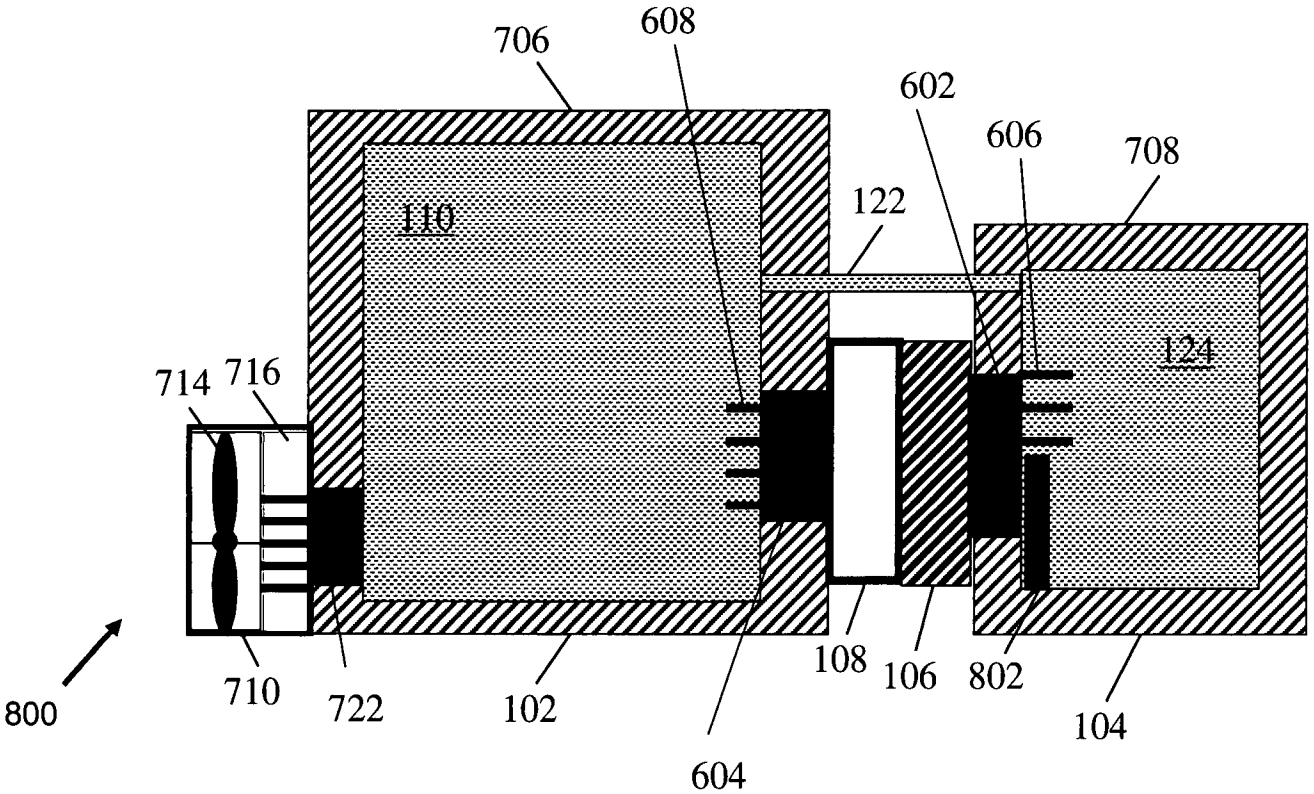

FIG. 8 illustrates a cross-sectional view of a cooling system 800, in accordance with yet another embodiment of the present invention. Cooling system 800 includes, in addition to the elements described with reference to FIG. 6 and FIG. 7, a phase change material (PCM) 802 provided in second chamber 104.

In an embodiment, PCM 802 is provided on one side of second chamber 104 where thermoelectric device 106 is connected. In accordance with this embodiment, PCM 802 covers only a portion of cold sink 606 of thermoelectric device 106, while the rest of cold sink 606 is in contact with second fluid 124. This partial overlap makes PCM 802 thermally in parallel with cold sink 606, thereby avoiding an increase in the cooling time of second fluid 124. In an exemplary embodiment, PCM 802 is a package of blue-ice PCM or a hydrated salt base material with a sub-ambient phase transition temperature. Magnesium sulfate heptahydrate is an example of a typical salt hydrate that is used to make PCM 802. In yet another exemplary embodiment, PCM 802 is made of liquid metals. Typical examples of liquid metals that are used to make PCM 802 include, but are not limited to, gallium indium and tin alloys.

In the present embodiment of the invention, cooling system 800 can be a water cooler in which the temperature of second fluid 124 in second chamber 104 is maintained at a predetermined temperature. To limit the temperature in second chamber 104, one or more PCMs, such as PCM 802, can be used. For instance, PCM 802 limits the temperature of cold sink 606 of thermoelectric device 106 to about 5 degrees Celsius, thereby limiting the temperature differential between the two chambers. Since water is a poor thermal spreader, cold sink 606 reaches a much lower temperature while the full volume of water is cooled. PCM 802 prevents the cooling of cold sink 606 and stores the excess energy through phase transition.

Figure 9:
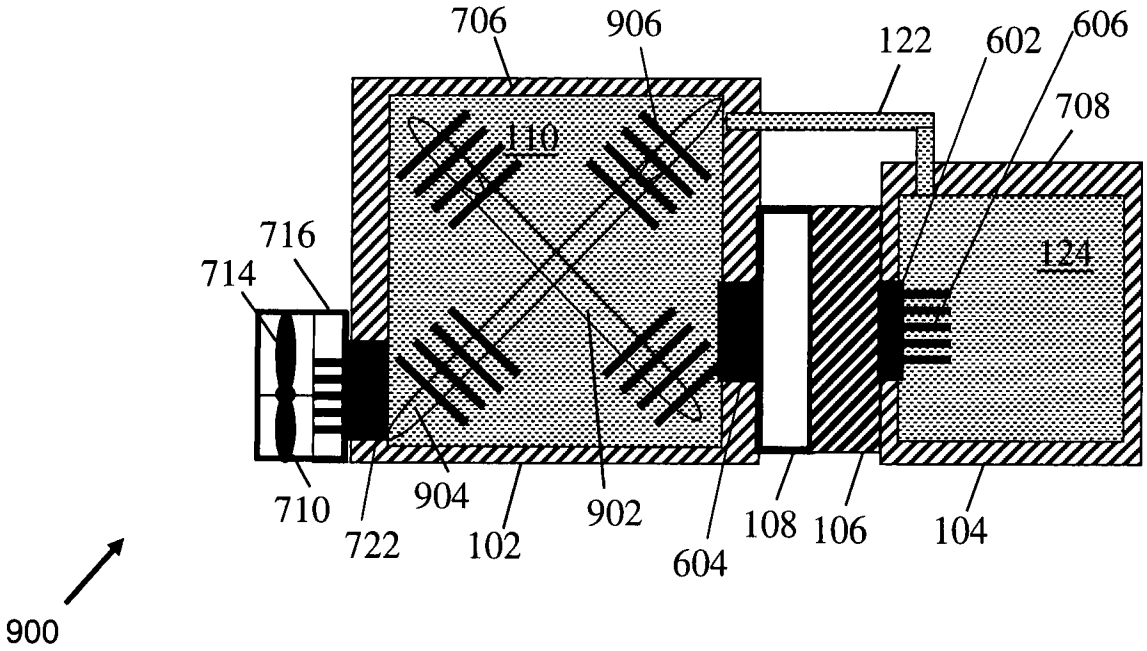

FIG. 9 illustrates a cross-sectional view of a cooling system 900, in accordance with yet another embodiment of the present invention. Cooling system 900 includes, in addition to the elements described with reference to FIG. 6 and FIG. 7, heat pipes 902 and 904 (alternatively referred to as one or more heat pipes) that are installed to maintain a constant temperature in first chamber 102. Heat pipes 902 and 904 are made of a material such as copper with fins 906 at the ends. Fins 906 act as efficient thermal spreaders. Furthermore, a comparatively larger first chamber 102 can be used in cooling system 900 by using heat pipes 902 and 904, to maintain a constant temperature throughout first chamber 102. In accordance with another embodiment of the invention, alcohol, or ammonia-based heat pipes that operate at sub-ambient temperatures are provided in second chamber 104. Similar to heat pipes 902 and 904, the heat pipes provided in second chamber 104 maintain a constant temperature throughout second chamber 104. In accordance with various embodiments of the invention, the use of heat pipes 902 and 904 is also advantageous in decreasing the heat transfer resistance (equivalent to increasing the Biot number for heat transfer) inside first chamber 102.

Figure 10:
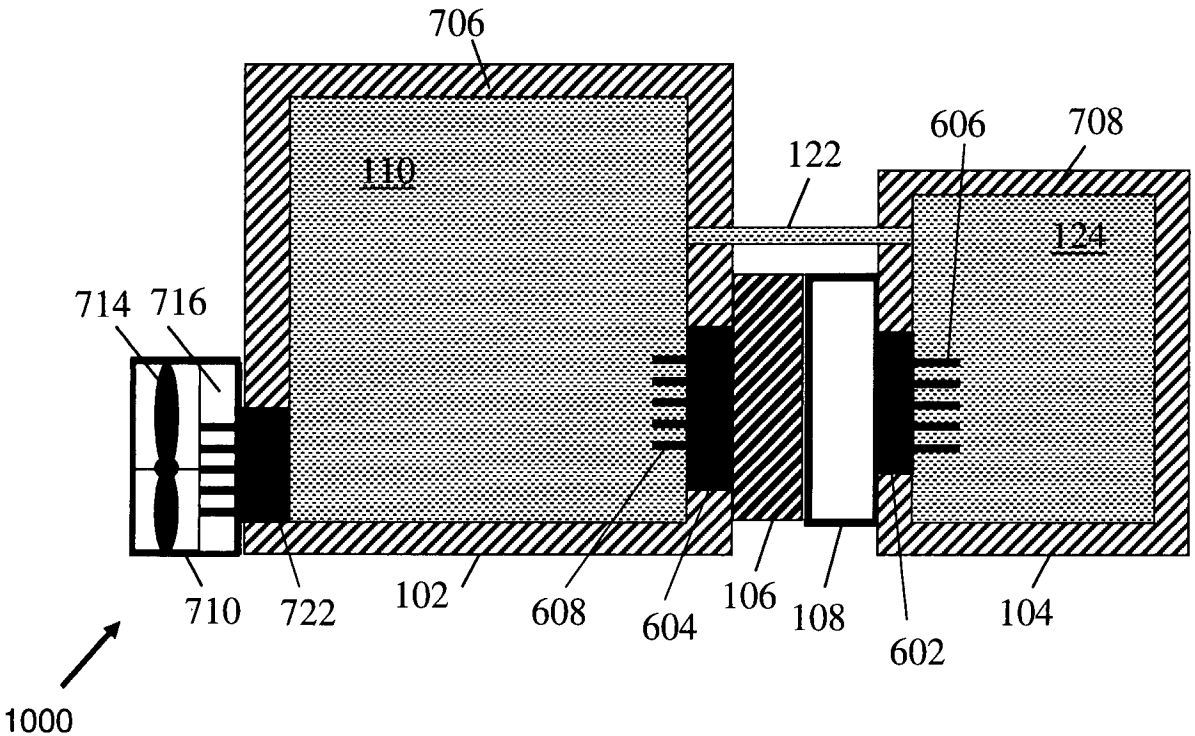

FIG. 10 illustrates a cross-sectional view of a cooling system 1000, in accordance with yet another embodiment of the present invention. Cooling system 1000 includes the elements described with reference to FIG. 6 and FIG. 7, with a varied arrangement of thermoelectric device 106 and first body 108. The present embodiment of the invention includes first body 108, which is in contact with second chamber 104 of cooling system 1000, and with a cold end of thermoelectric device 106, which is in contact with first chamber 102 of cooling system 1000. In accordance with the present embodiment, first body 108 transfers heat from second fluid 124 in second chamber 104 to the cold end of thermoelectric device 106. Thermoelectric device 106 extracts heat from first body 108 and dissipates it to first fluid 110 in first chamber 102. In the previous embodiments, first body 108 was attached to the hot end of thermoelectric device 106 and transferred a sum of heat extracted from second chamber 104 as well as the heat generated due to power consumption by the thermoelectric device. When first body 108 is attached to the cold end of thermoelectric device 106, it transfers only the heat extracted from second chamber 104. Thus, the heat flux through first body 108 is roughly half that of the previous embodiments. Since first body 108 has a finite thermal resistance, halving the heat flux reduces the loss in temperature and thereby leads to more efficient cooling of second chamber 104.

According to this embodiment of the invention, a working fluid with a lower heat of vaporization can be used for evaporation in first body 108 because of a lower heat flux. Examples of the working fluid with a lower heat of vaporization include ethyl alcohol, ammonia, and so forth. Lower heat flux also allows making first body 108 smaller in size and is suitable for applications where the hot side of thermoelectric device 106 cannot be modified. In the presence of an efficient fluid loop managing the hot side of one or more thermoelectric devices, providing the first body 108 on the cold side of the thermoelectric devices provides efficient storage solutions.

Figure 11:
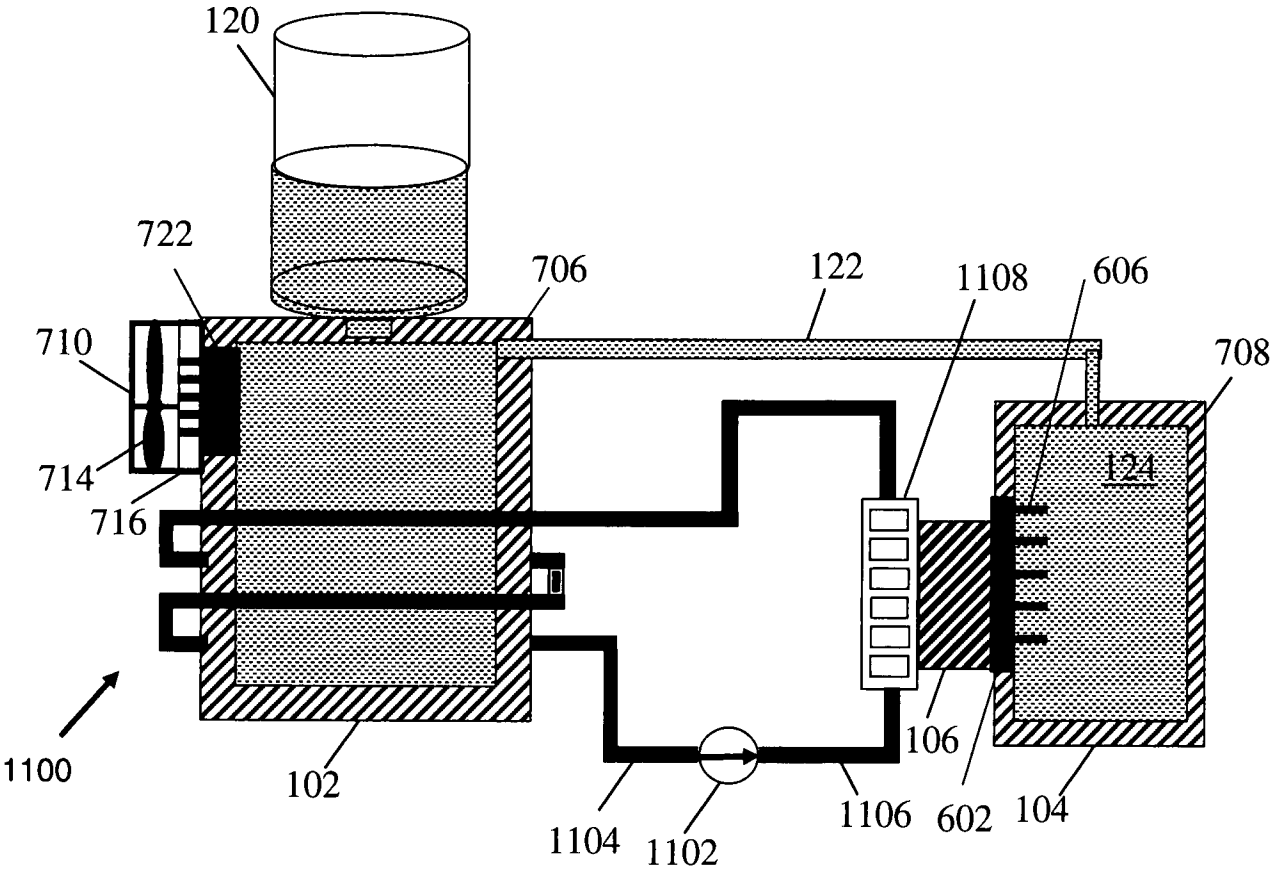

FIG. 11 illustrates a cross-sectional view of a cooling system 1100, in accordance with yet another embodiment of the present invention. Cooling system 1100 includes, in addition to the elements described with reference to FIG. 6, FIG. 7 and FIG. 9, a pump 1102, a working fluid 1104, a fluid loop 1106, and a heat exchanger 1108. Fluid loop 1106 wraps around wall 706 of first chamber 102. In the present embodiment, fluid loop 1106 is made of soft copper. In the present embodiment of the invention, pump 1102 acts as a replacement for first body 108 and facilitates transfer of heat from heat exchanger 1108 to first chamber 102. In the present embodiment, heat exchanger 1108, which includes micro-channels, is connected to the hot side of thermoelectric device 106, and transfers the heat rejected by thermoelectric device 106 to working fluid 1104. This embodiment enables first chamber 102 to be further away from second chamber 104. Typically, working fluid 1104 in the present embodiment is water, which in addition to being commonly available, can be replenished easily while the cooling device is in operation. In accordance with other embodiments of the invention, working fluid 1104 is a combination of ethylene glycol and water, commonly known as antifreeze. Use of antifreeze prevents the working fluid from freezing when thermoelectric device 106 is switched off.

Figure 12:
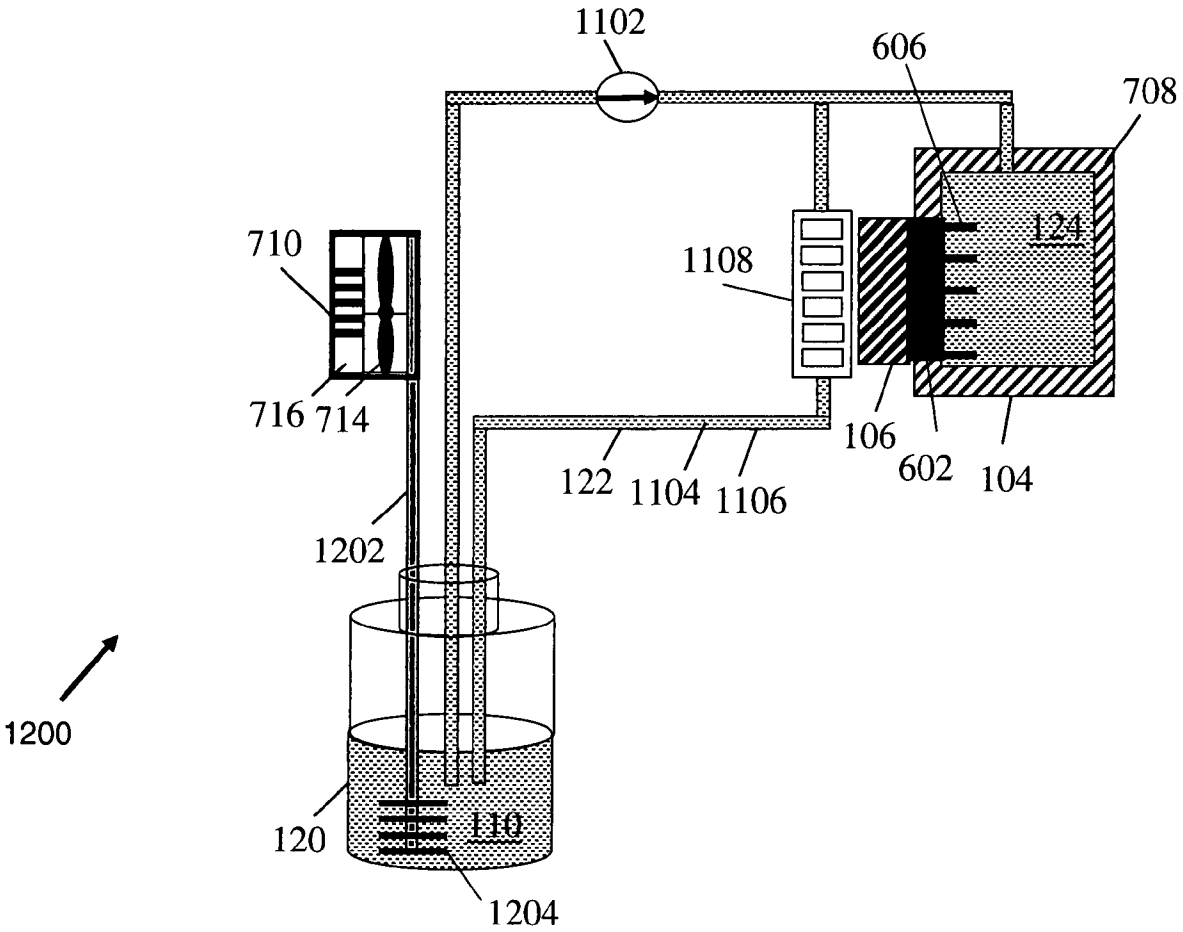

FIG. 12 illustrates a cross-sectional view of a cooling system 1200, in accordance with yet another embodiment of the present invention. Cooling system 1200 includes, in addition to the elements described with reference to FIG. 6, FIG. 7, FIG. 9 and FIG. 11, one or more sintered heat pipes 1202 with fins 1204. Sintered heat pipe(s) 1202 maintain the temperature of first fluid 110 close to room temperature. Pump 1102 circulates working fluid 1104 between fluid container 120 and heat exchanger 1108 through fluid loop 1106 that is flexible. In accordance with this embodiment, fluid loop 1106 distributes first fluid 110 in two parts. One part of first fluid 110 is transferred as working fluid 1104 to heat exchanger 1108, and the other part is transferred to second chamber 104. When second fluid 124 in second chamber 104 reaches the required temperature, pump 1102 shuts off, thereby preventing circulation of working fluid 1104.

Figure 13:
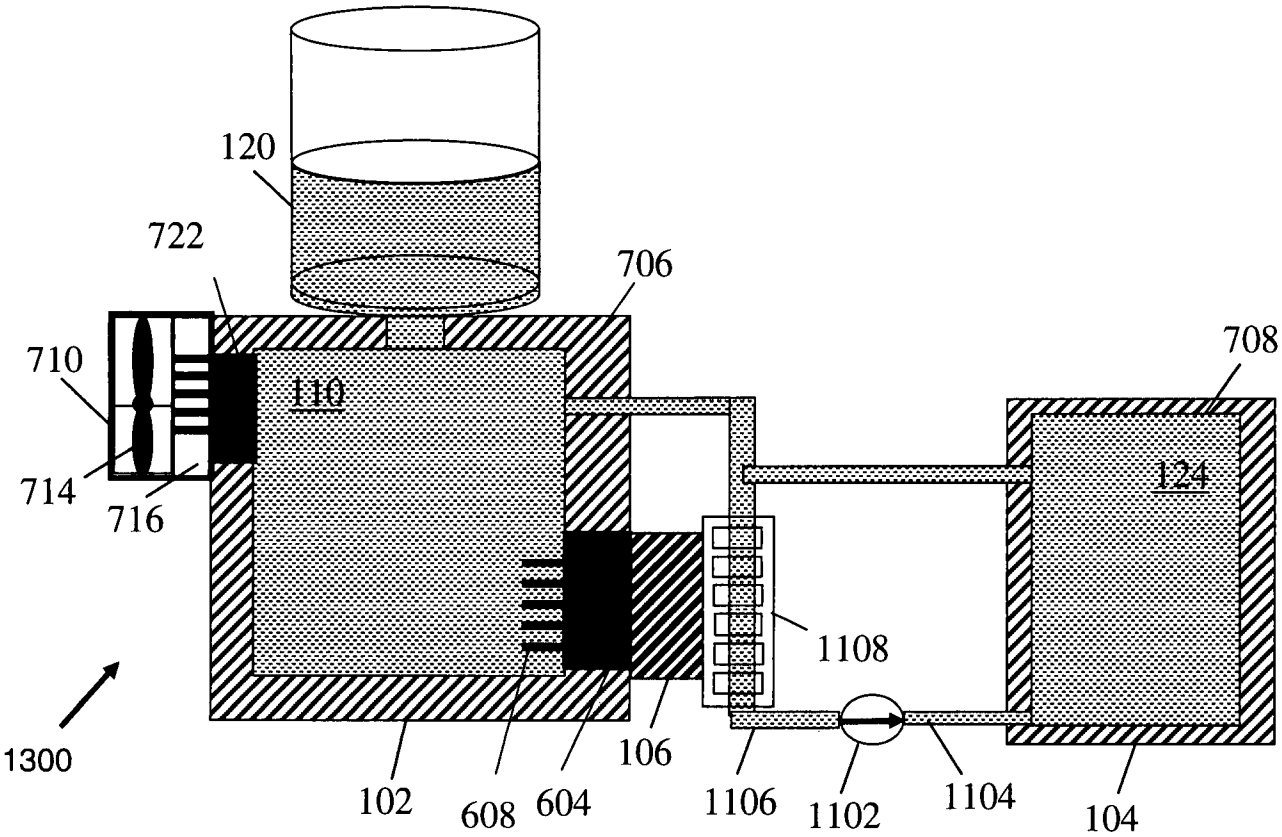

FIG. 13 illustrates a cross-sectional view of a cooling system 1300, in accordance with yet another embodiment of the present invention. Cooling system 1300 includes varied arrangement of the elements described in FIG. 11. According to the present embodiment of the invention, fluid loop 1106 distributes working fluid 1104 between first chamber 102 and second chamber 104. In an embodiment, fluid loop 1106 is made of soft copper. In accordance with the present embodiment, working fluid 1104 is a part of first fluid 110.

Fluid loop 1106 distributes first fluid 110 in two parts: one part is transferred as working fluid 1104 to heat exchanger 1108, and the other part is transferred to second chamber 104. In the present embodiment, heat exchanger 1108 is attached to the cold side of thermoelectric device 106, and thus, fluid loop 1106 is cooled during each pass through heat exchanger 1108. When second fluid 124 in second chamber 104 reaches the desired cooling temperature, pump 1102 shuts off, thereby preventing any further exchange of fluid between first chamber 102 and second chamber 104. In the embodiments described in FIG. 12 and FIG. 13, the presence of pump 1102 and working fluid 1104 allows unidirectional transfer of heat when pump 1102 is switched on and ensures thermal isolation when pump 1102 is switched off. Thus, pump 1102 and working fluid 1104 thus act as a thermal diode.

Figure 14:
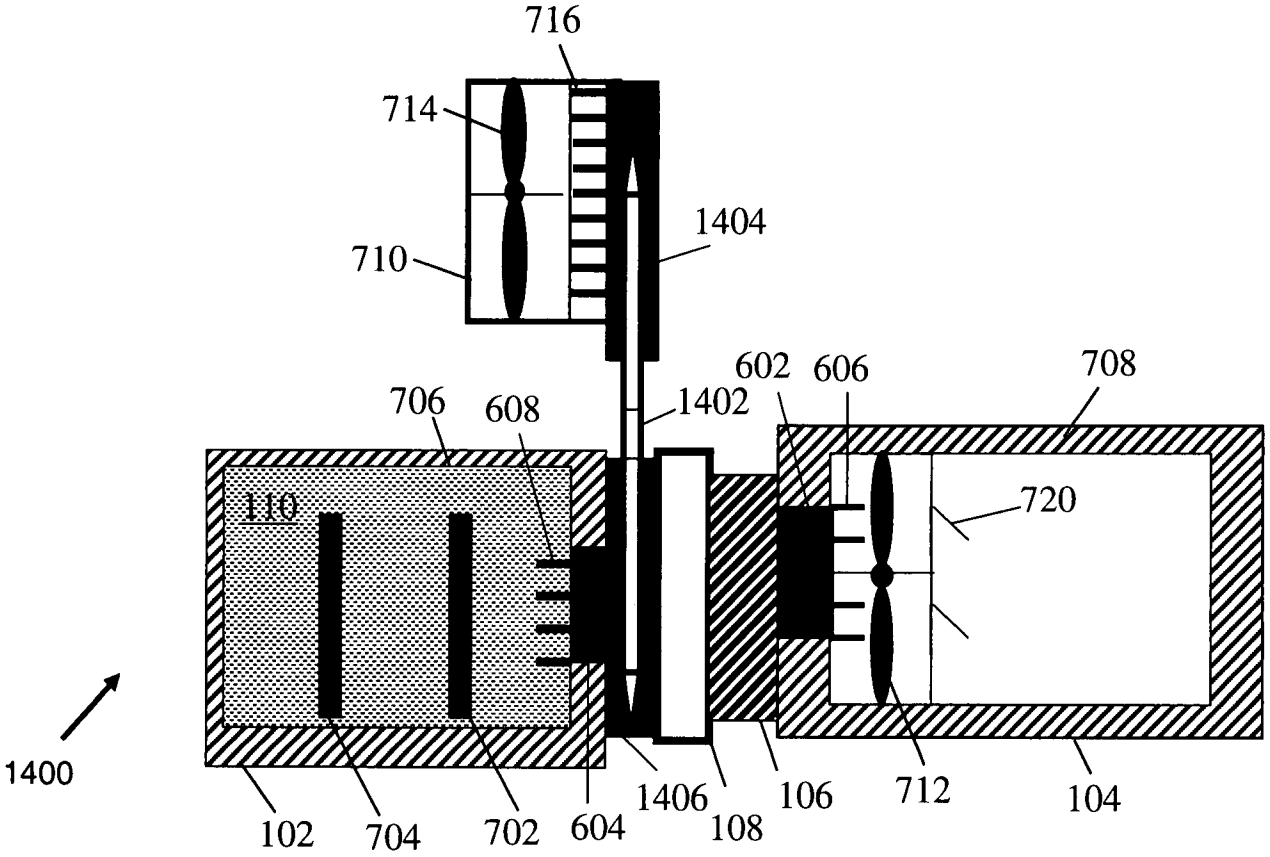

FIG. 14 illustrates a cross-sectional view of a cooling system 1400, in accordance with another embodiment of the present invention. Cooling system 1400 includes, in addition to the elements described with reference to FIG. 6, a heat pipe 1402, a first metal block 1404, and a second metal block 1406.

In the present embodiment, first metal block 1404 is connected to heat rejection device 710, and second metal block 1406 is connected to first body 108. The ends of heat pipe 1402 are embedded in each of first metal block 1404 and second metal block 1406, thereby connecting heat rejection device 710 to first body 108. Heat pipe 1402 enables direct heat transfer from first body 108 to heat rejection device 710.

Figure 15:
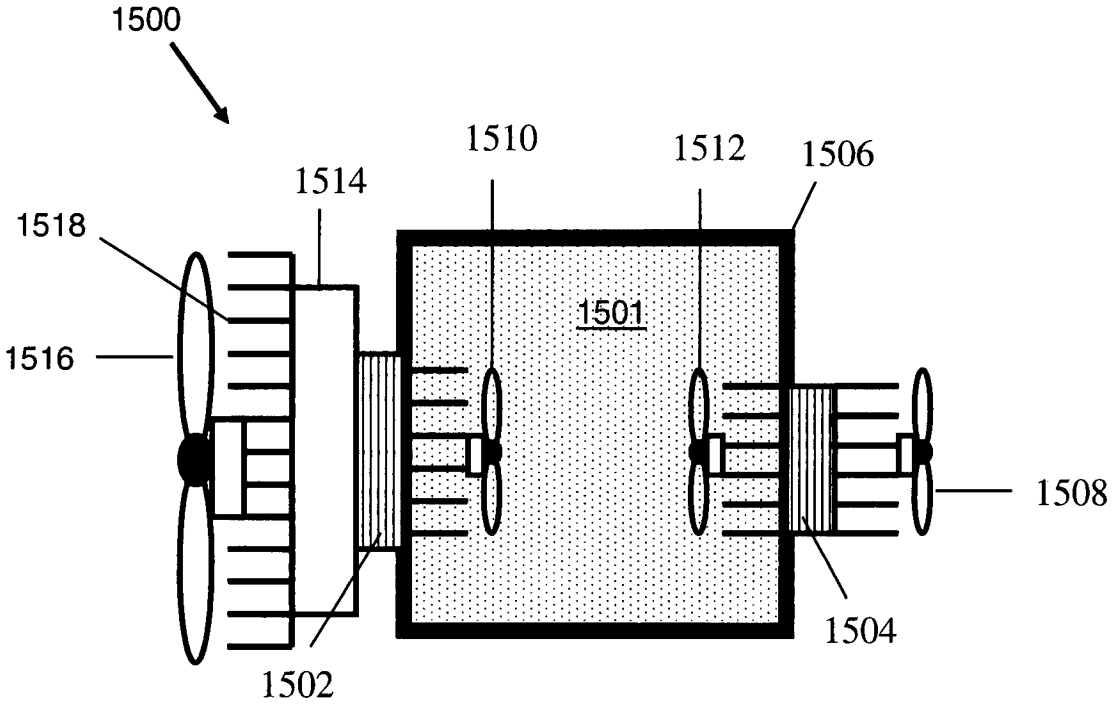

FIG. 15 illustrates a cross-sectional view of a cooling system 1500, in accordance with another embodiment of the present invention.

Cooling system 1500 is a split thermoelectric cooler, which comprises a primary thermoelectric device 1502 and a secondary thermoelectric device 1504. Primary thermoelectric device 1502 and secondary thermoelectric device 1504 are connected to a cooling chamber 1506.

In an embodiment or the present invention, secondary thermoelectric device 1504 is smaller in size and has less cooling capacity as compared with primary thermoelectric device 1502. Primary thermoelectric device 1502 remains switched on for a certain period to create a cooling effect in cooling chamber 1506. Secondary thermoelectric device 1504 is a small thermoelectric cooler and is always turned on. Secondary thermoelectric device 1504 is preferably biased with the minimum current required to produce cooling in cooling chamber 1506 to compensate for leakage of heat from cooling chamber 1506. Cooling chamber 1506 contains fluid 1501 that needs to be cooled. In an embodiment of the present invention, cooling chamber 1506 is a cooling chamber of a refrigerator.

A vapor diode 1514 is connected to the hot end of primary thermoelectric device 1502 to prevent flow of heat to cooling chamber 1506 when primary thermoelectric device 1502 is switched off. Heat exchanger 1518 dissipates the heat extracted by primary thermoelectric device 1502 to the ambient. In an embodiment of the present invention, heat exchanger 1518 has a heat sink fan 1516. When primary thermoelectric device 1502 and heat sink fan 1516 are switched on, the net heat conductance of the combination of vapor diode 1514 and heat exchanger 1518 to the ambient is about 5 W/° C. However, when primary thermoelectric device 1502 and heat sink fan 1516 are switched off, the net heat conductance of the combination is much lower. This is because the conductance of heat exchanger 1518 is only due to free convection, and the conductance of vapor diode 1514 is small when primary thermoelectric device 1502 is switched off. Thus, heat exchanger 1518 adds additional thermal resistance to cooling system 1500. Therefore, the net heat conductance of the combination of vapor diode 1514 and heat sink fan 1516 in the switched off state is less than 0.1 W/° C. Heat exchanger 1518 acts as a diode because its conductance is dependent on the on or off state of heat sink fan 1516, and it enhances thermal diode characteristics. Thus, heat exchanger 1518, in addition to vapor diode 1514, helps in preventing heat leakage back into the cold chamber.

A first cold fan 1510 is present in cooling chamber 1506 to help in transferring heat from fluid 1501 to primary thermoelectric device 1502. Further, first cold fan 1510 helps in maintaining a uniform temperature within cooling chamber 1506. First cold fan 1510 is also switched off when primary thermoelectric device 1502 is switched off. Thermal conductance of first cold fan 1510 is more when it is switched on than when it is switched off. Thus, first cold fan 1510 also adds additional thermal resistance when it is switched off and, therefore, enhances thermal diode characteristics of the combination of vapor diode 1514 and heat exchanger 1518.

A second cold fan 1512 is present in cooling chamber 1506 to help in transferring heat from fluid 1501 to secondary thermoelectric device 1504. Further, second cold fan 1512 helps in maintaining a uniform temperature within cooling chamber 1506. A hot fan 1508 that acts as a heat sink is attached to secondary thermoelectric device 1504 to dissipate the small amount of heat rejected by secondary thermoelectric device 1504 to the ambient. In an embodiment of the present invention, any other type of heat sink is used in place of hot fan 1508.

In an embodiment of the present invention, the cooling power of primary thermoelectric device 1502 is 5 to 10 times more than that of secondary thermoelectric device 1504. Secondary thermoelectric device 1504 is always kept in an on state. A constant current is passed through secondary thermoelectric device 1504 to produce cooling to compensate for the heat leakage through cooling chamber 1506. Hot fan 1508 is also kept in an on state constantly, along with secondary thermoelectric device 1504, to dissipate the heat rejected by secondary thermoelectric device 1504. Primary thermoelectric device 1502 is switched on at the beginning of the cooling process. After a steady state is achieved, primary thermoelectric device 1502 is switched off. Heat sink fan 1516 and first cold fan 1510 also get switched off when primary thermoelectric device 1502 is switched off.

In an embodiment of the present invention, primary thermoelectric device 1502 is switched on when the temperature of cooling chamber 1506 increases above an upper limit of temperature. Furthermore, heat exchanger 1518 and first cold fan 1510 are switched on when primary thermoelectric device 1502 is switched on. For example, when a refrigerator is opened, primary thermoelectric device 1502 is switched on when the temperature of cooling chamber 1506 increases above the upper limit of temperature. When the temperature of cooling chamber 1506 decreases and reaches a lower limit of temperature, primary thermoelectric device 1502 is switched off. When primary thermoelectric device 1502 is switched off, heat sink fan 1516 and first cold fan 1510 are also switched off, and heat leakage is prevented by the combination of heat exchanger 1518 and vapor diode 1514.

Typically, in a refrigerator, the door is opened about twenty to twenty four times a day. Therefore, primary thermoelectric device 1502 is turned on only about 20 times a day on an average, which means about 7,000 to 8,000 times a year or 70,000 to 80,000 times in the lifetime of primary thermoelectric device 1502 (assuming a lifetime of 10 years). Thus, the reliability of the thermoelectric cooling system increases. Power consumption of the thermoelectric cooling system is also less because the primary thermoelectric device 1502 is switched off after the lower limit of temperature is attained, and the only power dissipation is due to secondary thermoelectric device 1504 that is small.

In an embodiment of the present invention, bias current of secondary thermoelectric device 1504 is varied such that it is biased at a higher current when primary thermoelectric device 1502 is switched on. The bias current to secondary thermoelectric device 1504 is then reduced to the minimum current necessary to compensate for the leakage into third cooling chamber 406 when primary thermoelectric device 1502 is switched off.

Figure 16:
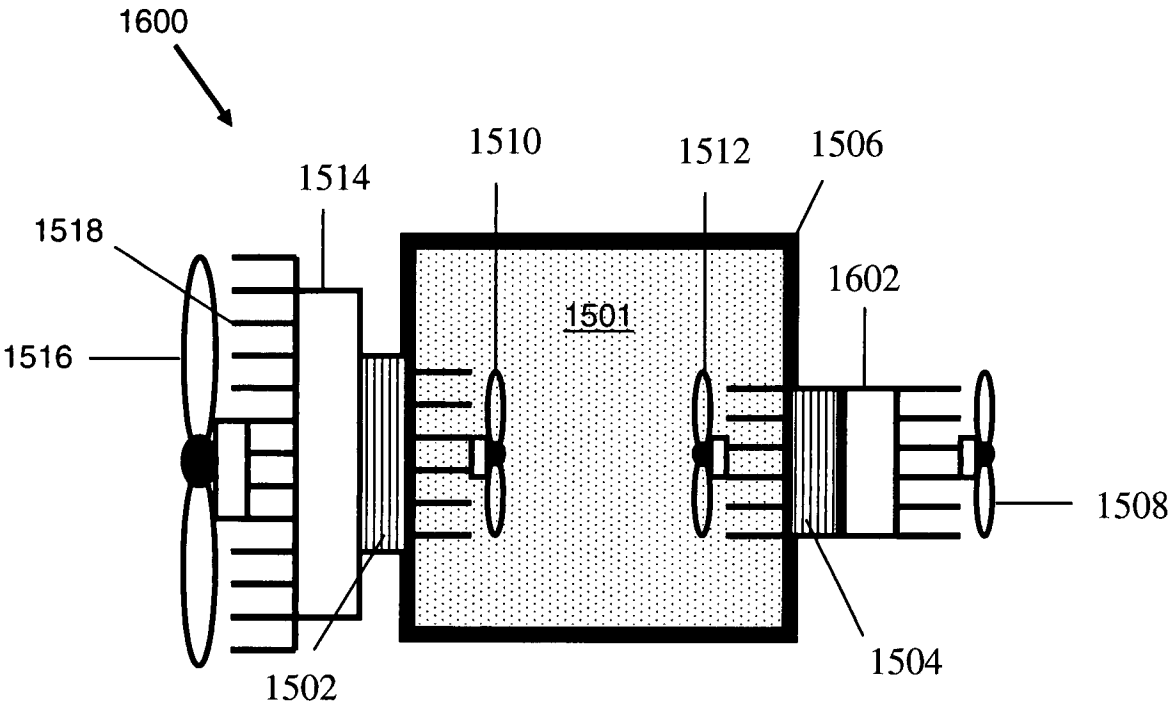

FIG. 16 illustrates a cross-sectional view of a cooling system 1600, in accordance with yet another embodiment of the present invention. Cooling system 1600 contains a secondary vapor diode 1602, in addition to the elements mentioned in conjunction with FIG. 15.

Secondary vapor diode 1602 is connected to the hot side of secondary thermoelectric device 1504. In this embodiment of the present invention, secondary thermoelectric device 1504 operates with a switching cycle. It is switched on after a long period of inactivity only when the leakage through the walls of cooling chamber 1506 increases the temperature of fluid 1501 above an upper limit of temperature. For example, during the night when the refrigerator remains closed for a long time, secondary thermoelectric device 1504 gets switched off. Secondary vapor diode 1602 prevents backflow of heat to secondary thermoelectric device 1504 when secondary thermoelectric device 1504 is switched off. In an embodiment of the present invention, second cold fan 1512 and hot fan 1508 are switched on when secondary vapor diode 1602 is switched on. Similarly, second cold fan 1512 and hot fan 1508 are turned off when secondary vapor diode 1602 is turned off. This switching cycle reduces the power consumption of secondary thermoelectric device 1504 and improves the efficiency of cooling system 1600.

In another embodiment, secondary thermoelectric device 1504 is controlled by a pulse-width modulated current supply, and the current supply depends on the temperature of cooling chamber 1506.

Figure 17A:
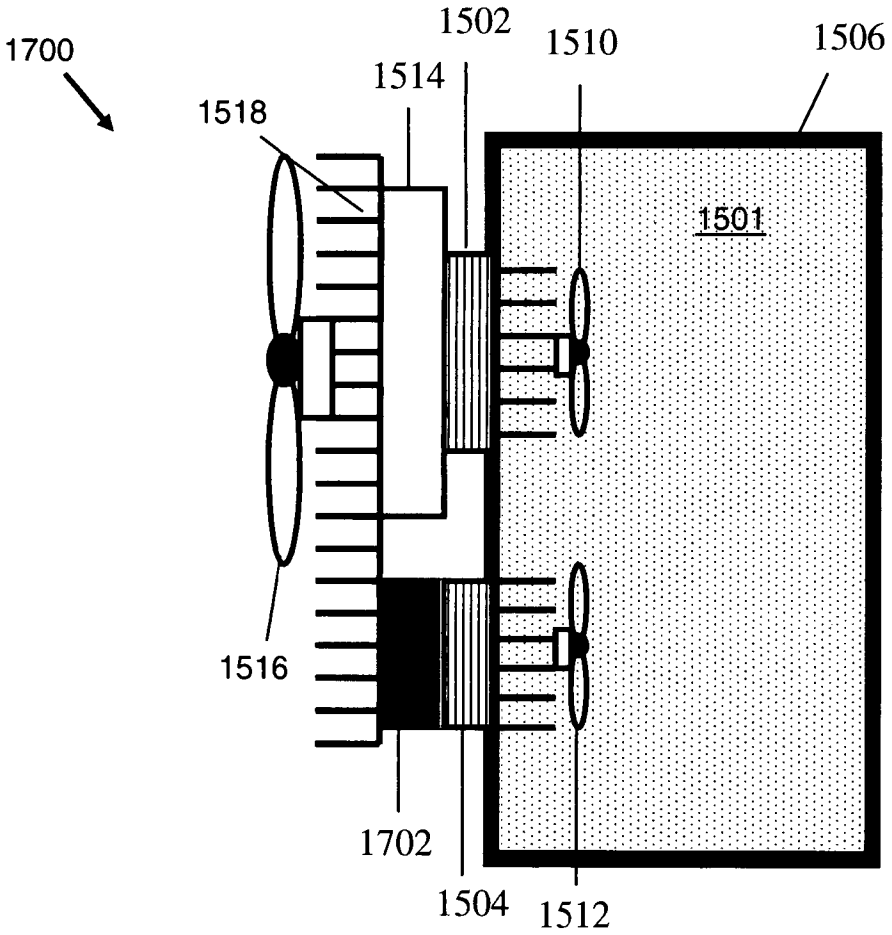
Figure 17B:
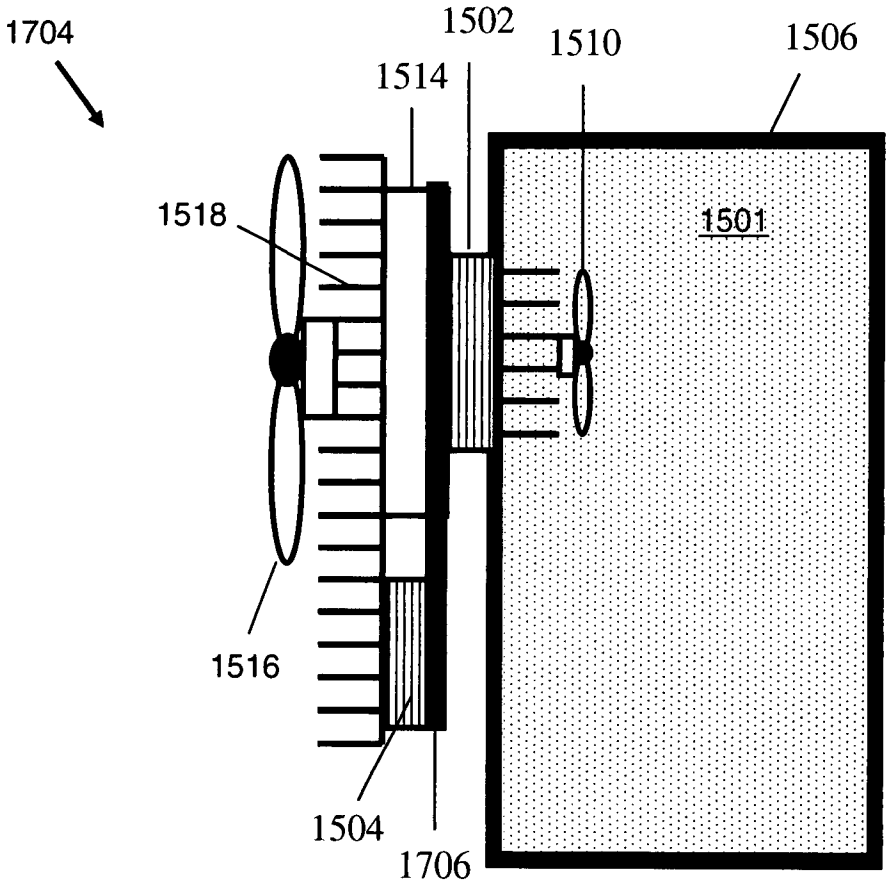

FIG. 17*a* and FIG. 17*b* illustrate cross-sectional views of a first cooling system 1700 and a second cooling system 1704 respectively, in accordance with yet another embodiment of the present invention.

First cooling system 1700 in FIG. 17*a* is another configuration of a split thermoelectric cooler and comprises primary thermoelectric device 1502 and secondary thermoelectric device 1504, which are connected to cooling chamber 1506.

In an embodiment of the present invention, cooling chamber 1506 is a cooling chamber of a refrigerator containing air or a cooling chamber of a water cooler.

In addition to the elements mentioned in conjunction with FIG. 15, first cooling system 1700 contains a copper block 1702, which is attached to secondary thermoelectric device 1504. Copper block 1702 conducts the heat rejected by secondary thermoelectric device 1504 to heat exchanger 1518 that dissipates it to the ambient. Thus, heat exchanger 1518 dissipates the heat rejected by primary thermoelectric device 1502 and secondary thermoelectric device 1504. Heat sink fan 1516 always remains turned on to dissipate the heat rejected by secondary thermoelectric device 1504.

Second cooling system 1704 of FIG. 17*b* is another configuration of a split thermoelectric cooler and comprises primary thermoelectric device 1502 and secondary thermoelectric device 1504 that are connected to cooling chamber 1506.

Second cooling system 1704 is different from first cooling system 1700 in that vapor diode 1514 is parallel to secondary thermoelectric device 1504. Second cooling system 1704 further includes a metal plate 1706 that connects primary thermoelectric device 1502 with secondary thermoelectric device 1504 as well as vapor diode 1514.

Figure 18:
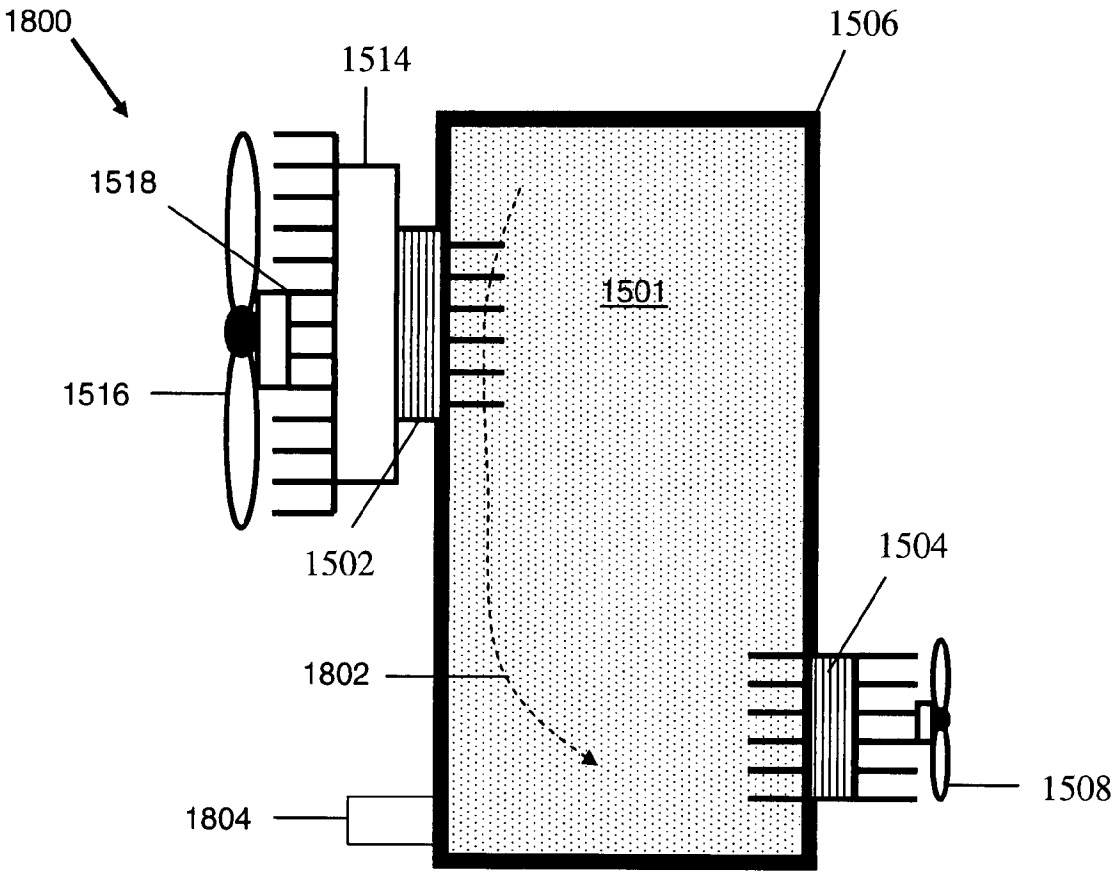

FIG. 18 illustrates a cross-sectional view of a cooling system 1800, in accordance with another embodiment of the present invention.

Cooling system 1800 depicts another configuration of a split thermoelectric cooler comprising primary thermoelectric device 1502 and secondary thermoelectric device 1504, as mentioned in conjunction with FIG. 15.

In this embodiment of the present invention, fluid 1501 is water and cooling system 1800 is a water cooler. Warm water stays above cold water in cooling chamber 1506. Primary thermoelectric device 1502 is placed at the top of cooling chamber 1506. When the warm water present at the top of cooling chamber 1506 is cooled by primary thermoelectric device 1502, the density of the water increases and the cold water slides down as indicated by an arrow 1802.

Secondary thermoelectric device 1504 is present at the bottom of cooling system 1800 and maintains the temperature of the cold water present at the bottom of cooling chamber 1506. A cold water outlet 1804 is present at the bottom of cooling chamber 1506.

Figure 19:
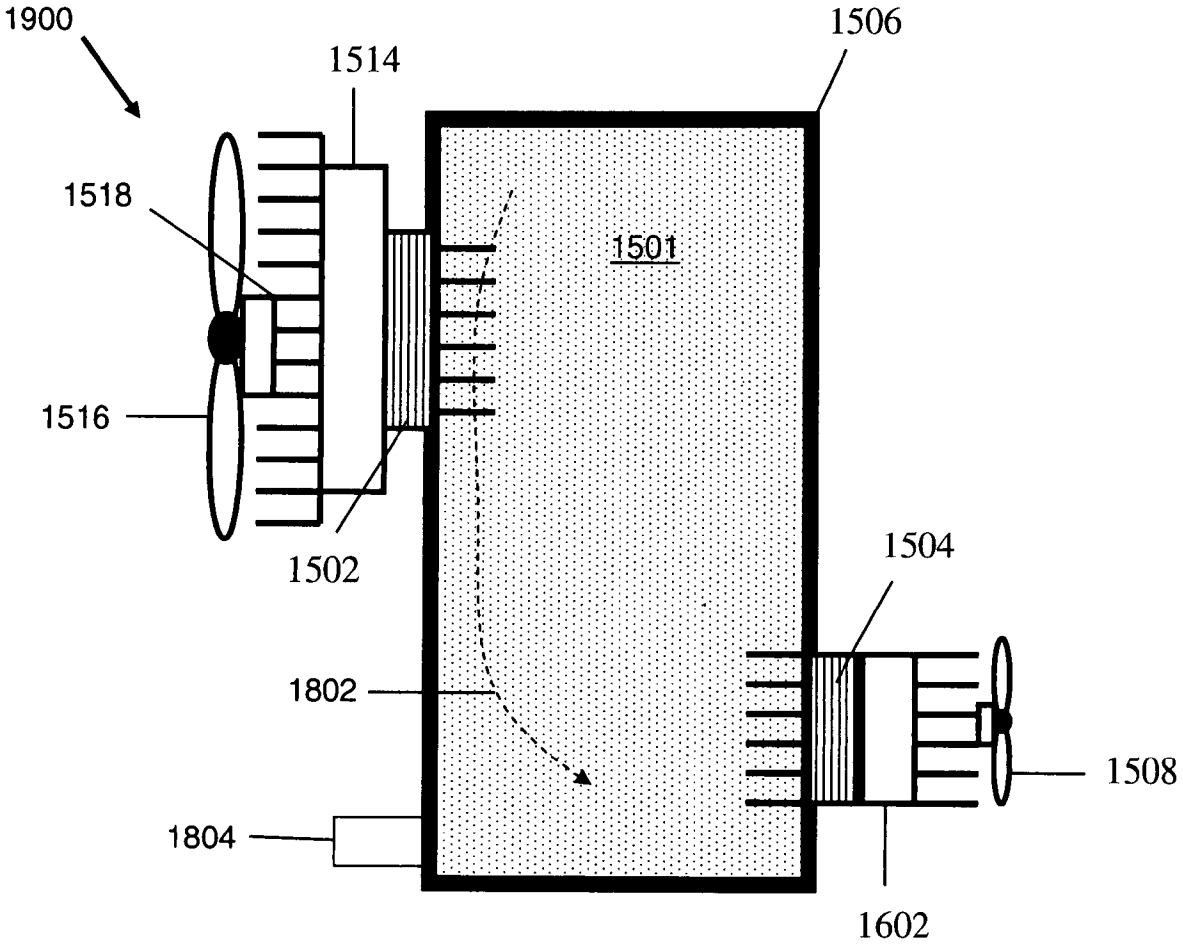

FIG. 19 illustrates a cross-sectional view of a cooling system 1900, in accordance with another embodiment of the present invention.

Cooling system 1900 contains secondary vapor diode 1602, in addition to the elements mentioned in conjunction with FIG. 18. Cooling system 1900 depicts another configuration of split thermoelectric cooler comprising primary thermoelectric device 1502 and secondary thermoelectric device 1504.

Secondary vapor diode 1602 is connected to the hot side of secondary thermoelectric device 1504. In this embodiment of the present invention, secondary thermoelectric device 1504 operates with a switching cycle. It is switched on after a long period of inactivity only when the leakage through the walls of cooling chamber 1506 increases the temperature of fluid 1501 above an upper limit of temperature. For example, during the night when a water cooler remains closed for a long time, secondary thermoelectric device 1504 gets switched off. Secondary vapor diode 1602 prevents backflow of heat to secondary thermoelectric device 1504 when secondary thermoelectric device 1504 is switched off. In an embodiment of the present invention, secondary thermoelectric device 1504 is controlled by a pulse-width modulated current supply, and the current supply depends on the temperature of cooling chamber 1506. Switching secondary thermoelectric device 1504 off further improves the efficiency of cooling system 1900 as compared with that of first cooling system 1700.

Figure 20:
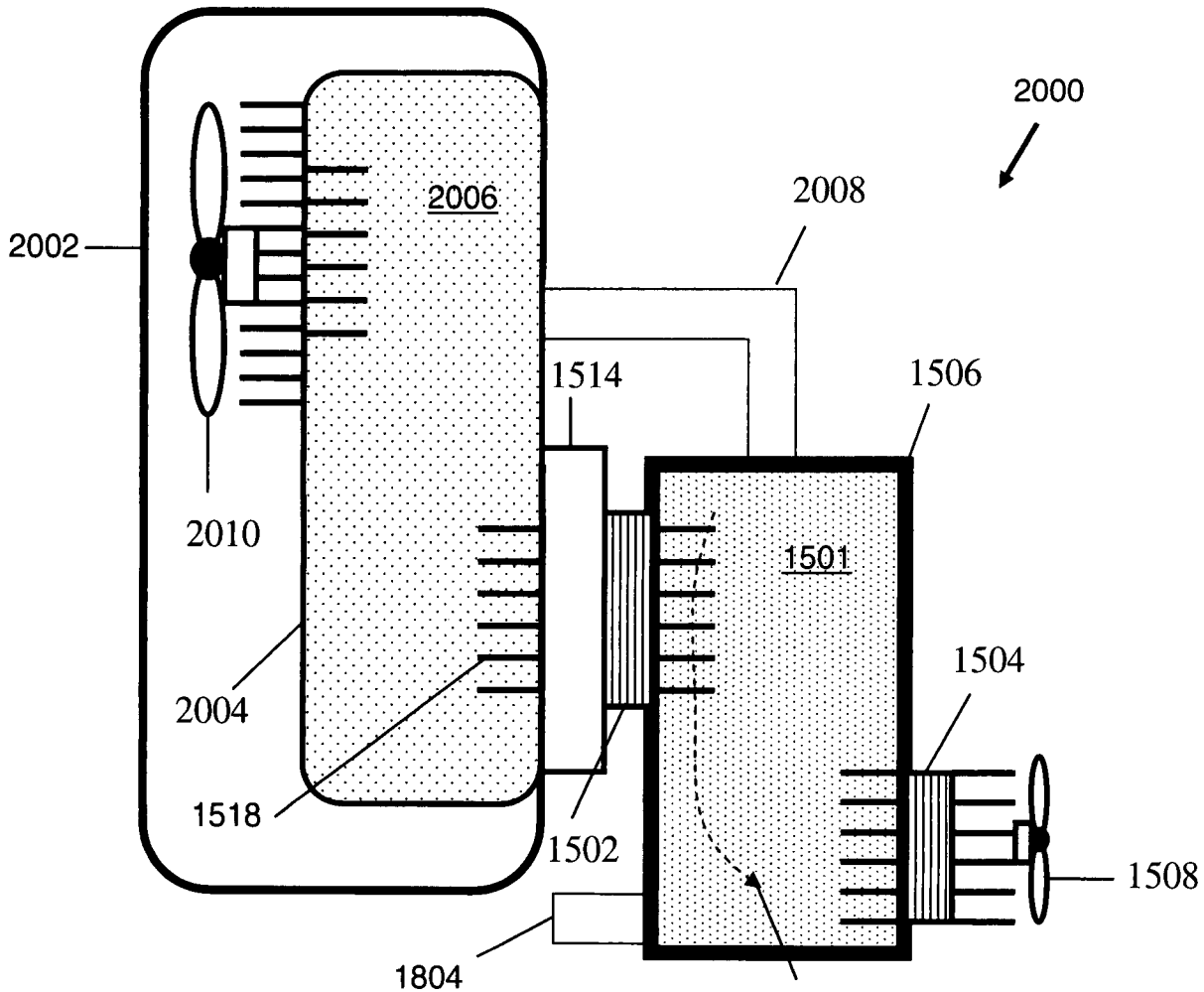

FIG. 20 illustrates a cross-sectional view of a cooling system 2000, in accordance with yet another embodiment of the present invention.

Cooling system 2000 depicts another configuration of a split thermoelectric cooler comprising primary thermoelectric device 1502 and secondary thermoelectric device 1504.

In addition to the elements mentioned in conjunction with FIG. 18, cooling system 2000 contains a capacitor 2002, which includes heat exchanger 1518. Capacitor 2002 has an input chamber 2004, which contains a first fluid 2006 and a fan 2010. Capacitor 2002 is mechanically connected to a surface of vapor diode 1514 in such a manner that the heat dissipated by vapor diode 1514 is transferred to first fluid 2006. In an embodiment of the present invention, first fluid 2006 is water. Since water has a high-specific heat capacity, it helps to maintain a constant temperature in input chamber 2004. Further, the volume of first fluid 2006 is greater than that of fluid 1501. Thus, first fluid 2006 has a higher heat capacity than fluid 1501. Consequently, the temperature of first fluid 2006 is relatively constant even when primary thermoelectric device 1502 is turned on. In accordance with an embodiment, the typical temperature of first fluid 2006 is 30 degrees centigrade and the temperature of fluid 1501 is 5 degrees centigrade.

In an embodiment, input chamber 2004 and cooling chamber 1506 are connected through a fluid pipe 2008 to enable transfer of fluid from input chamber 2004 to cooling chamber 1506. In accordance with an embodiment, input chamber 2004 and cooling chamber 1506 are kept at a distance, and are connected through a flexible fluid loop and a pump. The flexible fluid loop may be bent into different shapes to connect input chamber 2004 to cooling chamber 1506. The pump helps in the transfer of fluid from input chamber 2004 to cooling chamber 1506 through the flexible fluid loop. In an embodiment of the present invention, input chamber 2004 is placed at a higher position than cooling chamber 1506, and first fluid 2006 is transferred to cooling chamber 1506 due to gravity. For the purpose of this description, only two chambers have been shown for cooling system 2000. However, it will be apparent to a person skilled in the art that cooling system 2000 may include more than two chambers, and the cooling scheme can be cascaded to cool the fluids to very low temperatures.

Figure 21:
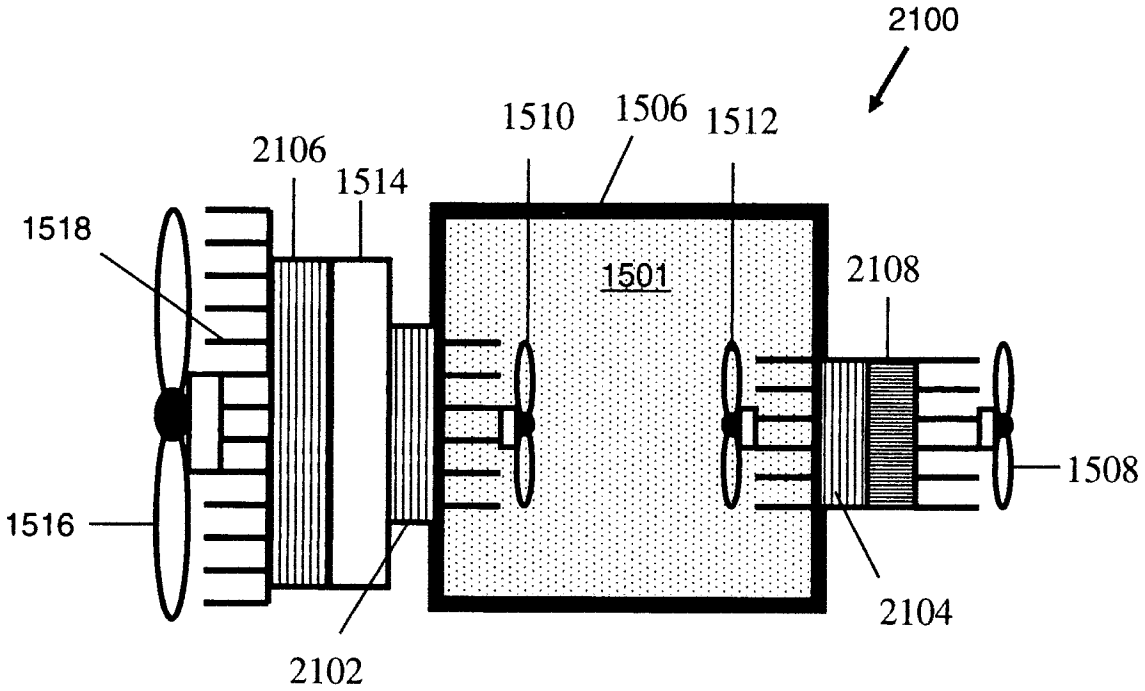

FIG. 21 illustrates a cross-sectional view of a cooling system 2100, in accordance with yet another embodiment of the present invention.

Cooling system 2100 is a two-stage split thermoelectric cooler and comprises a stage one primary thermoelectric device 2102, a stage one secondary thermoelectric device 2104, a stage two primary thermoelectric device 2106, a stage two secondary thermoelectric device 2108, vapor diode 1514, and heat exchanger 1518. Stage one primary thermoelectric device 2102 and stage one secondary thermoelectric device 2104 are connected to cooling chamber 1506.

Cooling chamber 1506 contains fluid 1501 that needs to be cooled. In an embodiment of the present invention, cooling chamber 1506 is a cooling chamber of a refrigerator or an ice box, which requires cooling to low (sub-zero degrees centigrade) temperatures.

Stage one secondary thermoelectric device 2104 and stage two secondary thermoelectric device 2108 are smaller as compared with stage one primary thermoelectric device 2102 and stage two primary thermoelectric device 2106. Secondary thermoelectric devices 2104 and 2108 are used because the heat leakage into cooling chamber 1506 is very high when cooling chamber 1506 is maintained at low temperatures. Stage one primary thermoelectric device 2102 is connected to cooling chamber 1506 and vapor diode 1514. Stage two primary thermoelectric device 2106 is connected to vapor diode 1514 and heat exchanger 1518. Stage one primary thermoelectric device 2102 and stage two primary thermoelectric device 2106 remain turned on for a certain period to create a cooling effect in cooling chamber 1506.

Stage one secondary thermoelectric device 2104 and stage two secondary thermoelectric device 2108 always remain turned on with a small current that is continually supplied to them.

Vapor diode 1514 is connected to the hot end of stage one primary thermoelectric device 2102 to prevent backflow of heat to cooling chamber 1506. Heat exchanger 1518 dissipates the heat extracted by stage one primary thermoelectric device 2102 and stage two primary thermoelectric device 2106 to the ambient. In an embodiment of the present invention, heat exchanger 1518 contains heat sink fan 1516. When stage one primary thermoelectric device 2102, stage two primary thermoelectric device 2106, and heat sink fan 1516 are switched on, the forward conductance of vapor diode 1514 and the conductance of heat exchanger 1518 to the ambient are very high. However, when stage one primary thermoelectric device 2102, stage two primary thermoelectric device 2106, and heat sink fan 1516 are switched off, the thermal conductance of vapor diode 1514 and that of heat exchanger 1518 are low. This is because the conductance of heat exchanger 1518 is only due to free convection, and the conductance of vapor diode 1514 is low in the reverse direction.

First cold fan 1510 is present in cooling chamber 1506 to help in transferring heat from fluid 1501 to stage one primary thermoelectric device 2102. Further, first cold fan 1510 helps in maintaining a uniform temperature in cooling chamber 1506. First cold fan 1510 is switched on when primary thermoelectric devices 2102 and 2106 are switched on, and first cold fan 1510 is switched off when primary thermoelectric devices 2102 and 2106 are switched off.

Second cold fan 1512 is present in cooling chamber 1506 to help in transferring heat from fluid 1501 to stage one secondary thermoelectric device 2104. Further, second cold fan 1512 helps in maintaining a uniform temperature in cooling chamber 1506. Hot fan 1508 is attached to stage two secondary thermoelectric device 2108 to dissipate the heat rejected by stage two secondary thermoelectric device 2108 to the ambient.

In an embodiment of the present invention, the cooling power of primary thermoelectric devices 2102 and 2106 is 5 to 10 times more than that of secondary thermoelectric devices 2104 and 2108. Secondary thermoelectric devices 2104 and 2108 always remain in a switched on state. A constant current is passed through secondary thermoelectric devices 2104 and 2108 to keep them switched on and to compensate for the heat leakage into cooling chamber 1506. Hot fan 1508 also remains switched on constantly, along with the secondary thermoelectric devices 2104 and 2108, to dissipate the heat rejected. Primary thermoelectric devices 2102 and 2106 are switched on at the beginning of the cooling process. After a steady state is achieved, primary thermoelectric devices 2102 and 2106 are switched off. Primary thermoelectric devices 2102 and 2106 are switched on when the temperature of cooling chamber 1506 increases above an upper limit of temperature. For example, when a refrigerator is opened, primary thermoelectric devices 2102 and 2106 are switched on after the temperature of cooling chamber 1506 increases above the upper limit of temperature. When the temperature of cooling chamber 1506 decreases to a lower limit of temperature, primary thermoelectric devices 2102 and 2106 are switched off. When primary thermoelectric devices 2102 and 2106 are switched off, vapor diode 1514 prevents heat leakage into cooling chamber 1506.

Stage two primary thermoelectric device 2106 dissipates its joule heat and the heat rejected by vapor diode 1514 to heat exchanger 1518. Stage two primary thermoelectric device 2106 can operate at a switching frequency that is different from the frequency of stage one primary thermoelectric device 2102.

Typically, cooling system 2100 has two stages, but it can have a greater number of stages cascaded to achieve low temperatures. Two stage thermoelectric coolers provide more cooling and are more efficient than one stage thermoelectric coolers for a given temperature differential. In an exemplary embodiment, cooling chamber 1506 is maintained at a temperature of −5 degrees centigrade. Stage one primary thermoelectric device 2102 operates between −5 degrees centigrade and 20 degrees centigrade, and stage two primary thermoelectric device 2106 operates between 20 degree centigrade and ambient temperature (close to 40 degrees centigrade). Since vapor diode 1514 does not need to dissipate the joule heat rejected by stage two primary thermoelectric device 2106, smaller vapor diodes can be used. Two stage thermoelectric cooling devices efficiently operate in wide temperature ranges.

Figure 22:
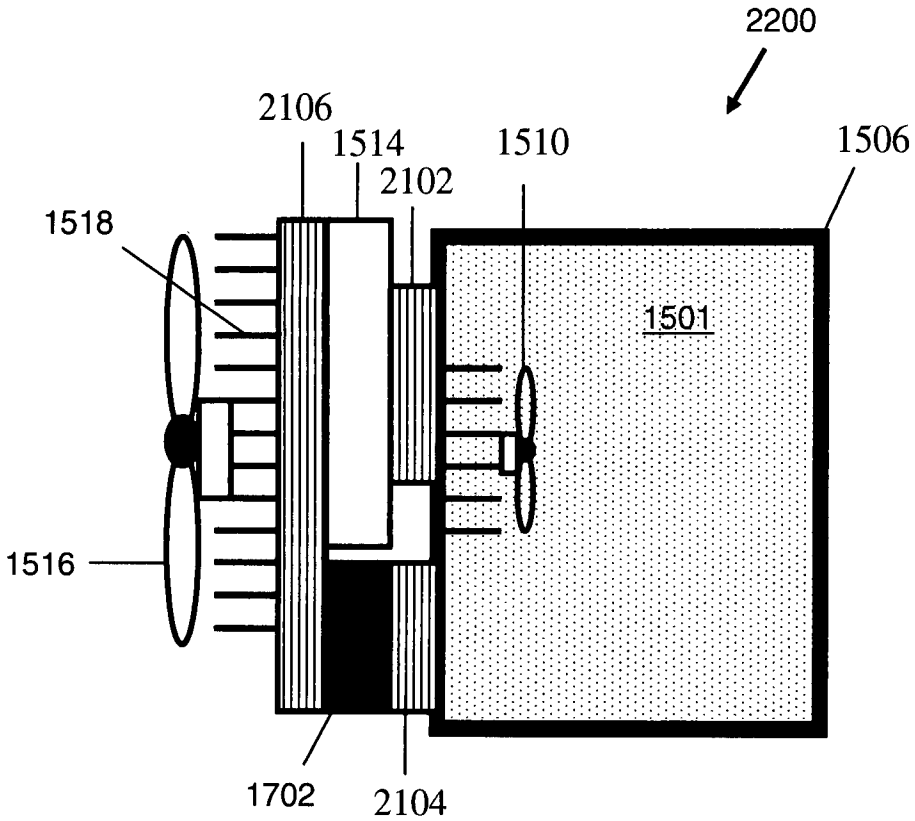

FIG. 22 illustrates a cross-sectional view of a cooling system 2200, in accordance with another embodiment of the present invention.

Cooling system 2200 is another configuration of a two stage split thermoelectric cooler and comprises stage one primary thermoelectric device 2102, stage one secondary thermoelectric device 2104, stage two primary thermoelectric device 2106, vapor diode 1514, and heat exchanger 1518. In cooling system 2200, stage two secondary thermoelectric device 2108 of FIG. 21 is not used.

Stage one thermoelectric devices 2102 and 2104 are connected to cooling chamber 1506. Stage one primary thermoelectric device 2102 is connected to vapor diode 1514. Stage two primary thermoelectric device 2106 is connected to vapor diode 1514 and heat exchanger 1518. Copper block 1702 is attached to stage one secondary thermoelectric device 2104 to conduct the heat rejected by stage one secondary thermoelectric device 2104 to stage two primary thermoelectric device 2106. Heat sink fan 1516 always remains turned on to dissipate the heat rejected by stage one secondary thermoelectric device 2104.

Stage one primary thermoelectric device 2102 is switched on when large temperature differentials are needed to maintain the temperature of fluid 1501 within an operating temperature range. Stage two primary thermoelectric device 2106 is constantly switched on to dissipate the heat from stage one primary thermoelectric device 2102 and stage one secondary thermoelectric device 2104. Furthermore, heat exchanger 1518 remains switched on to dissipate the heat extracted to the ambient.

In accordance with various embodiments of the present invention, it is possible to have different arrangements of thermoelectric devices, vapor diodes, and thermal capacitors in thermoelectric cooling systems. FIG. 23*a*, FIG. 23*b*, FIG. 24*a*, FIG. 24*b*, FIG. 25*a*, FIG. 25*b*, FIG. 25*c*, and FIG. 25*d* exemplify such arrangements.

Figure 23A:
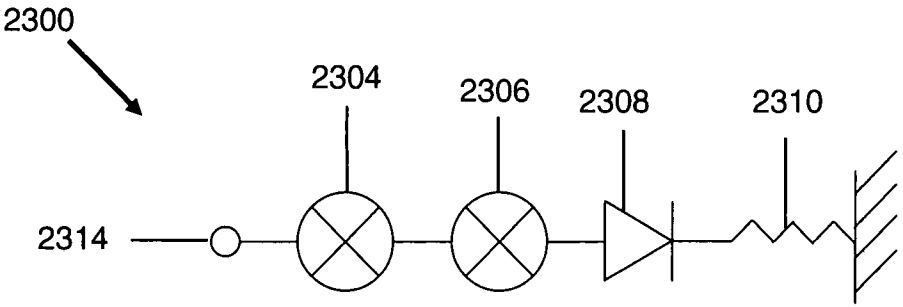
FIGS. 23*a*-25*d* are schematic diagrams of two-stage cooling systems, in accordance with various embodiments of the present invention.
Figure 23B:
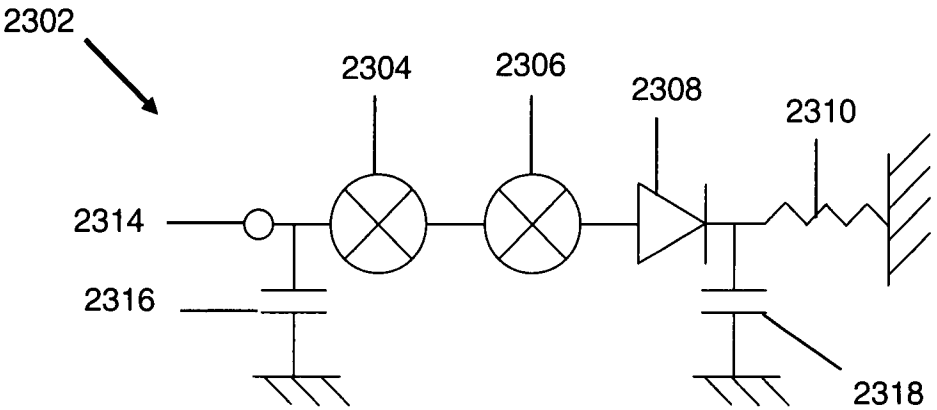

FIG. 23*a* and FIG. 23*b* are schematic figures depicting the thermoelectric devices and other elements by means of symbols. FIG. 23*a* symbolizes arrangements of a first two-stage cooling brick 2300 and FIG. 23*b* symbolizes arrangements of a second two-stage cooling brick 2302. Each of first two-stage cooling brick 2300 and second two-stage cooling brick 2302 includes two thermoelectric devices, a first thermoelectric device 2304 and a second thermoelectric device 2306, followed by a vapor diode 2308 and a heat sink 2310.

First thermoelectric device 2304 and second thermoelectric device 2306 extract heat through a cold end 2314 of first two-stage cooling brick 2300 and pass it to heat sink 2310 through vapor diode 2308. Heat sink 2310 rejects the heat to the ambient.

Second two-stage cooling brick 2302 in FIG. 23*b* includes the same arrangement of thermoelectric devices, vapor diode, and heat sink as that of first two-stage cooling brick 2300. In addition, second two-stage cooling brick 2302 includes a first thermal capacitor 2316 and a second thermal capacitor 2318. First thermal capacitor 2316 and second thermal capacitor 2318 are placed in parallel with the heat rejection path of second two-stage cooling brick 2302 to clamp the temperatures at different points in the system and to prevent any additional temperature loss corresponding to the addition of thermal capacitors 2316 and 2318. High heat capacity materials such as the phase change materials usually have a low thermal conductivity and can increase the thermal resistance of the path. First thermal capacitor 2316 clamps the temperature of cold end 2314 and second thermal capacitor 2318 clamps the temperature of the end of vapor diode 2308. Since first thermal capacitor 2316 and second thermal capacitor 2318 have very lower thermal conductance as compared with heat sink 2310, placing first thermal capacitor 2316 and second thermal capacitor 2318 in series will result in huge temperature loss along the heat rejection path. Therefore, a parallel arrangement is preferred which clamps the temperature and ensures minimum temperature loss along the heat rejection path. Since PCMs have a low thermal conductivity, it is important to spread the heat inside first thermal capacitor 2316 and second thermal capacitor 2318, to increase the net thermal conductance.

First thermal capacitor 2316 and second thermal capacitor 2318 are so designed that heat flow is distributed throughout the volume of the PCMs without incurring a significant temperature drop between the respective capacitor and the ambient. In an embodiment of the present invention, first thermal capacitor 2316 and second thermal capacitor 2318 have conductor structures with a high Biot number. The use of first thermal capacitor 2316 and second thermal capacitor 2318 reduces the total temperature differential across second two-stage cooling brick 2302 during transient stages, and thereby results in a high COP.

Figure 24A:
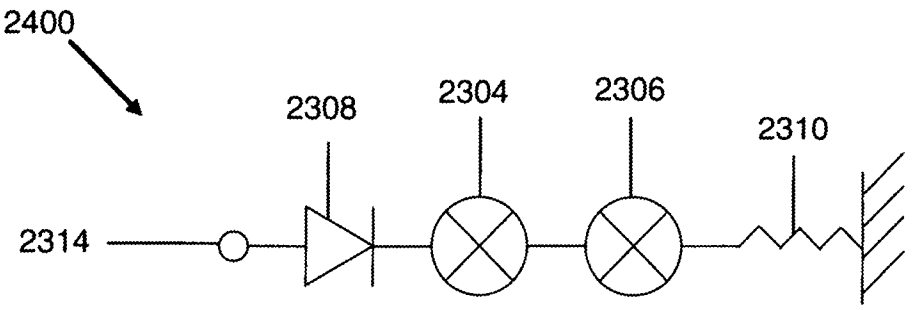
Figure 24B:
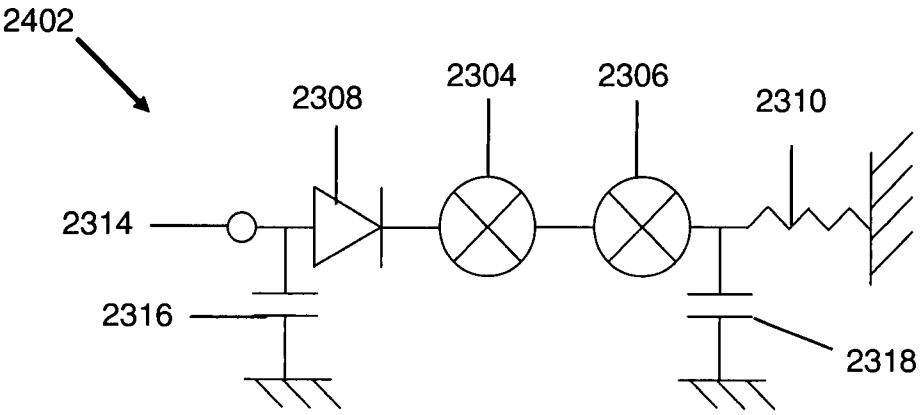

FIG. 24*a* and FIG. 24*b* symbolize the arrangements of a third two-stage cooling brick 2400 and a fourth two-stage cooling brick 2402 respectively. While most of the components are similar to those in FIG. 23*a* and FIG. 23*b*, their relative positions are different in this arrangement. In particular, vapor diode 2308 is attached to the cold side of first thermoelectric device 2304.

In accordance with this embodiment of the present invention, third two-stage cooling brick 2400 of FIG. 24*a* contains vapor diode 2308 followed by two thermoelectric devices i.e., first thermoelectric device 2304 and second thermoelectric device 2306. Vapor diode 2308 contains fluids that are more efficient at low temperatures, for example, isopropyl alcohol. Since vapor diode 2308 is present at the cold side in third two-stage cooling brick 2400, vapor diode 2308 passes less heat flux than that passed by vapor diode 2308 placed at the hot side of first two-stage cooling brick 2300. Heat sink 2310 rejects the heat extracted from cold end 2314 and the joule heat of first thermoelectric device 2304 and second thermoelectric device 2306 to the ambient.

Fourth two-stage cooling brick 2402 of FIG. 24*b* includes the same arrangement of thermoelectric devices, vapor diode, and heat sink as that of third two-stage cooling brick 2400. In addition to the elements in third two-stage cooling brick 2400, fourth two-stage cooling brick 2402 includes first thermal capacitor 2316 and second thermal capacitor 2318. As described in conjunction with FIG. 23*b*, first thermal capacitor 2316 and second thermal capacitor 2318 are placed in parallel with the heat rejection path of fourth two-stage cooling brick 2402 such that there is no temperature loss corresponding to the addition of thermal capacitors 2316 and 2318.

In an embodiment of the invention, first thermal capacitor 2316 clamps the temperature of cold end 2314 and second thermal capacitor 2318 clamps the temperature of heat sink 2310.

FIG. 25*a*, FIG. 25*b*, FIG. 25*c* and FIG. 25*d* are schematic figures depicting a fifth two-stage cooling brick 2500, a sixth two-stage cooling brick 2502, a seventh two-stage cooling brick 2504, and an eighth two-stage cooling brick 2506 respectively. These are yet another variation of the relative arrangements of the thermoelectric devices, the vapor diode, and the heat sink.

Figure 25A:
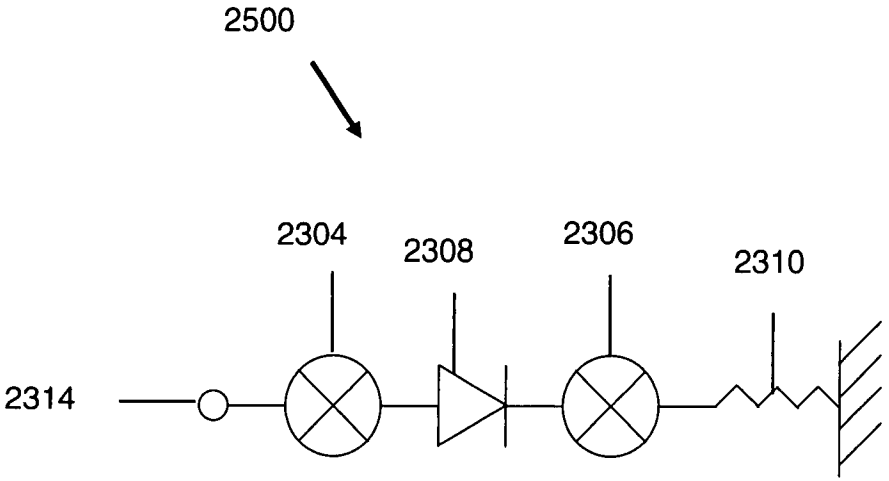

Fifth two-stage cooling brick 2500 shown in FIG. 25*a* contains vapor diode 2308 provided between first thermoelectric device 2304 and second thermoelectric device 2306, in accordance with this embodiment of the present invention. In this embodiment, vapor diode 2308 isolates both first thermoelectric device 2304 and cold end 2314 in the off state of fifth two-stage cooling brick 2500. Vapor diode 2308 handles the heat extracted from cold end 2314 and the joule heating of first thermoelectric device 2304. Therefore, heat flux through vapor diode 2308 of fifth two-stage cooling brick 2500 is less than the heat flux through vapor diode 2308 of first two-stage cooling brick 2300. The arrangement of FIG. 25*a* can create an optimum temperature difference across the vapor diode, thereby improving its performance.

Figure 25B:
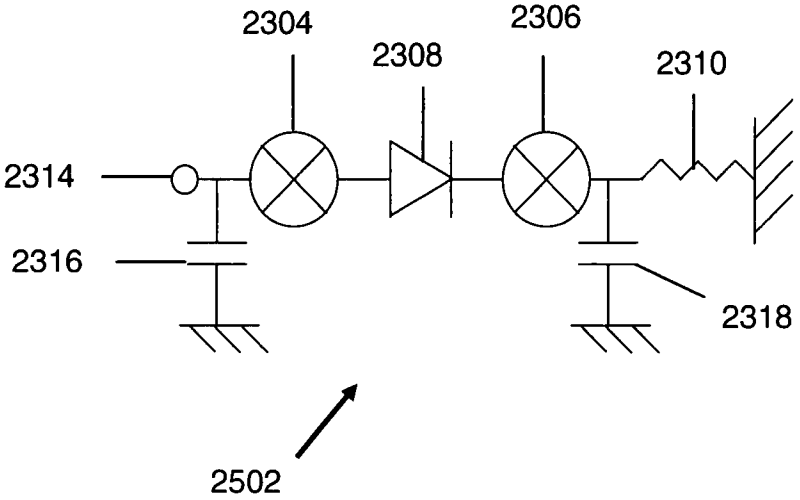

Sixth two-stage cooling brick 2502 shown in FIG. 25*b* includes the same arrangement of thermoelectric devices, vapor diode, and heat sink as that of fifth two-stage cooling brick 2500. In addition to the elements in fifth two-stage cooling brick 2500, sixth two-stage cooling brick 2502 includes first thermal capacitor 2316 and second thermal capacitor 2318, which are placed in parallel to the heat rejection path. As explained in conjunction with FIG. 23*b* and in FIG. 24*b*, this arrangement not only clamps the temperature at different points of the heat flow but also increases the efficiency of the cooling brick. In an embodiment of the invention, first thermal capacitor 2316 clamps the temperature of cold end 2314 and second thermal capacitor 2318 clamps the temperature of heat sink 2310.

Figure 25C:
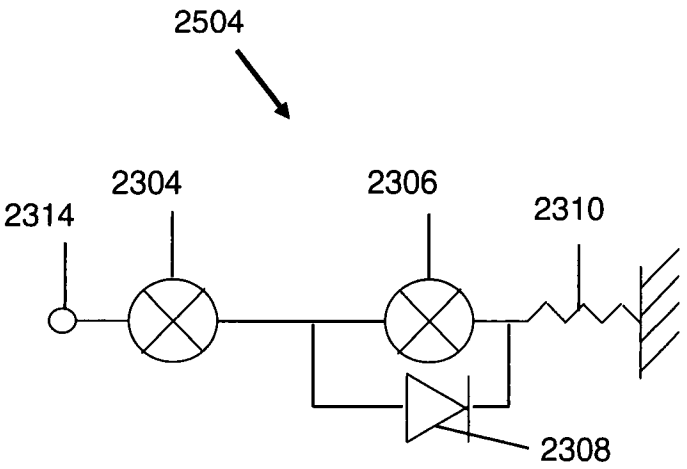

Seventh two-stage cooling brick 2504 shown in FIG. 25*c* includes the same elements as fifth two-stage cooling brick 2500 but with a different arrangement. In this embodiment of the present invention, vapor diode 2308 is parallel to second thermoelectric device 2306.

Figure 25D:
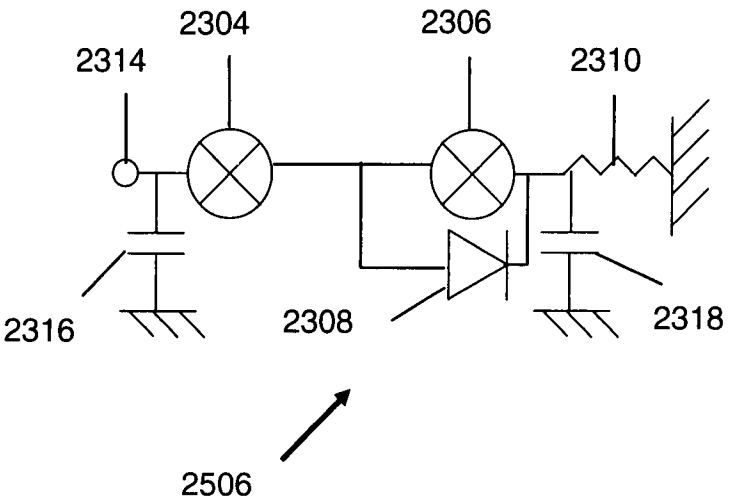

Eighth two-stage cooling brick 2506 shown in FIG. 25*d* includes the same arrangement of thermoelectric devices, vapor diode and heat sink as that of seventh two-stage cooling brick 2504. In addition to elements in seventh two-stage cooling brick 2504, eighth two-stage cooling brick 2506 includes first thermal capacitor 2316 and second thermal capacitor 2318, which are placed in parallel to the heat rejection path. As explained in conjunction with FIG. 23*b* and in FIG. 24*b* this arrangement not only clamps the temperature at different points of the heat flow but also increases the efficiency of the cooling brick. In an embodiment of the invention, first thermal capacitor 2316 clamps the temperature of cold end 2314 and second thermal capacitor 2318 clamps the temperature of heat sink 2310.

Figure 26:
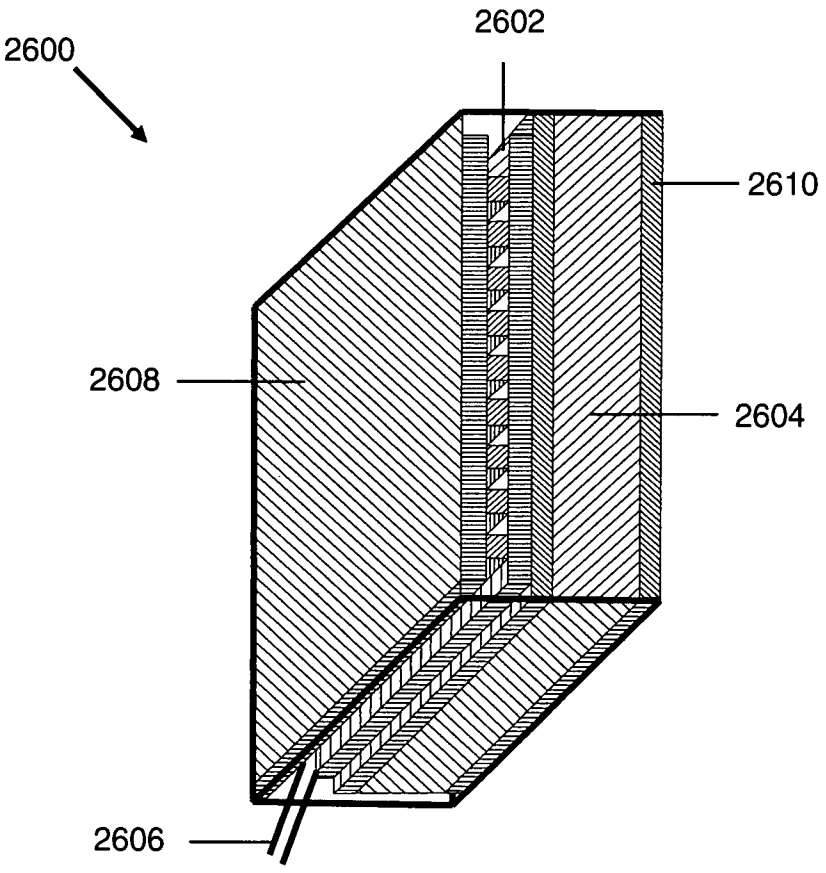
FIG. 26 illustrates a perspective view of a cooling brick, in accordance with an embodiment of the present invention.

FIG. 26 illustrates a perspective view of a cooling brick 2600, in accordance with an embodiment of the present invention. Cooling brick 2600 is used as a cooling engine in thermoelectric cooling systems, such as freezers, refrigerators, and water dispensers, in accordance with various embodiments of the present invention. In accordance with an embodiment of the present invention, cooling brick 2600 is a rectangular block, which is three inches long, three inches wide, and one inch high. However, depending on the application and amount of heat flux passed through it, cooling brick 2600 can assume different dimensions.

Figure 27:
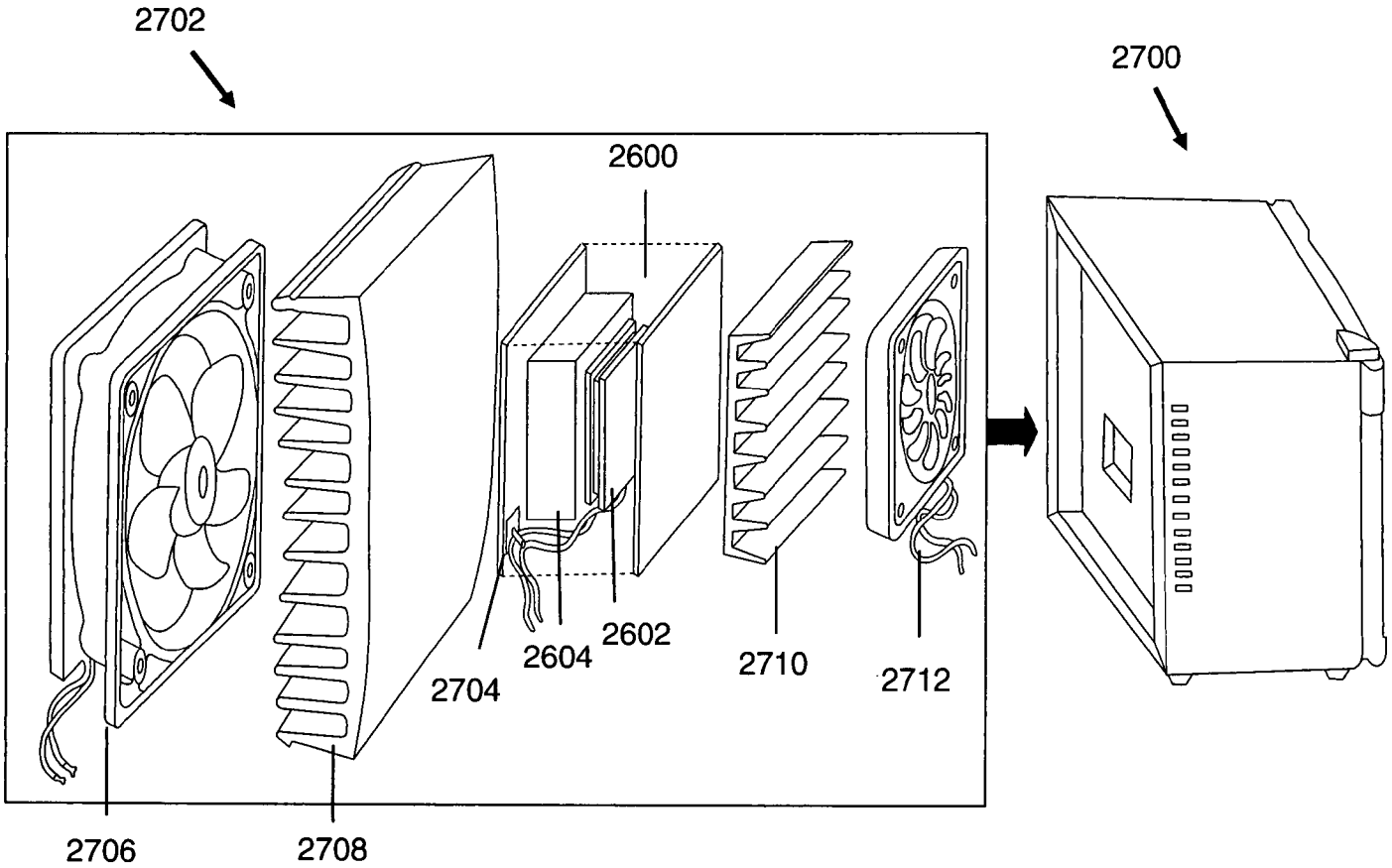
FIG. 27 illustrates an exploded view of a cooling system containing a cooling brick, in accordance with an embodiment of the present invention.

In accordance with various embodiments of the present invention, cooling brick 2600 comprises a thermoelectric cooler module 2602, a vapor diode 2604, and a switching circuit (marked 2704 in FIG. 27). Cooling brick 2600 has two sides—a first side 2608 and a second side 2610. In accordance with an embodiment of the present invention, first side 2608 is connected to a chamber that needs to be cooled (explained in conjunction with FIG. 28 and FIG. 29) and second side 2610 is connected to a heat sink (explained in conjunction with FIG. 27). First side 2608 absorbs heat from the chamber and second side 2610 rejects the heat.

Vapor diode 2604 acts as a thermal diode that maintains a directional dependency of heat flow through cooling brick 2600. Vapor diode 2604 allows flow of heat from the chamber to the heat sink and prevents flow of heat from the heat sink to the chamber.

The choice of the thermal diode for the present invention depends on a parameter of thermal diodes known as diodicity $\gamma$. Diodicity of a thermal diode is defined as the ratio of thermal conductance in the forward-conducting direction to that in the reverse direction. Thermal diodes for the purpose of this invention have a diodicity as high as possible, ideally greater than or equal to 100. Therefore, vapor diodes are preferred over other thermal diodes, since the diodicity of vapor diodes is greater than 150. In accordance with other embodiments of the present invention, other thermal diodes using mechanically moving parts such as water-pumped loops and air diaphragms are used.

Cooling brick 2600 has a port 2606, which includes electrical leads to provide DC electrical current to thermoelectric cooler module 2602 and the switching circuit. In accordance with an embodiment of the present invention, cooling brick 2600 is powered with a 12V DC electrical current supply capable of supplying 6 A to 15 A current. The cooling brick 2600 may be powered with 110V AC or 220V AC if the voltages are converted to 12V DC to 15V DC by a transformer and rectifier. The switching circuit present in cooling brick 2600 is described in detail in conjunction with FIG. 36.

In accordance with various embodiments of the present invention, thermoelectric cooler module 2602 of cooling brick 2600 contains multiple thermocouples capable of pumping heat from first side 2608 to second side 2610 of cooling brick 2600. In various embodiments of the present invention, cooling brick 2600 also contains thermal elements such as thermal capacitors. A thermal capacitor is a system with high-specific heat capacity liquid, for example, water, which can be used to maintain the temperature within a desired temperature range. In various embodiments of the invention, thermal capacitors are PCMs or water reservoirs with high-specific heat capacity suspensions.

Apart from the improved COP that results from the method for operating cooling brick 2600 mentioned in the present invention, the advantage of cooling brick 2600 over a system that has a thermoelectric cooler module, vapor diode, and a switching circuit as separate elements is that cooling brick 2600 makes a cooling system modular, similar to vapor compressors. Therefore, refrigeration systems using cooling brick 2600 are easy to assemble and integrate in a refrigerator, thereby lowering manufacturing costs. Thus, a refrigerator can be assembled without any electrical or cooling expertise. Further, cooling brick 2600 can be used without any major design modifications. Furthermore, cooling brick 2600 has less external wiring for temperature sensors and control circuits, and the four adiabatic sides of the brick can be insulated with thermal insulators such as polystyrene foams to prevent heat loss.

FIG. 27 illustrates an exploded view of a cooling system 2700 containing cooling brick 2600, in accordance with an embodiment of the present invention.

Cooling system 2700 is a refrigerator box containing a cooling part 2702 that cools cooling system 2700. Cooling part 2702 contains cooling brick 2600. As explained in conjunction with FIG. 26, cooling brick 2600 contains thermoelectric cooler module 2602, vapor diode 2604, and a switching circuit 2704. A hot fan 2706 and a hot sink 2708 are provided to facilitate transfer of heat from cooling brick 2600 to the ambient. A cold sink 2710 and a cold fan 2712 are provided to facilitate transfer of heat from a fluid to be cooled to cooling brick 2600.

Figure 28:
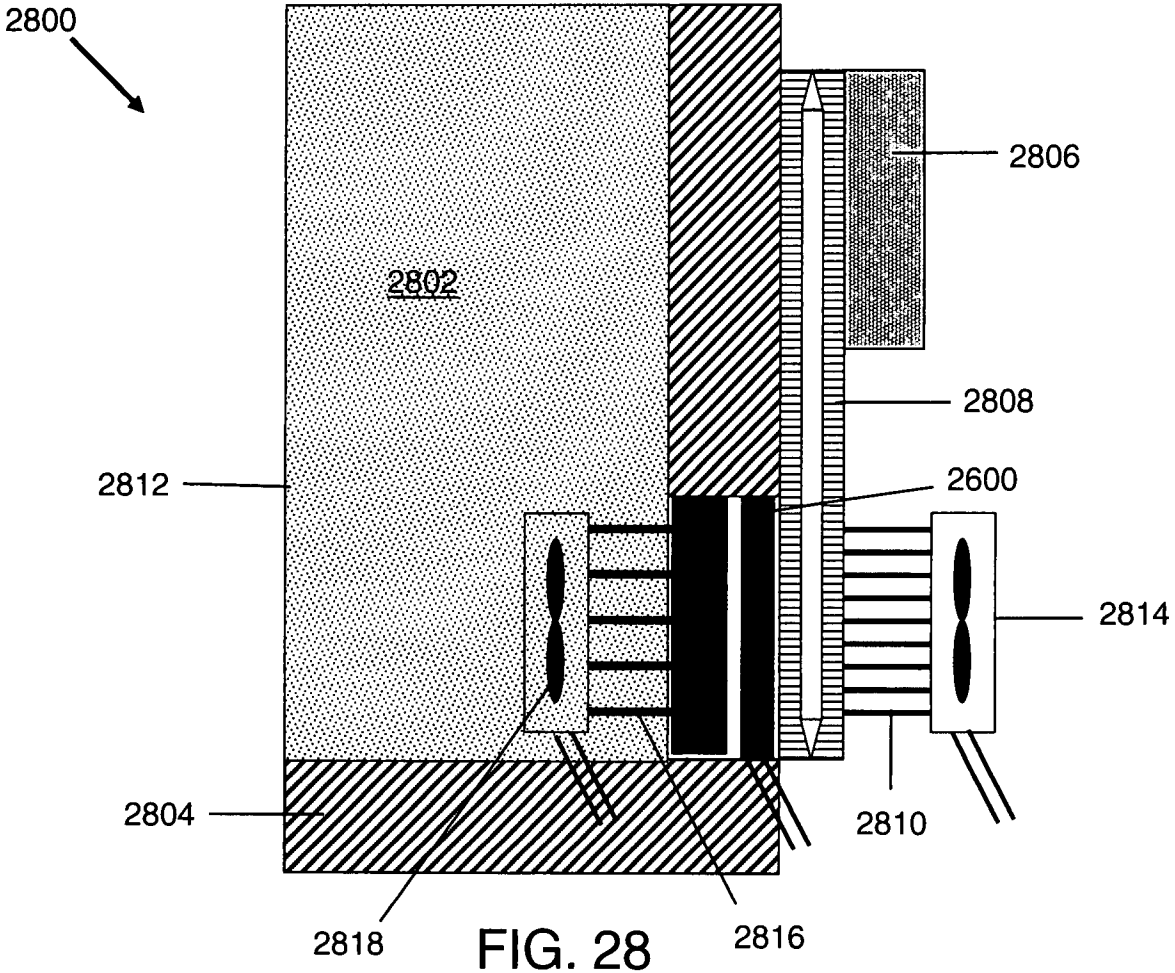
FIG. 28 illustrates a cross-sectional view of a thermoelectric refrigerator with a cooling brick, in accordance with an embodiment of the present invention.

FIG. 28 illustrates a cross-sectional view of a cooling system 2800 with cooling brick 2600, in accordance with an embodiment of the present invention. In addition to cooling brick 2600, cooling system 2800 includes a cold chamber 2812, a third thermal capacitor 2806, a metal plate 2808 that contains a heat pipe, and a heat sink 2810. In accordance with another embodiment of the current invention, metal plate 2808 can contain a set of one or more heat pipes.

In cooling system 2800, cold chamber 2812 contains a fluid 2802 that needs to be cooled. In accordance with an embodiment of the present invention, fluid 2802 is the air of a cold store or a refrigerator. Cold chamber 2812 is enclosed by a first insulating wall 2804 that helps in preventing transfer of heat from the ambient to fluid 2802, thereby helping in maintaining fluid 2802 within a desired temperature range. In an exemplary embodiment, the desired temperature range is between zero degrees centigrade and eight degrees centigrade. In accordance with various embodiments of the present invention, first insulating wall 2804 is made of a material with low thermal conductivity. Typical examples of materials with low thermal conductivity include polyurethane and plastic foam.

Cooling of fluid 2802 in cold chamber 2812 is done by cooling brick 2600, which is present in cooling system 2800. When a DC current is passed through cooling brick 2600, cooling brick 2600 extracts heat from fluid 2802 through heat sink 2810 and an air-fan 2814, and thereby cools fluid 2802. Air fan 2814 is provided to aid dissipation of heat from heat sink 2810 to the ambient. The extracted heat and the joule heat of cooling brick 2600 are dissipated to the heat pipe embedded in metal plate 2808, which is connected to cooling brick 2600. The heat pipe maintains the temperature of the top of metal plate 2808 at the same temperature as the bottom of the metal plate. The other side of metal plate 2808 connects to third thermal capacitor 2806 at the top and to heat sink 2810 at the bottom. Third thermal capacitor 2806 maintains the temperature of metal plate 2808 at a constant value close to ambient temperature during switching transients. In addition, heat sink 2810 and air fan 2814 dissipate the heat to the ambient and also maintain the temperature of metal plate 2808 close to ambient temperature. The relative positions of heat sink 2810 and third thermal capacitor 2806 can be interchanged as long as they are thermally connected to metal plate 2808.

In an exemplary embodiment, third thermal capacitor 2806 is a package of PCM with a phase transition temperature slightly (5 degrees centigrade) higher than ambient temperature. In another exemplary embodiment, PCM in third thermal capacitor 2806 is made from paraffin. Typical examples of paraffin that are used to make PCM in third thermal capacitor 2806 include eicosane and docosane. In yet another exemplary embodiment, PCM in third thermal capacitor 2806 is made of salt hydrates. Magnesium sulfate heptahydrate is an example of a typical salt hydrate that is used to make PCM in third thermal capacitor 2806. In still another exemplary embodiment, PCM in third thermal capacitor 2806 is made of liquid metals. Typical examples of liquid metals that are used to make PCM in third thermal capacitor 2806 include, but are not limited to, gallium, indium, and tin alloys.

In accordance with an embodiment of the present invention, a cold-side heat sink 2816 and a cold fan 2818 are provided in cold chamber 2812. Cold-side heat sink 2816 and cold fan 2818 help in transferring heat from fluid 2802 to cooling brick 2600 and in maintaining a uniform temperature in cold chamber 2812.

Figure 29:
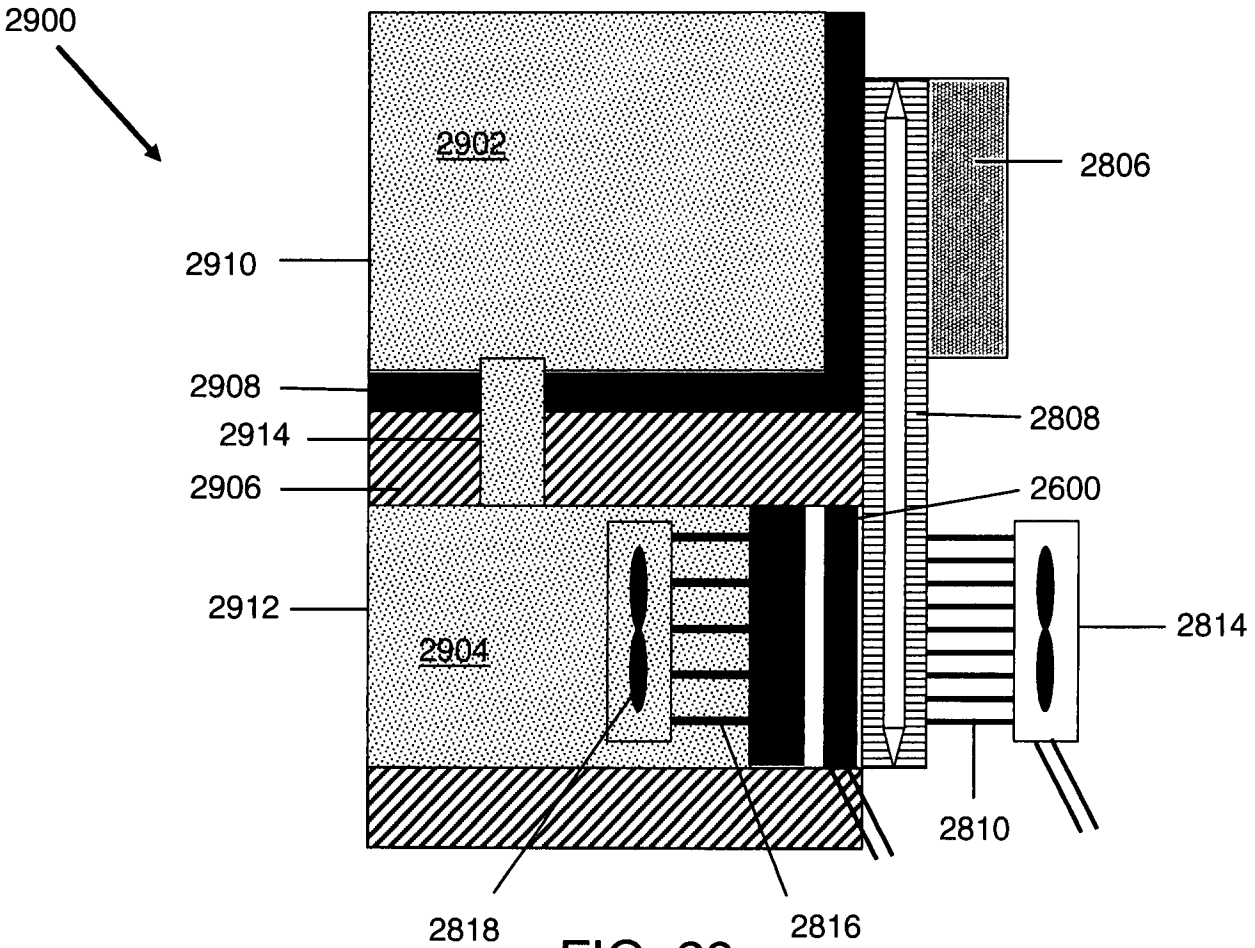
FIG. 29 illustrates a cross-sectional view of a thermoelectric fluid dispenser with a cooling brick, in accordance with an embodiment of the present invention.

FIG. 29 illustrates a cross-sectional view of a cooling system 2900 with cooling brick 2600, in accordance with an embodiment of the present invention. Cooling system 2900 includes a first chamber 2910 containing a first fluid 2902, and a second chamber 2912 containing a second fluid 2904.

In cooling system 2900, second chamber 2912 contains second fluid 2904 that needs to be cooled. In an exemplary embodiment of the present invention, second fluid 2904 is water. Cooling of second fluid 2904 is done in second chamber 2912 by cooling brick 2600. When a DC current is passed through cooling brick 2600, it extracts heat from second fluid 2904, thereby cooling second fluid 2904, and dissipates the extracted heat and the joule heat of cooling brick 2600 to the heat pipe contained in metal plate 2808, which is connected to cooling brick 2600. Second chamber 2912 is enclosed by a second insulating wall 2906 that inhibits heat flow from the ambient and first chamber 2910 to second fluid 2904, thereby helping in maintaining second fluid 2904 within a constant temperature range.

Metal plate 2808 includes a first end and a second end. The first end has a first surface, which is mechanically connected to the hot end of cooling brick 2600, and an opposite surface, which is connected to heat sink 2810. The second end is sandwiched between third thermal capacitor 2806 with PCM and conducting walls of first chamber 2910. In accordance with an embodiment of the present invention, the second end of metal plate 2808 is connected to third thermal capacitor 2806 in such a manner that metal plate 2808 enables transfer of heat, which is dissipated at the hot end of cooling brick 2600, to third thermal capacitor 2806, which is maintained at a constant temperature close to ambient temperature. First fluid 2902 in first chamber 2910 also acts as a thermal capacitor and maintains the temperature of metal plate 2808 close to ambient temperature.

First chamber 2910 is mechanically connected to the second end of metal plate 2808 in such a manner that the heat dissipated by cooling brick 2600 is transferred to first fluid 2902. In accordance with an embodiment, first chamber 2910 includes thermally conducting parts 2908 that enable transfer of heat from metal plate 2808 to first fluid 2902. Since water has a high-specific heat capacity, it helps to maintain a constant temperature in first chamber 2910.

Therefore, in an embodiment of the present invention, first fluid 2902 is water. Further, the volume of first fluid 2902 is greater than that of second fluid 2904. Thus, first fluid 2902 has a higher heat capacity than second fluid 2904. Consequently, the temperature of first fluid 2902 is relatively constant even when cooling brick 2600 is turned on. In accordance with an embodiment, the typical temperature differential between first fluid 2902 and second fluid 2904 varies from 20 degrees centigrade to 25 degrees centigrade.

In an embodiment, first chamber 2910 and second chamber 2912 are connected through a fluid pipe 2914 to enable transfer of fluid from first chamber 2910 to second chamber 2912. For the purpose of this description, only two chambers have been shown for cooling system 2900. However, it will be apparent to a person skilled in the art that cooling system 2900 may include more than two chambers and the cooling scheme can be cascaded to cool the fluids to low temperatures.

Figure 30:
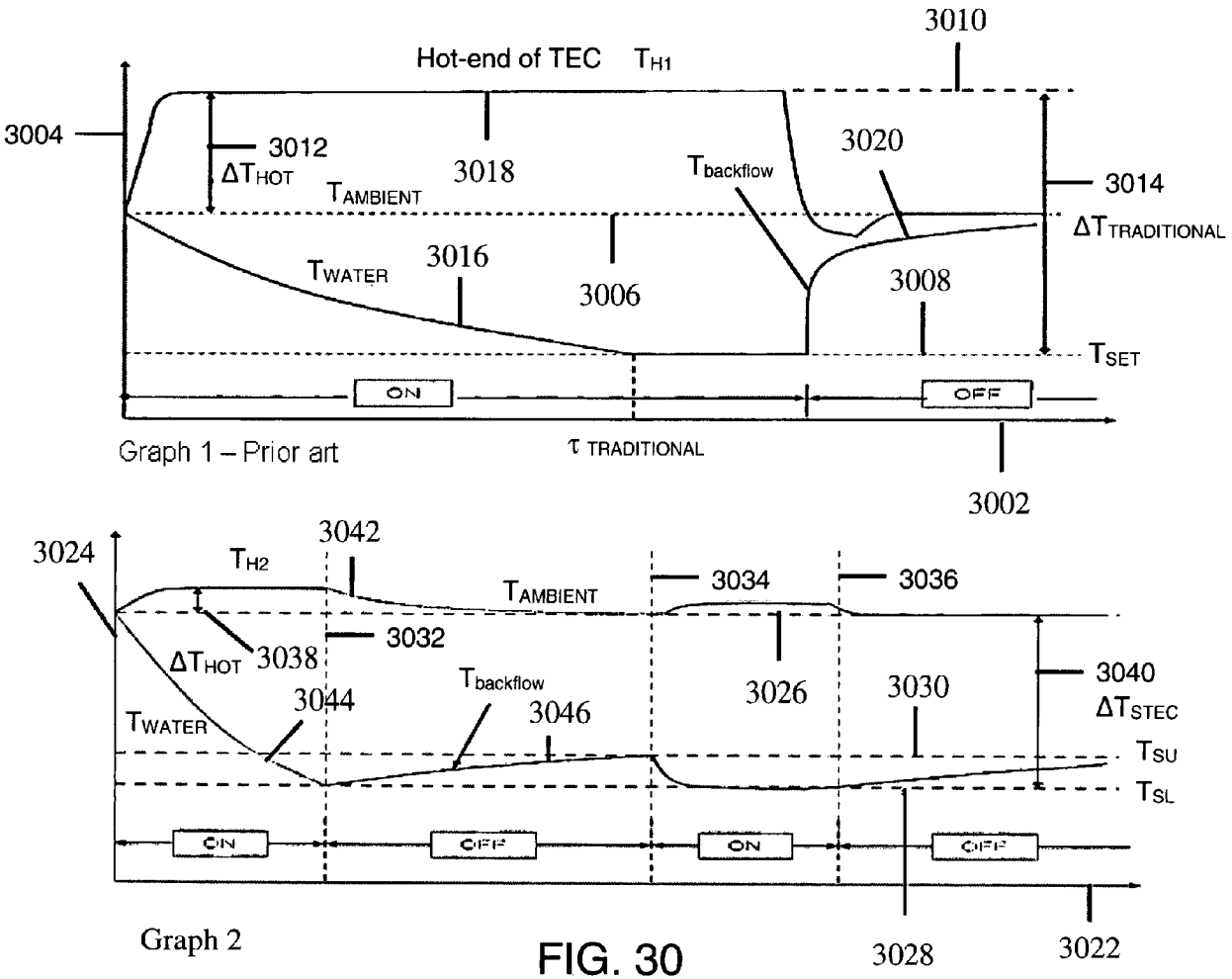
FIG. 30 illustrates graphs depicting variations in temperature with time for a conventional cooling device and a cooling system in accordance with an embodiment of the present invention.

FIG. 30 illustrates two graphs depicting variations in the temperature with time for (1) a conventional cooling device, and (2) the cooling system in accordance with various embodiments of the present invention.

Graph 1 plots temperature vs. time for a conventional cooling device during the process of cooling of a fluid. In Graph 1, time is represented on a horizontal axis 3002, and temperature is represented on a vertical axis 3004. A first dotted line 3006 represents a constant ambient temperature and is indicated by $T_{AMBIENT}$ in Graph 1. Further, a second dotted line 3008 corresponds to a target temperature to which the fluid needs to be cooled and is indicated by $T_{SET}$ in Graph 1. In addition, a third dotted line 3010, corresponding to a maximum temperature of a hot end of the conventional cooling device, is indicated by the hot end of TEC ($T_{H1}$) in Graph 1. When the conventional cooling device is turned on, the hot end of the cooler quickly attains an equilibrium temperature $T_{H1}$, depending on the efficiency of the heat sink and the associated air flow. In conventional cooling devices, which use the typical heat sinks, $T_{H1}$ is about 20 degrees higher than ambient temperature. The difference between $T_{H1}$ and $T_{AMBIENT}$, is represented by a first double arrow 3012 and is labeled as $\Delta T_{HOT}$ in Graph 1. Furthermore, the difference between $T_{H1}$ and $T_{SET}$, is indicated by a second double arrow 3014 and is labeled as $\Delta T_{TRADITIONAL}$ in Graph 1.

In the process of cooling by using the conventional cooling device, the fluid to be cooled is initially at $T_{AMBIENT}$. The temperature of the fluid drops to $T_{SET}$ after a time duration of $\tau_{TRADITIONAL}$. The temporal variation of the fluid temperature is represented by a first curved line 3016, and is indicated by $T_{WATER}$ in Graph 1. Since the conventional cooling device dissipates the extracted heat and the associated joule heat of the device to the hot end, there is a rise in the temperature of the hot end of the conventional cooling device. Typically, the rise in the temperature of the hot end of the conventional cooling device is in the range of 35 degrees centigrade to 45 degrees centigrade. A second curved line 3018 plots the variations in the temperature of the hot end with time throughout the cooling process. While the hot end of the conventional cooling device quickly attains equilibrium, the fluid achieves the desired cold temperature only after the time period of $\tau_{TRADITIONAL}$.

When the conventional cooling device is switched off, heat from the hot end of the conventional cooling device flows back into the cold fluid. This backflow of heat through the thermoelectric device is represented by a third curved line 3020 and is labeled as $T_{backflow}$ in Graph 1. Third curved line 3020 is the variation of the temperature of the cooled fluid with time after the conventional cooling device has been turned off. When the conventional cooling device is turned off, heat flows from the hot end ($T_{H1}$) to the fluid ($T_{WATER}$). As shown in Graph 1, $T_{H1}$ shows a drop (in some cases even below ambient temperature). In conventional cooling devices, the thermal conductance between the cooling module and the heat sink is maximized to optimize its efficiency in transferring the heat. This is usually performed by applying thermally conducting interface pastes or epoxies. Although the close thermal contact with the heat sink is beneficial during the normal operation when the conventional cooling device is turned off, this high conductance facilitates the backflow of heat into the cooled fluid. Therefore, it is necessary to keep the conventional cooling device operational which increases the consumption of energy.

When a conventional thermoelectric cooling device is turned on to cool the fluid, the hot end of the thermoelectric cooler quickly attains an equilibrium temperature depending on the efficiency of the heat sink and the associated air flow. In conventional thermoelectric cooling devices that use typical aluminum heat sinks and typical hot side air fan (about 40-50 c.f.m airflow), this equilibrium temperature is in the range of 40 degrees centigrade to 45 degrees centigrade, which is about 20 degrees centigrade higher than ambient temperature. When the conventional thermoelectric cooling device is switched off, heat from its hot end flows back into the fluid.

Further, in conventional thermoelectric cooling devices, the thermal conductance of the heat sink is maximized to decrease the temperature of the hot side of the thermoelectric cooler and thereby maximizing its cooling efficiency. Thermal conductance is increased by applying thermally conducting interface pastes or epoxies between the thermoelectric cooler and the heat sink. Also, to lower the hot side temperature of conventional thermoelectric cooling systems, larger heat sinks and air fans with larger airflows are preferred. While better thermal contacts and larger heat sinks facilitate better heat rejection during the on state, they enhance the backflow of heat during the off state. Therefore, it is generally necessary to keep the conventional cooling device operational which results in increasing the consumption of energy.

Graph 2 shows the performance of a thermoelectric cooling device in accordance with an embodiment of the present invention, and plots the variation in the temperature of the fluid with time during a process of cooling.

In accordance with an embodiment, the first body has two different thermal conductances. In accordance with this embodiment, the thermal conductance between the hot end of the thermoelectric device and the first fluid is high when the thermoelectric cooling device is switched on and a low thermal conductance when it is switched off.

In Graph 2, time is represented on a horizontal axis 3022, and temperature is represented on a vertical axis 3024. A fourth dotted line 3026 represents a constant ambient temperature that is indicated by $T_{AMBIENT}$ in Graph 2. Further, a fifth dotted line 3028 represents a lower limit of temperature after the fluid has been cooled, which is indicated by $T_{SL}$ in Graph 2. A sixth dotted line 3030 represents an upper limit of temperature of the fluid. This temperature level is indicated by $T_{SU}$ in Graph 2, and corresponds to a temperature threshold at which the cooling system needs to be switched on again. In a simple proportional control system, these two temperatures define the proportional band.

A seventh dotted line 3032 represents the time corresponding to the end of the transient phase, i.e., the time when the thermoelectric device is switched off for the first time.

The time corresponding to the switching cycle phase when the thermoelectric device is switched on after the transient is depicted between an eighth dotted line 3034 and a ninth dotted line 3036.

The difference between the maximum temperature of the hot end of the thermoelectric device and $T_{AMBIENT}$ is represented by a third double arrow 3038 and is indicated by $\Delta T_{HOT}$ in Graph 2. The difference between the ambient temperature $T_{AMBIENT}$ and $T_{SL}$ is represented by a fourth double arrow 3040, and is indicated by $\Delta T_{STEC}$ in Graph 2.

On comparing the two graphs, it is evident that the $\Delta T_{HOT}$ in Graph 1 is higher than the $\Delta T_{HOT}$ in Graph 2. This is because the heat dissipated at the heat sink of the thermoelectric device according to embodiments of the invention is dissipated in the first fluid. The high heat capacity of the first fluid clamps the rise in the temperature of the heat sink of the thermoelectric device. The variations in the temperature of the hot end of the thermoelectric device are represented by a fourth curved line 3042, and indicated by $T_{H2}$ in Graph 2. Further, the variations in the temperature of the second fluid are represented by a fifth curved line 3044, and, are indicated by $T_{WATER}$. In an exemplary embodiment, the rise in the temperature of the hot end of the cooling system is in the range of 1 degree centigrade to 3 degrees centigrade. This rise in the temperature of the hot end is significantly less than the rise in the temperature in the case of a conventional cooling device. It should be apparent to a person skilled in the art that the thermoelectric device is most efficient when the temperature differential across its ends is the minimum. Since $T_{H2}$ is kept close to the ambient temperature, as represented in Graph 2, the thermoelectric device attains $T_{SL}$ much faster and more efficiently than a conventional design. This enables switching off the cooling device earlier: Additionally, since the backflow of heat is prevented, the cooling device can remain switched off for a longer period of time.

As represented in Graph 2, when the thermoelectric device is turned off, the second fluid takes more time to reach the $T_{SU}$. The directional nature of the heat flow in the first body prevents the backflow of heat from the hot end of the thermoelectric device, as represented by a sixth curved line 3046 and indicated by $T_{backflow}$ in Graph 2. This is generally not possible in a conventional design in which the first body does not work in a similar manner as a thermal diode. Typically, the switched off state can be five times longer than the switched on state. This results in further improvement in the efficiency of the cooling device. This is particularly beneficial when the second fluid is not drained and the thermoelectric device runs for a long period of time, thereby conserving electric power.

Figure 31:
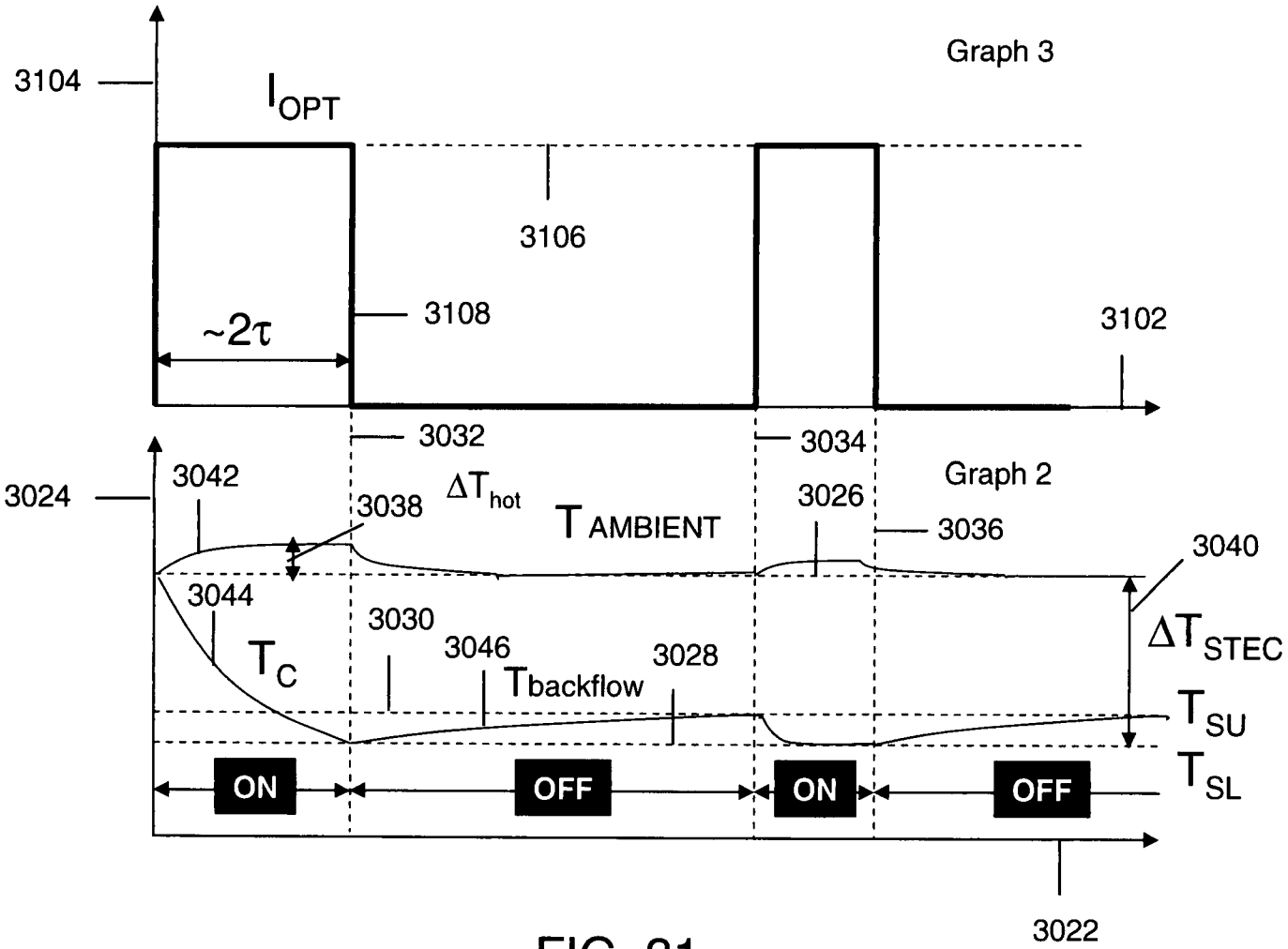
FIG. 31 illustrates graphs depicting variations in temperature and current with time for a cooling system, in accordance with an embodiment of the present invention.

FIG. 31 illustrates Graph 3 depicting variations in input current with time, and Graph 2 (explained in conjunction with FIG. 30) depicting variations in temperature with time for a thermoelectric cooling system, in accordance with an embodiment of the present invention.

Graph 3 plots current vs. time during the process of cooling of a fluid by using a thermoelectric cooling device, in accordance with an embodiment of the present invention. In Graph 3, time is represented on a horizontal axis 3102 and current is represented on a vertical axis 3104. A tenth dotted line 3106 represents the optimal current $I_{OPT}$. The efficiency of the thermoelectric cooling system is maximized when the optimal current $I_{OPT}$ is passed through it.

In the embodiments of the present invention, the thermoelectric cooling device has a vapor diode with strong diodicity which results in high thermal conductance during the on state and extremely low conductance during the off state. Thus, the thermoelectric cooling device combines thermal switching along with electrical switching to deliver an efficient refrigeration system. In an embodiment, the thermoelectric device is turned off at a time t, where time t is less than or equal to two times the time constant (indicated as $2\tau$), resulting in doubling the COP of the thermoelectric cooling device. The variations of current with time are represented at 3108 in FIG. 31.

The process of cooling the fluid from the ambient temperature $T_{AMBIENT}$ by using the thermoelectric cooling device and maintaining its temperature within the temperature range ($T_{SL}$ to $T_{SU}$) includes two phases—a transient phase and a switching cycle phase. During the transient phase, the thermoelectric cooling device is switched on until the fluid is cooled from ambient temperature to a lower limit of temperature $T_{SL}$. Since cooling is done in the transient phase, the temperature of the hot end of the thermoelectric cooling device increases to its highest limit during this phase. When the lower limit of temperature is reached, the thermoelectric cooling device is turned off and the temperature rises due to heat leakage into the fluid. The temperature of the fluid is maintained within the temperature range $T_{SL}$ to $T_{SU}$ by switching the thermoelectric cooling device on and off at regular intervals, i.e., the switching cycle phase. In the switching cycle phase, the thermoelectric cooling device pumps the small amount of heat that leaks during the off state. Thus, the temperature of the hot end of the thermoelectric cooling device shows a negligible or insignificant rise during the switching cycle phase.

It should be apparent to a person skilled in the art that the thermoelectric cooling device is the most efficient when the temperature differential across its ends is the minimum. In an embodiment of the present invention, thermal capacitors clamp the hot side temperature of the thermoelectric cooling device close to ambient temperature. Therefore, the fluid attains $T_{SL}$ faster and more efficiently with the thermoelectric cooling device than a conventional thermoelectric cooling device. Thus, time required for the thermoelectric cooling device to remain switched on is less as compared to the time required for the conventional thermoelectric cooling device. This improves the duty cycle and efficiency of the thermoelectric cooling device according to the present invention. Additionally, since the backflow of heat is prevented, the thermoelectric cooling device can remain switched off for a long period of time, thereby saving significant amount of energy.

When the thermoelectric cooling device is turned off, the fluid takes more time to reach $T_{SU}$ as compared with the time taken in a conventional thermoelectric cooling device. The directional nature of the heat flow in the vapor diode prevents the backflow of heat from the hot end of the thermoelectric cooling device.

The time periods for which the thermoelectric cooling device is turned on are indicated by "ON" and the time periods for which the thermoelectric cooling device is turned off are indicated by "OFF" in Graph 2.

To maximize the COP of the transient phase, the thermoelectric cooling device should be turned off at an optimal time. In an embodiment, the efficiency of the thermoelectric cooling device is the maximum when an optimal current $I_{OPT}$ flows through it.

The equation representing the optimal current $I_{OPT}$, based on an analysis of a cooling system cooled by a thermoelectric device and powered by a current step waveform, in accordance with the present invention, is:

$$I_{OPT} = \frac{Z(T_0 - T_S)}{R\left(\sqrt{1 + 0.5Z(T_0 + T_S)} - 1\right)} \quad (1)$$

where, z is a figure of merit of the thermoelectric material;

$T_0$ is the ambient temperature at which the hot side of the thermoelectric device is clamped;

$T_s$ is the set point temperature; and

R is the resistance of the thermoelectric material.

Further, the steady-state temperature that the chamber achieves in the absence of a switching cycle after the transient phase, when the optimal current $I_{OPT}$ is passed through the thermoelectric device is given by the equation:

$$T_{C\infty}(I_{OPT}) = \frac{(K + K_l)T_0 + \frac{1}{2}I^2R}{K + K_l + SI} \quad (2)$$

where, $T_{C\infty}(I_{OPT})$ is the steady-state temperature that the chamber will attain at the end of the transient phase if there was no switching;

$T_0$ is the ambient temperature at which the hot side of the thermoelectric device is clamped;

K is the thermal conductivity of the thermoelectric device;

$K_l$ is the leakage conductance of the cold chamber; and

S is the effective seebeck coefficient of the thermoelectric device.

The thermoelectric cooling process is approximated by an exponentially decaying function of time such that the cold end temperature is represented by the equation:

$$T_C(t) = T_{C\infty} - (T_{C\infty} - T_0)e^{-t/\tau} \quad (3)$$

where,

Tc(t) is the temperature of the cooled material at time t;

$T_{C\infty}$ is the steady-state temperature of the cooled material;

$T_0$ is the initial temperature of the cooled material; and

τ is the time constant, which is directly proportional to the total heat capacity, and inversely proportional to (K+SI).

Further, the time constant of the cooling at the optimal operation mode is given by the equation:

$$\tau(I_{OPT}) = \frac{mC}{K + K_l + SI_{OPT}} \quad (4)$$

where, m is the mass of the materials in the chamber; and

C is the effective heat capacity of the materials in the chamber.

Furthermore, duty cycle (D) represents the fraction of the switching cycle period when the cooler is in an on state. Smaller duty cycle implies proportionally lower power dissipation since the thermoelectric device is ON only for a small fraction of time. The duty cycle for the optimal current is given by the equation:

$$D(I_{OPT}) = \frac{1}{1 + \frac{(K + K_l + SI_{OPT})}{K_l} \cdot \left[\frac{T_S - T_{C\infty}(I_{OPT})}{T_0 - T_S}\right]} \quad (5)$$

Figure 32:
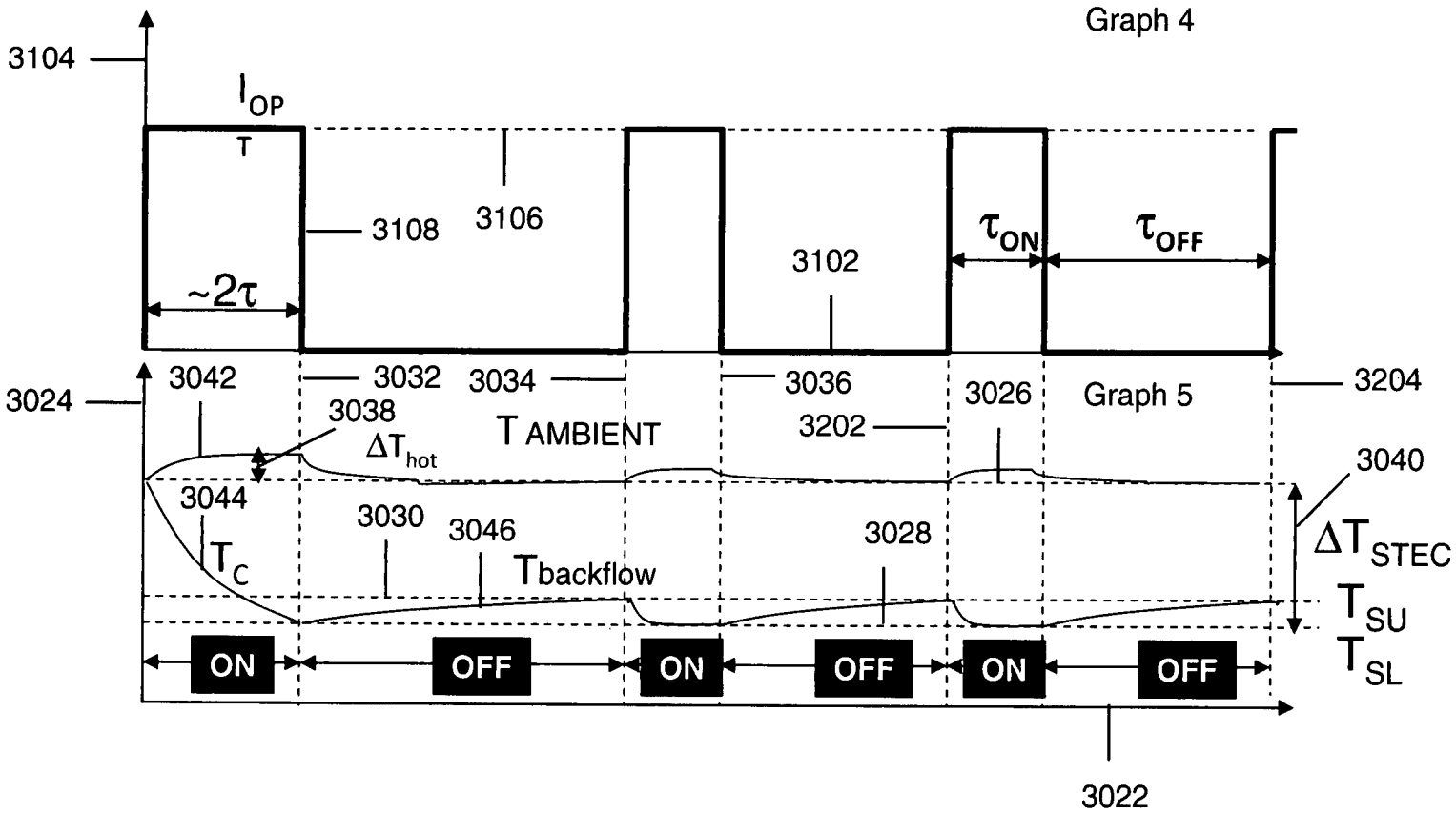
FIG. 32 illustrates graphs depicting variations in temperature and current with time for a cooling system, in accordance with another embodiment of the present invention.

FIG. 32 illustrates graphs depicting variations in temperature and current with time for a cooling system, in accordance with an embodiment of the present invention.

Graph 4 plots current vs. time during the process of cooling of a fluid using a thermoelectric cooling device in accordance with the present invention. Graph 4 includes, in addition to the elements described in conjunction with Graph 3, variations in current during a subsequent switching cycle. The additional switching cycle is depicted between an eleventh dotted line 3202 and a twelfth dotted line 3204.

Graph 5 illustrates the performance of the thermoelectric cooling device and plots the time variations in the fluid temperature during a cooling process in accordance with an embodiment of the present invention. Graph 4 includes, in addition to the elements described in conjunction with Graph 3, performance of the thermoelectric cooling device during the subsequent switching cycle.

Figure 33:
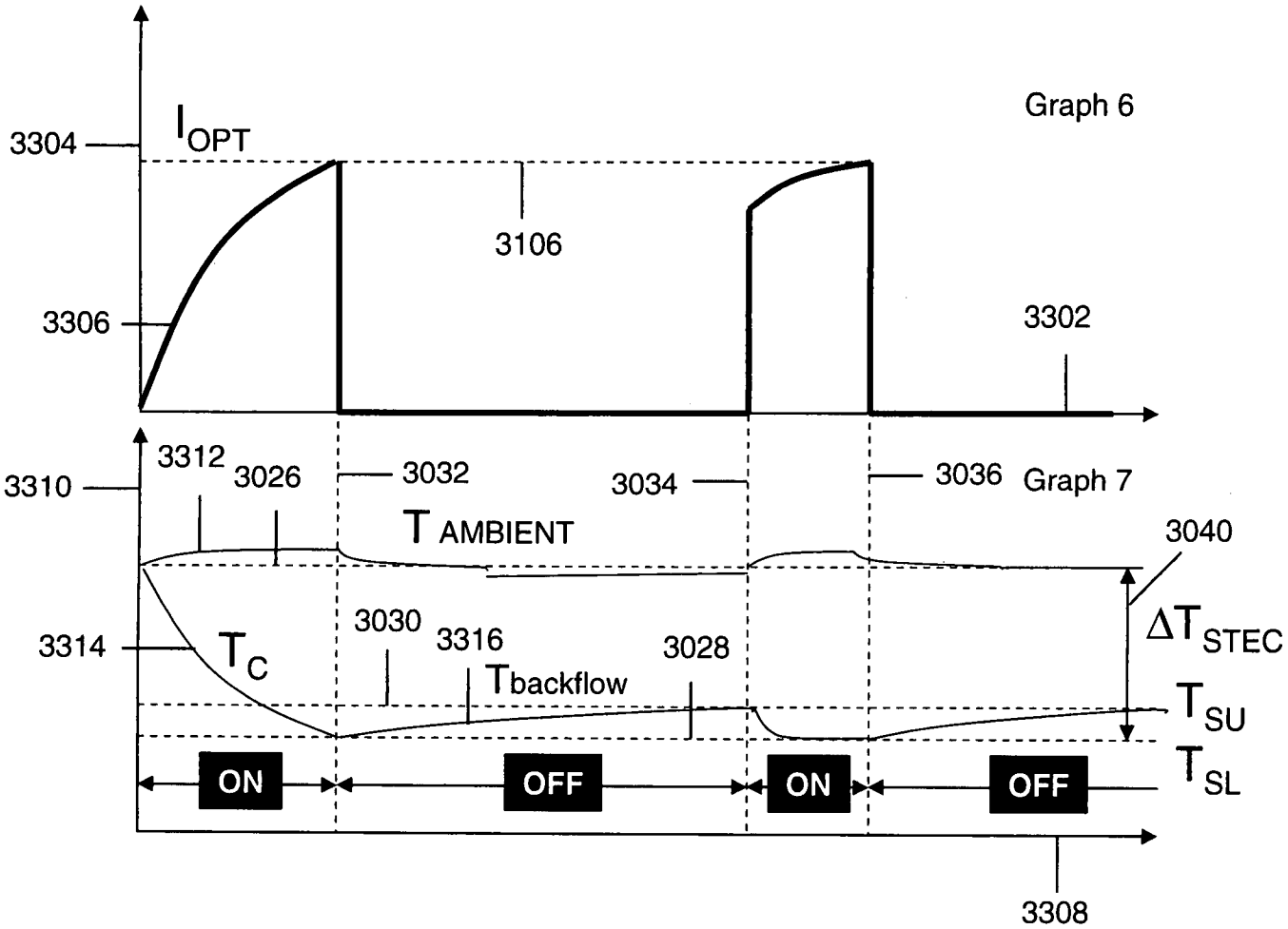
FIG. 33 illustrates graphs depicting variations in temperature and current with time for proportional current feedback for a cooling system, in accordance with yet another embodiment of the present invention.

FIG. 33 illustrates two graphs, Graph 6 depicting variations in input current with time, and Graph 7 depicting variations in temperature with time for a thermoelectric system with proportional current feedback in accordance with another embodiment of the present invention.

Graph 6 plots current vs. time during the process of cooling of a fluid by using a thermoelectric cooling device, in accordance with an embodiment of the present invention. In Graph 6, time is represented on a horizontal axis 3302 and current is represented on a vertical axis 3304. Tenth dotted line 3106 represents the optimal current $I_{OPT}$. The efficiency of the thermoelectric cooling system is maximized when the optimal current $I_{OPT}$ is passed through it.

In an embodiment of the present invention, the shape of the waveform of the current is given by the equation:

$$I(t) = \beta\Delta T \quad (6)$$

where,

ΔT is the instantaneous temperature difference across the thermoelectric cooler module; and β is a constant of proportionality.

Thus, the current through the thermoelectric cooling device is proportional to the temperature difference across the thermoelectric cooler module. The variation of input current with time is represented at 3306 in FIG. 33.

Graph 7 shows the performance of the thermoelectric cooling device with proportional feedback and plots variations in the fluid temperature with respect to time during a cooling process, in accordance with an embodiment of the present invention. In Graph 7, time is represented on a horizontal axis 3308 and temperature is represented on a vertical axis 3310. Passing current that is proportional to the temperature difference across the thermoelectric cooler module improves efficiency of the cooling.

The variations in the temperature of the hot end of the thermoelectric device with proportional current feedback are represented by a seventh curved line 3312 in Graph 7. Further, the variations in the temperature of the fluid from $T_{AMBIENT}$ to $T_{SL}$ are represented by an eighth curved line 3314 in Graph 7.

The variations in the temperature of the fluid from $T_{SL}$ to $T_{SU}$ when the thermoelectric device is turned off are represented by a ninth curved line 3316 and indicated by $T_{backflow}$ in Graph 7. The difference between the ambient temperature $T_{AMBIENT}$ and $T_{SL}$ is represented by fourth double arrow 3040 and indicated by $\Delta T_{STEC}$ in Graph 7.

Figure 34:
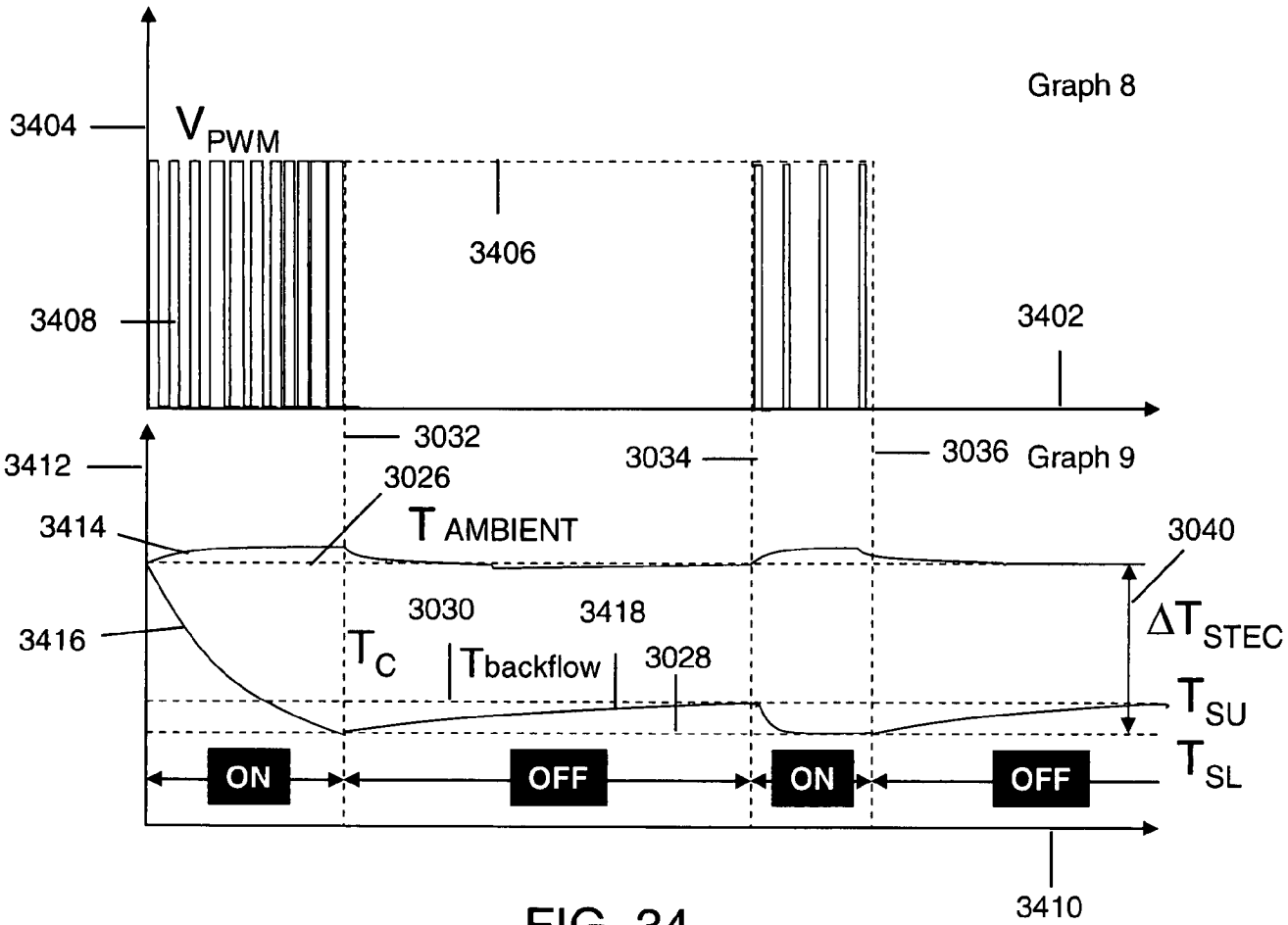
FIG. 34 illustrates graphs depicting variations in temperature and current with time for pulse-width modulated current feedback for a cooling system, in accordance with yet another embodiment of the present invention.

FIG. 34 illustrates graphs depicting variations in temperature and voltage with time for a pulse-width modulated (PWM) scheme, in accordance with yet another embodiment of the present invention. In this embodiment, a switch (3602 explained in conjunction with FIG. 36), switches the output of a rectifier (3710 explained in conjunction with FIG. 37) digitally with different pulse widths during the ON period of the cooling cycle, and thereby produces an average current that varies with time. The PWM switching rise and fall times are much less (<1 millisecond) as compared with the thermal time constants (>1000 seconds). The use of PWM techniques in conjunction with thermal switching techniques using the vapor diode can reduce the power dissipation significantly.

In Graph 8, time is represented on a horizontal axis 3402 and voltage across the thermoelectric cooler is represented on a vertical axis 3404. As shown in Graph 8, the pulse-width modulated voltage waveform allows a digital way of changing the effective bias current of a thermoelectric cooling device whereas Graph 6 shows an analog way of changing it. As shown in Graph 8, the pulse width of the voltage across the thermoelectric cooling device during the first transient (depicted as 3408) starts at short pulse width/duty cycle and increases to large pulse widths. This results in a proportionally higher current through the thermoelectric cooling device. After the temperature of the fluid reaches the set temperature, the pulse width and the duty cycle of the PWM switching is reduced during the ON period (depicted between eighth dotted line 3034 and ninth dotted line 3036). These reduced pulse widths correspond to lower currents through the thermoelectric cooling device and reduce the time-averaged power consumption further. Further, the maximum voltage level during the PWM switching, as depicted by 3406, is at the rectified DC level.

Graph 9 shows the performance of the thermoelectric cooling device with pulse-width modulated voltage and plots the time variations in the fluid temperature during a cooling process, in accordance with an embodiment of the present invention. In Graph 9, time is represented on a horizontal axis 3410 and temperature is represented on a vertical axis 3412. Powering the thermoelectric cooling device by pulse-width modulated voltage waveforms in addition to the thermal switching cycles using the vapor diode improves efficiency of the cooling.

Variations in the temperature of the hot end of the cooling brick using a pulse-width modulated supply is represented by a tenth curved line 3414 in Graph 9. Further, the variations in the temperature of the fluid from $T_{AMBIENT}$ to $T_{SL}$ are represented by an eleventh curved line 3416 in Graph 9.

Variations in the temperature of the fluid from $T_{SL}$ to $T_{SU}$ when the thermoelectric cooling device is turned off is represented by a twelfth curved line 3418 and indicated by $T_{backflow}$ in Graph 9. The difference between the ambient temperature $T_{AMBIENT}$ and $T_{SL}$ is represented by fourth double arrow 3040 and indicated by $\Delta T_{STEC}$ in Graph 9.

Figure 35:
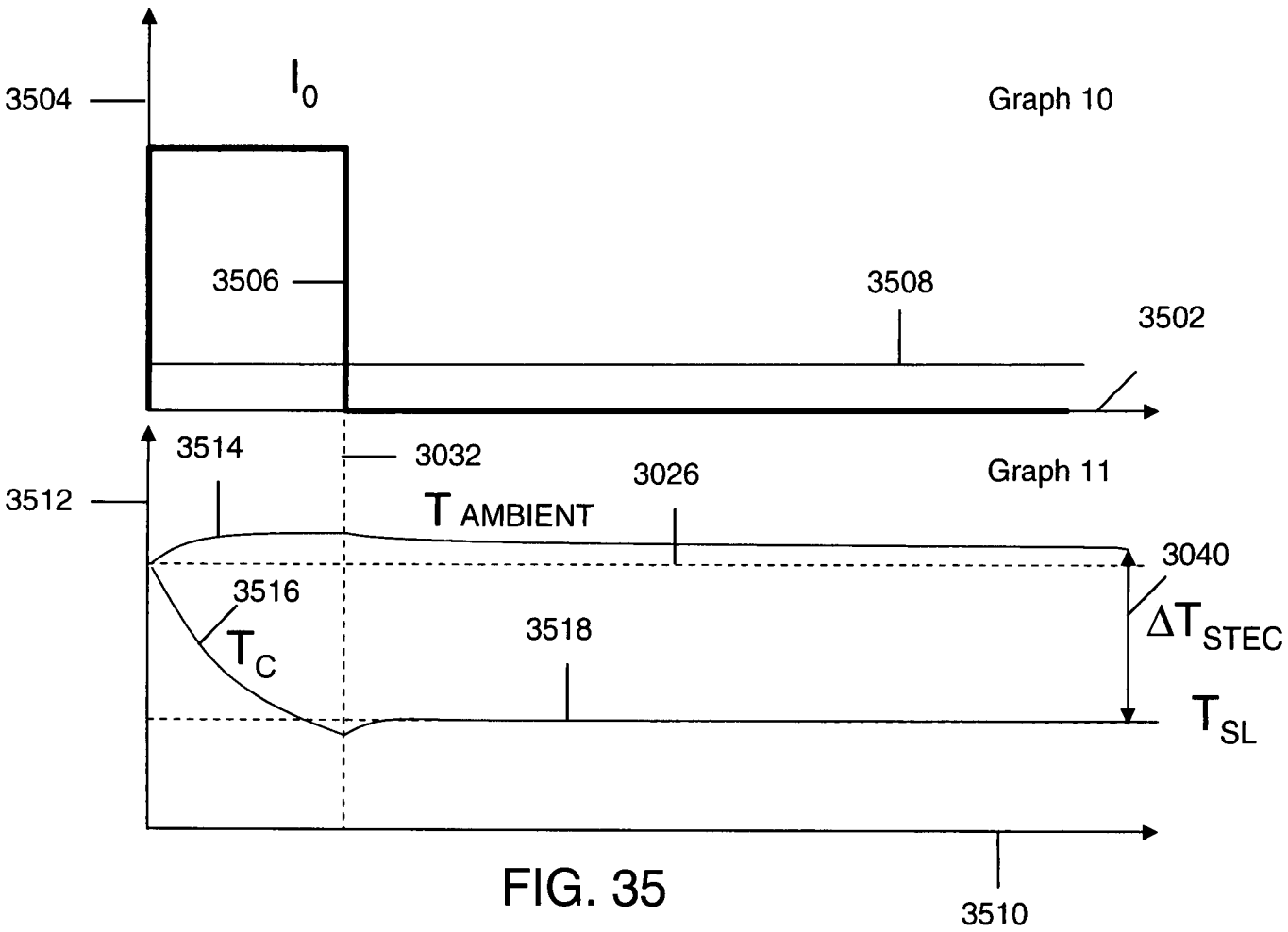
FIG. 35 illustrates graphs depicting variations in temperature and current with time for a cooling system having a primary thermoelectric cooler and a secondary thermoelectric cooler, in accordance with yet another embodiment of the present invention.

FIG. 35 illustrates graphs depicting variations in temperature and current with time for a cooling system with a primary thermoelectric cooler and a secondary thermoelectric cooler, in accordance with an embodiment of the present invention.

In an embodiment, the primary thermoelectric cooler is cooling brick 2600, which remains turned on for a certain period to create a cooling effect in a chamber, and the secondary thermoelectric cooler is a small thermoelectric cooler. The secondary thermoelectric cooler is always turned on and continually supplies a small current to compensate for the leakage of heat from the chamber.

In Graph 10, time is represented on a horizontal axis 3502 and current is represented on a vertical axis 3504. The primary thermoelectric cooler is switched on and is provided with an input current $I_0$ for a certain time after which the primary thermoelectric cooler is switched off. Variations in current supplied to the primary thermoelectric cooler with time are represented at 3506 in FIG. 35. Leakage current that passes through the secondary thermoelectric cooler is indicated at 3508 in Graph 10.

Graph 11 represents performance of the cooling system with the primary thermoelectric cooler and the secondary thermoelectric cooler. Graph 11 plots the temperature and time variations in the chamber during a cooling process, in accordance with an embodiment of the present invention. In Graph 11, time is represented on a horizontal axis 3510 and temperature is represented on a vertical axis 3512.

As explained in conjunction with Graph 2, fourth dotted line 3026 represents ambient temperature, as indicated by $T_{AMBIENT}$ in Graph 11. Further, seventh dotted line 3032 represents the time corresponding to the end of the transient phase, i.e., the time when the thermoelectric device is switched off for the first time.

Variations in the temperature of the hot end of the cooling brick in this embodiment of the present invention are represented by a thirteenth curved line 3514 in Graph 11. Further, the reduction in temperature of the fluid from $T_{AMBIENT}$ is represented by a fourteenth curved line 3516 in Graph 11.

Variations in the temperature of the fluid after the transient when cooling brick 2600 is turned off are represented at 3518 in Graph 11. The difference between the ambient temperature $T_{AMBIENT}$ and the lower limit of temperature $T_{SL}$ is represented by fourth double arrow 3040 and indicated by $\Delta T_{STEC}$ in Graph 11.

Figure 36:
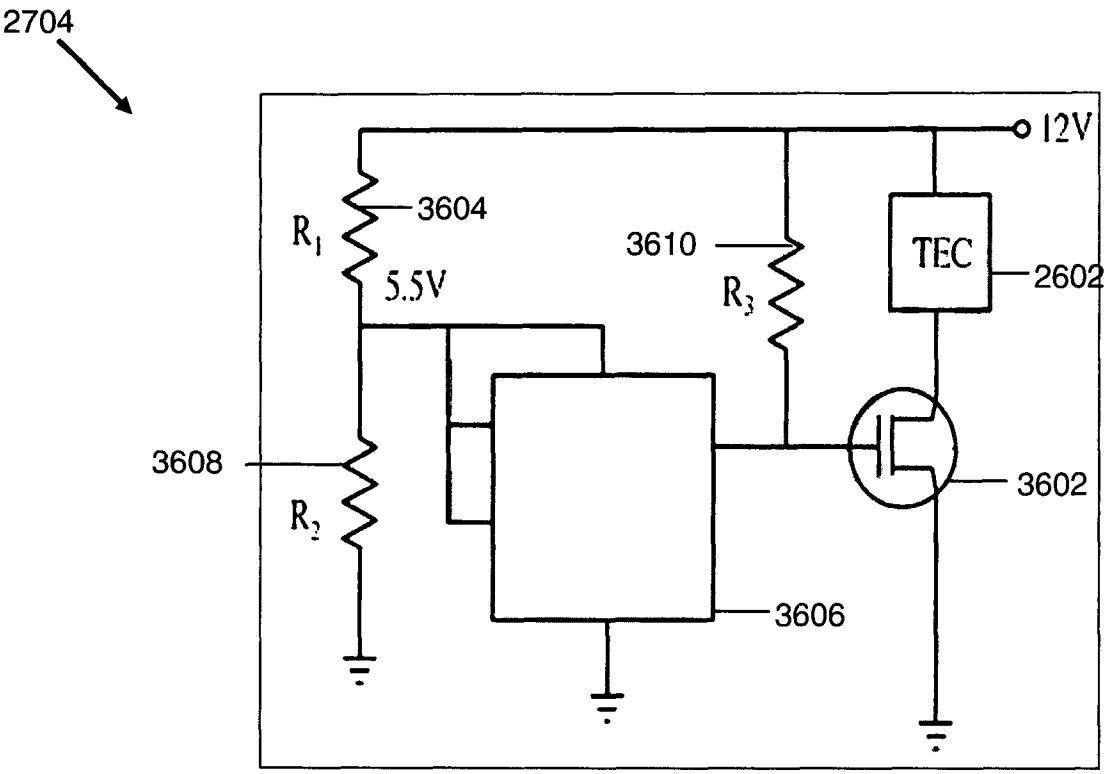
FIG. 36 is a circuit diagram of a switching circuit, in accordance with an embodiment of the present invention.

FIG. 36 is a circuit diagram of switching circuit 2704, in accordance with an embodiment of the present invention. Switching circuit 2704 includes thermoelectric cooler module 2602, a switch 3602, and a sensor 3606. The object of switching circuit 2704 is to implement a switching scheme that switches thermoelectric cooler module 2602 on and off, based on the temperature of first side 2608 of cooling brick 2600.

Switching circuit 2704 is operated by a DC current source. In an embodiment, the DC current source is a 12 Volts source, a 24 Volts source, or any other power source. In accordance with an embodiment of the present invention, sensor 3606 implements a circuit similar to a temperature sensor circuit. In accordance with an embodiment of the present invention, sensor 3606 uses MAX6505 from Maxim Inc to implement a circuit similar to a temperature sensor circuit. Further, sensor 3606 typically operates at 5.5 Volts. Furthermore, sensor 3606 is pre-programmed at set temperatures corresponding to the upper limit of temperature and the lower limit of temperature. In an embodiment of the present invention, the set temperature corresponding to the lower limit of temperature is zero degrees centigrade. Sensor 3606 has an internal diode that fixes the set temperature of sensor 3606. Sensor 3606 has a programmable operating range. In an embodiment, the lower limit of the operating range of sensor 3606 is zero degrees centigrade and the upper limit is 10 degrees centigrade.

Switching circuit 2704 includes a first resistor 3604 indicated by $R_1$ and a second resistor 3608 indicated by $R_2$. $R_1$ and $R_2$ divide 12 Volts to provide 5.5 Volts supply that can be coupled to an input of sensor 3606. In an embodiment of the present invention, sensor 3606 takes a small current as input which is of the order of 18 micro amperes. The output of sensor 3606 is an open drain type of output with a third resistor 3610 indicated by $R_3$. Third resistor 3610 acts as the load to the open drain. In an embodiment of the present invention, switch 3602 is a power MOSFET that has low drain to source resistance, typically less than 10 milliohms.

Thermoelectric cooler module 2602 acts as the load to switch 3602. In a typical cooling brick 2600, sensor 3606 is in contact with first side 2608 of cooling brick 2600 and detects the temperature at first side 2608 of cooling brick 2600. In an embodiment, components of switching circuit 2704 other than sensor 3606 are on a printed circuit board that is present on the hot side of cooling brick 2600. Initially, when the circuit is switched on, the temperature at first side 2608 of cooling brick 2600 is high and a transistor present at the output of sensor 3606 is off. Therefore, no current flows through the third resistor $R_3$, and the gate of switch 3602 is pulled to 12 Volts, thus turning it on. As a result, current flows through thermoelectric cooler module 2602. Electrical resistance of thermoelectric cooler module 2602 is much higher than that of the switch 3602. In an embodiment of the present invention, electrical resistance of thermoelectric cooler module 2602 is in the range of 0.5 ohm to 10 ohms, and the electrical resistance of switch 3602 is less than 10 milliohms. Therefore, almost all of the 12 Volts supply falls across thermoelectric cooler module 2602. This biases thermoelectric cooler module 2602 and optimal current starts flowing through it. Thus, thermoelectric cooler module 2602 starts cooling and the temperature at first side 2608 of cooling brick 2600 starts decreasing. When the temperature of first side 2608 of cooling brick 2600 reaches the lower limit of temperature $T_{SL}$, the transistor present at the output of sensor 3606 is turned on so that voltage at the gate of switch 3602 is less than the threshold voltage (0.5V) and switch 3602 is turned off. A limited current flows through the third resistor $R_3$ but the power dissipation is negligible. When switch 3602 is turned off, thermoelectric cooler module 2602 also gets turned off. Therefore, thermoelectric cooler module 2602 is switched off and cooling is stopped.

Figure 37:
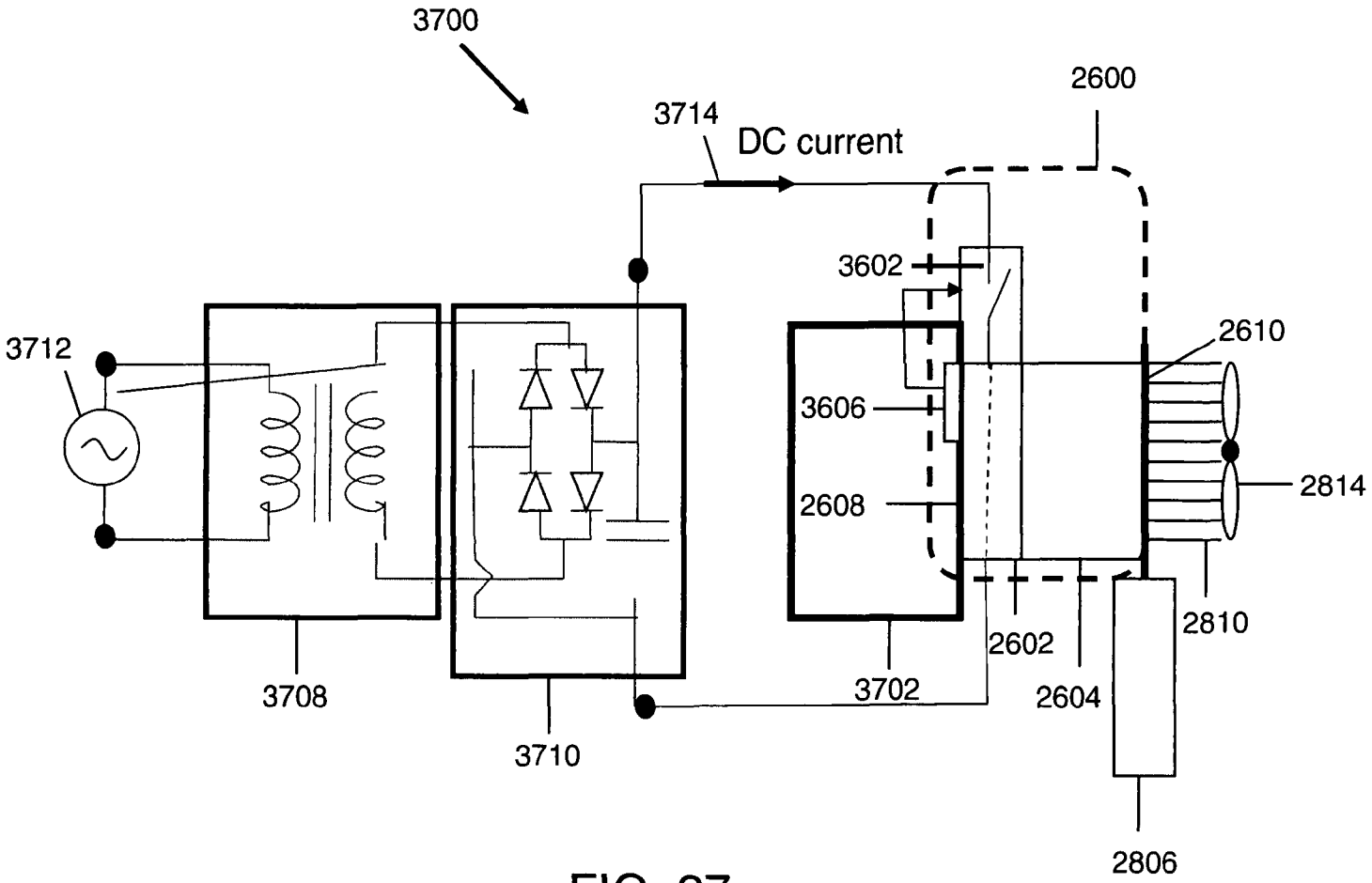
FIG. 37 is a schematic diagram of a thermoelectric cooling system, in accordance with an embodiment of the present invention.

FIG. 37 represents a schematic diagram of a thermoelectric cooling system 3700, in accordance with an embodiment of the present invention. Thermoelectric cooling system 3700 comprises a cold chamber 3702, cooling brick 2600, sensor 3606, third thermal capacitor 2806, a transformer 3708, and a rectifier 3710.

An AC line voltage source 3712 is provided to deliver 110 Volts or 220 Volts supply to thermoelectric cooling system 3700. Transformer 3708 is a step-down transformer that reduces the input voltage to a voltage appropriate for the functioning of cooling system 2700. Rectifier 310 converts AC voltage to DC voltage, which is then supplied to cooling brick 2600. A DC current flows through cooling brick 2600 in the direction indicated by arrow 3714. Sensor 3606 senses the temperature in cold chamber 3702, and the switching circuit of cooling brick 2600 works on the basis of the output of sensor 3606. Switch 3602 is turned to on when the temperature in cold chamber 3702 is above the upper limit of temperature $T_{SU}$ and is switched off when the temperature is below the lower limit of temperature $T_{SL}$.

Figure 38:
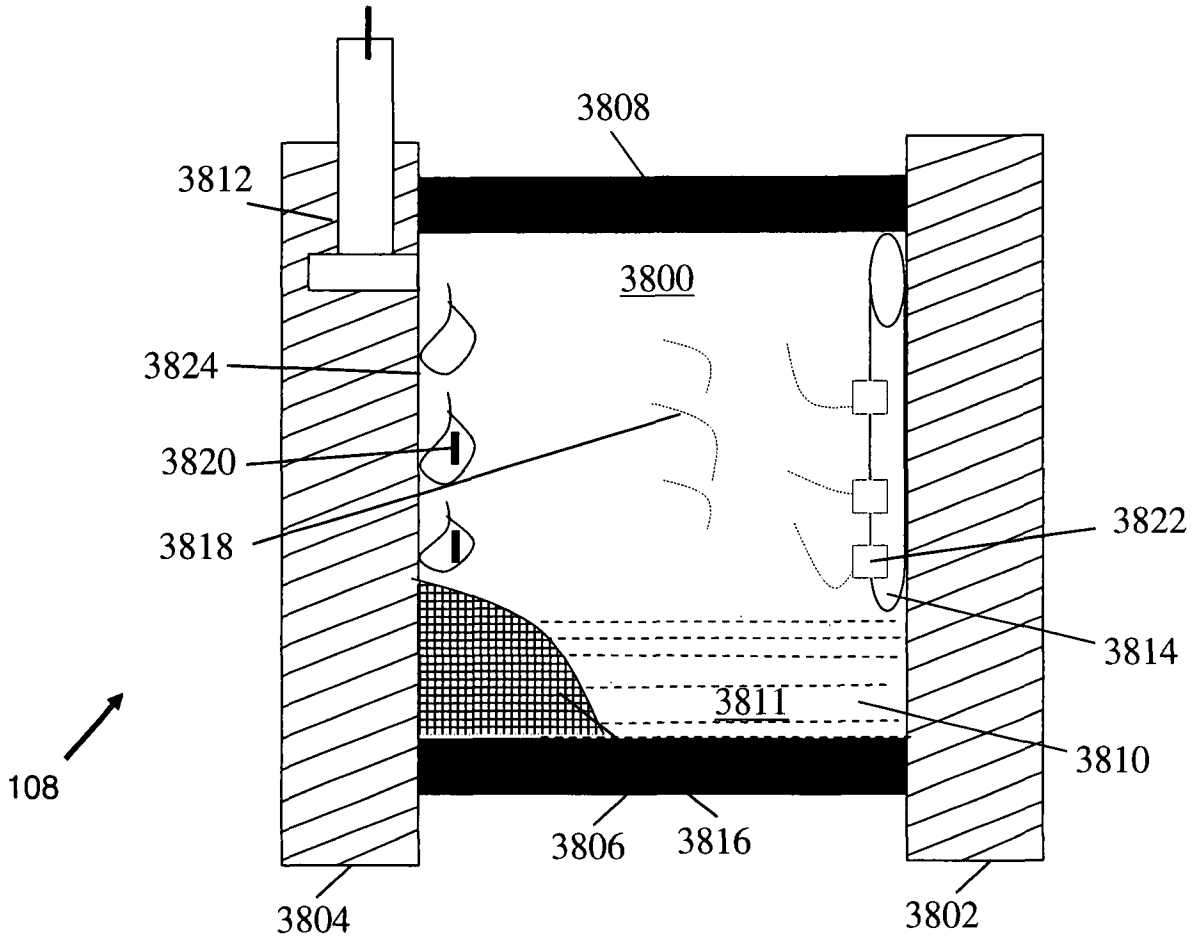
FIG. 38 illustrates a cross-sectional view of a first body with an insulator block, in accordance with an embodiment of the present invention.

FIG. 38 illustrates a cross-sectional view of first body 108, in accordance with an embodiment of the present invention. First body 108 includes a chamber 3800, a first conductor 3802 and a second conductor 3804, one or more insulators such as insulator 3806 and insulator 3808, a fluid reservoir 3810 with a working fluid 3811, a fill tube 3812 (alternatively referred to as crimped tube 3812), one or more heat pipes 3814 bonded to first conductor 3802, and an insulator block 3816 placed between chamber 3800 and second conductor 3804 at a bottom of the chamber to separate working fluid 3811 from second conductor 3804. First body 108 has a directional dependency on the flow of heat and acts as a thermal diode. The heat rejected from thermoelectric device 106 increases the temperature of first conductor 3802. Heat pipes 3814 bonded to first conductor 3802 have sintered inner surfaces (mentioned in conjunction with FIG. 39). Such sintered surfaces not only increase the effective surface for evaporation, but also provide strong capillary force to pull working fluid 3811 along the vertical direction. As working fluid 3811 evaporates after absorbing the heat from the hot side of thermoelectric device 106 from the sintered surface, it escapes into chamber 3800 through tiny holes 3822 provided in the heat pipes' walls. The vapor condenses on the condenser surface 3824 of chamber 3800 and replenishes fluid reservoir 3810.

First conductor 3802 and second conductor 3804 are made of a thermally conducting material that enables uniform spreading of heat along the evaporating and condensing surfaces. Examples of such thermally conducting material include, but are not limited to: copper; aluminum; conducting ceramics such as aluminum coated with nickel ($AlN_3$); alumina ($Al_2O_3$); and the like. Insulator 3806 and insulator 3808 thermally separate first conductor 3802 from second conductor 3804, thereby maintaining a temperature differential between them. Further, insulator 3806 and insulator 3808 also isolate chamber 3800 from the ambient and provide a structure to chamber 3800. Examples of the materials used in insulator 3806 and insulator 3808 include, but are not limited to, flame retardant 4 (FR4), composites of FR4 with ultra-thin metals, glass, glass/resin matrix, machinable ceramics such as Macor, acrylic, mica-ceramic composites, and so on. Typically, insulators 3806 and 3808 should have the same coefficient of thermal expansion as conductors 3802 and 3804. This results in similar thermal expansion of insulators 3806 and 3808 and conductors 3802 and 3804, thus increasing the reliability of the epoxy or soldered joints in between. For instance, when conductors 3802 and 3804 are made of copper, FR4 is the preferred insulator material since it has the same coefficient of thermal expansion as copper.

In an embodiment, working fluid 3811 in fluid reservoir 3810 is filled through fill tube 3812 provided in either first conductor 3802 or second conductor 3804. In accordance with the various embodiments of the present invention, working fluid 3811 used is water. In another embodiment of the present invention, working fluid 3811 with lower latent heat of vaporization is used. Examples of such fluid include, but are not limited to, ammonia, ethanol, acetone, and fluorocarbons such as Freon. Typically, a working fluid selection is based on the operating temperature range.

In an exemplary embodiment of the invention, first body 108 is connected between the hot end of thermoelectric device 106 and first chamber 102. When working fluid 3811 in fluid reservoir 3810 comes in contact with first conductor 3802, connected to the hot end of thermoelectric device 106, and the corresponding sintered surface, the fluid gains heat and starts evaporating to form vapors 3818. Tiny holes in heat pipes 3814 allow vapors 3818 to escape into chamber 3800. In accordance with an embodiment, heat pipes 3814 are bonded to first conductor 3802 provided in first body 108. Through capillary action, the sintered surface of heat pipes 3814 gathers working fluid 3811 from fluid reservoir 3810 and carries it upwards. The sintered surface of heat pipes 3814 provides a large surface area across first conductor 3802. To minimize the thermal losses across heat pipes 3814 and first conductor 3802, heat pipes 3814 are attached to first conductor 3802 with thin solder or thermally conducting epoxy.

Vapors 3818 transfer the heat carried by them to second conductor 3804, where vapors 3818 lose heat to condense into droplets 3820. In the present embodiment, droplets 3820 form on the inner side of second conductor 3804 and, aided by gravity, droplets 3820 roll down to replenish fluid reservoir 3810. In an embodiment of the invention, the inner surface of second conductor 3804 is covered with a hydrophobic coating to enable better gathering at fluid reservoir 3810.

Fill tube 3812 provided in second conductor 3804 create a low pressure inside chamber 3800 of first body 108. Low pressure allows working fluid 3811 to evaporate at temperatures close to room temperature. Typically, for water as working fluid 3811, the pressure measured at the outer end of fill tube 3812 is less than 20 Torr. In an exemplary embodiment, fill tube 3812 is made of oxygen-free copper, which can be crimped after creating low pressure in chamber 3800.

In the present embodiment, an insulator block 3816 is attached to the surface of insulator 3806 to separate fluid reservoir 3810 from second conductor 3804. In accordance with an embodiment of the invention, insulator block 3816 can be an integral part of insulator 3806. Typically, insulator block 3816 prevents the evaporation of water in contact with second conductor 3804 and the subsequent reverse flow of heat.

According to an embodiment of the invention, when thermoelectric device 106 is turned off, working fluid 3811 in fluid reservoir 3810 does not come in contact with second conductor 3804 due to intruding insulator block 3816. Therefore, the backflow of heat from second conductor 3804 to first conductor 3802 through conduction in working fluid 3811 is negligible or absent. This enables first body 108 to act as a thermal insulator and prevents transfer of heat in the backward direction from first fluid 110 in first chamber 102 to second fluid 124 in second chamber 104. In accordance with an exemplary embodiment, the thermal conductance of first body 108 in the backward direction is typically 100 times lower than that in the forward direction.

Figure 39:
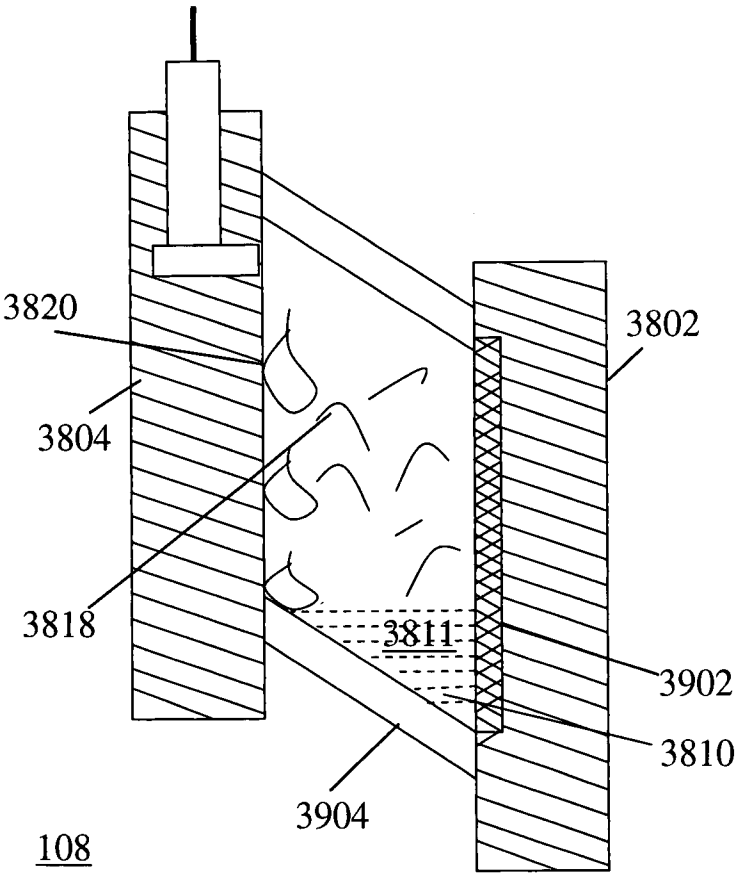
FIG. 39 illustrates a cross-sectional view of the first body with angular walls, in accordance with an embodiment of the present invention.

FIG. 39 illustrates a cross-sectional view of first body 108, in accordance with an embodiment of the invention. FIG. 39 includes the elements described with reference to FIG. 38 except for heat pipes 3814. Instead of heat pipes 3814, a surface 3902, which is a micro-grooved surface or sintered copper surface, is provided as the evaporating surface. In the present embodiment, the inner surface of first conductor 3802 has surface 3902 to create the capillary force necessary to pull working fluid 3811 along the surface. Surface 3902 can be created by chemically etching channels or metal skiving. In an exemplary embodiment, the channels are a few tens of microns deep. These channels should be designed based on the heat load on first conductor 3802, since higher heat loads can cause premature drying out of the fluid in the channels. These micro-channels can also be constructed out of silicon wafers and attached to first conductor 3802. Another cheap and efficient alternative to micro-channels is a sintered metal surface. Sintering copper powder on the evaporator surface is an established practice in the heat pipe industry, and sintering provides maximum capillary force which can pull working fluid 3811 along the vertical direction.

In an embodiment, the insulating section between first conductor 3802 and second conductor 3804 is a 45 degree insulating surface 3904. Typical examples of the insulating tube include, but are not limited to, acrylic, glass, and FR4 tubes. Providing insulating tube 3904 places second conductor 3804 at a higher elevation than first conductor 3802, thus creating fluid reservoir 3810 isolated from second conductor 3804. Since, in this embodiment, isolation of working fluid 3811 is inherently built-in, insulator block 3816 is not necessary.

Figure 40:
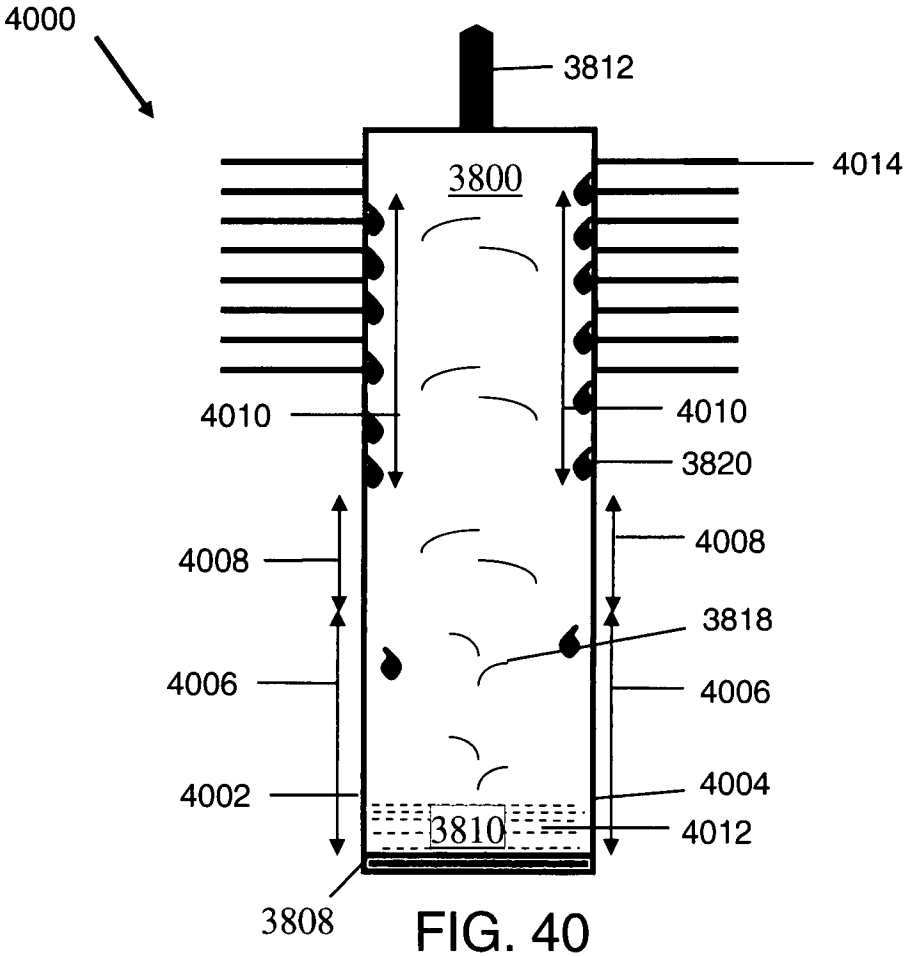
FIG. 40 illustrates a cross-sectional view of a symmetric vapor diode, in accordance with an embodiment of the present invention.

FIG. 40 illustrates a cross-sectional view of a symmetric vapor diode 4000, in accordance with an embodiment of the present invention. Symmetric vapor diode 4000 includes a chamber 3800, a first surface 4002, a second surface 4004, one or more thermal insulators such as an insulator 3808, fluid reservoir 3810, fill tube 3812, and a heat exchanger 4014.

First surface 4002 and second surface 4004 consist of three sections—an evaporation section 4006, an insulating section 4008, and a condenser section 4010. In an embodiment of the present invention, evaporation section 4006 is a sintered surface that enhances evaporation. Symmetric vapor diode 4000 has a directional dependency on the flow of heat and acts as a thermal diode. First surface 4002 and second surface 4004 are connected to hot sides of two thermoelectric devices (explained in conjunction with FIG. 42) through evaporation section 4006. Fluid reservoir 3810 contains a working fluid 4012 and is bound by first surface 4002, second surface 4004, and insulator 3808.

The rejected heat from the thermoelectric devices gets conducted to evaporation section 4006 of first surface 4002 and second surface 4004, and increases the temperature of these surfaces. Heat from evaporation section 4006 of first surface 4002 and second surface 4004 gets transferred to working fluid 4012 by the capillary action of the sintered surfaces of evaporation section 4006. As working fluid 4012 evaporates after absorbing heat rejected by the hot side of thermoelectric devices through evaporation section 4006, it escapes into chamber 3800 to form vapors 3818. Vapors 3818 lose heat to condenser section 4010 that is attached to heat exchanger 4014 and forms droplets 3820. Droplets 3820 return to evaporation section 4006 and replenish fluid reservoir 3810.

In an embodiment of the present invention, insulating section 4008 of first surface 4002 and second surface 4004 is adiabatic and is made of a material that prevents conduction of heat from the ambient to the thermoelectric devices that are attached to first surface 4002 and second surface 4004 of symmetric vapor diode 4000 when the thermoelectric devices are switched off. Examples of such material include, but are not limited to glass, stainless steel, and the like. Insulator 3808 is adiabatic and bounds chamber 3800 on one side. Examples of the materials used in insulator 3808 include, but are not limited to, composites of Flame Retardant 4 (FR4) with ultra-thin metals, glass, glass/resin matrix, stainless steel, machinable ceramics such as Macor, acrylic, mica-ceramic composites, and so forth. Ideally, insulator 3808 has the same coefficient of thermal expansion as that of first surface 4002 and second surface 4004. This results in similar thermal expansion of insulator 3808 and surfaces 4002 and 4004, thus increasing the reliability of the epoxy or soldered joints between these parts. For instance, when surfaces 4002 and 4004 are made of copper, FR4 is the preferred insulator material since it has the same coefficient of thermal expansion as copper.

In an embodiment, working fluid 4012 in fluid reservoir 3810 is filled through fill tube 3812. Fill tube 3812 is preferably made of copper and is present at a top surface of chamber 3800. In accordance with the various embodiments of the present invention, working fluid 4012 is water. In another embodiment of the present invention, working fluid 4012 is any other fluid with lower latent heat of vaporization than water. Examples of such fluids include, but are not limited to, ammonia, ethanol, acetone, fluorocarbons such as Freon, mixtures of water and ethyl alcohol, and mixtures of water and ammonia. Typically, working fluid 4012 is selected on the basis of the desired operating temperature range.

In an exemplary embodiment of the present invention, symmetric vapor diode 4000 is connected between the hot ends of two thermoelectric devices. When working fluid 4012 in fluid reservoir 3810 comes in contact with evaporation section 4006 of first surface 4002 connected to the hot end of a thermoelectric device, working fluid 4012 gains heat and starts evaporating to form vapors 3818 that escape into chamber 3800. Similarly, when working fluid 4012 in fluid reservoir 3810 comes in contact with evaporation section 4006 of second surface 4004 connected to the hot end of another thermoelectric device, working fluid 4012 gains heat and starts evaporating to form vapors 3818 that escape into chamber 3800. Thus, heat is conducted to working fluid 4012 symmetrically from both sides. Evaporation section 4006 of first surface 4002 and second surface 4004 are always kept wet even at high heat flux from the thermoelectric devices because droplets 3820 from condenser section 4010 fall under gravity to evaporation section 4006 and replenish fluid reservoir 3810.

Vapors 3818 transfer the heat carried by them and release it to condenser section 4010 before condensing into droplets 3820. Condenser section 4010 is attached to heat exchanger 4014 that transfers the heat to the ambient. In the present embodiment, droplets 3820 form on the inner sides of first surface 4002 and second surface 4004.

If an asymmetric vapor diode is used which has a thermoelectric device attached to first surface 4002 and not to second surface 4004, water evaporates from first surface 4002. If the heat flux increases, there is not enough water in evaporation section 4006 of first surface 4002 to conduct heat. Therefore, a dry out is experienced and the temperature at evaporation section 4006 increases. Thus, heat conduction of the asymmetric vapor diode becomes low at high heat flux. Consequently, symmetric vapor diode 4000 can conduct higher heat flux as compared with asymmetrical vapor diodes.

Fill tube 3812 creates a low pressure inside chamber 3800 of symmetric vapor diode 4000. Low pressure allows working fluid 4012 to evaporate at the temperature close to room temperature. Typically, for water used as working fluid 4012, the pressure measured at the outer end of fill tube 3812 is less than 20 Torrs. In an exemplary embodiment, fill tube 3812 is made of oxygen-free copper, which is crimped after creating a low pressure in chamber 3800.

When the thermoelectric devices connected to symmetric vapor diode 4000 are switched on, the temperature of evaporation section 4006 is higher than that of heat exchanger 4014 that is at ambient temperature. In this case, heat is conducted by working fluid 4012 to heat exchanger 4014. When the thermoelectric devices connected to symmetric vapor diode 4000 are switched off, the temperature of evaporation section 4006 is less than that of heat exchanger 4014 that is close to ambient temperature. Insulating section 4008 has a thin wall thickness and is made of low thermal conductivity materials such as stainless steel, glass, or composites of FR4 with metals that are have sufficient strength to retain high vacuum in chamber 3800. Thermal resistance is inversely proportional to cross section area. For thin wall thickness, the cross section area of the walls is less and thus, the thermal resistance is higher. Consequently, insulating section 4008 prevents conduction of heat from heat exchanger 4014 to evaporation section 4006 when the thermoelectric coolers are switched off. In an embodiment of the present invention, stainless steel (with thermal conductivity of about 15 W/mK) is used as the material of insulating section 4008, and the walls of insulating section 4008 are about 300 to 500 micron thick. In another embodiment of the present invention, glass (with thermal conductivity of about 1.4 W/mK) is used as the material of insulating section 4008, and the walls of insulating section 4008 are about 1 millimeter thick.

Figure 41:
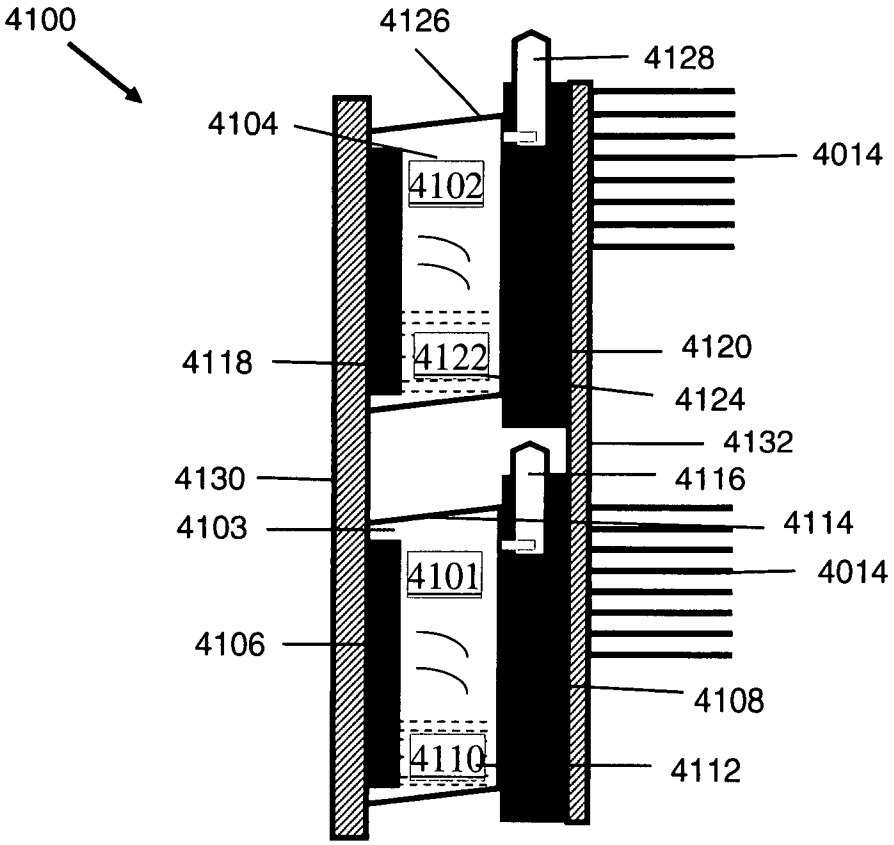
FIG. 41 illustrates a cross-sectional view of a mixed fluid vapor diode, in accordance with another embodiment of the present invention.

FIG. 41 illustrates a cross-sectional view of a mixed fluid vapor diode 4100, in accordance with another embodiment of the present invention.

Mixed fluid vapor diode 4100 is an asymmetric vapor diode and comprises two small asymmetric vapor diodes (a first small vapor diode 4101 and a second small vapor diode 4102) in parallel. First small vapor diode 4101 has a first chamber 4103, and second small vapor diode 4102 has a second chamber 4104.

First chamber 4103 contains a third surface 4106, a fourth surface 4108, heat exchanger 4014, and a first fluid reservoir 4110. A first working fluid 4112 is present in first fluid reservoir 4110. First working fluid 4112 is a fluid having a low boiling point. Examples of first working fluid 4112 include, but are not limited to ethyl alcohol, ammonia, and butane.

A first closure wall 4114 that is made of an insulating material is provided on first chamber 4103 to provide a structure to first chamber 4103. A first fill tube 4116 is provided on a top portion of fourth surface 4108. First fill tube 4116 is provided to create a low pressure inside first chamber 4103. The low pressure allows first working fluid 4112 to evaporate at temperatures close to room temperature.

Second chamber 4104 contains a fifth surface 4118, a sixth surface 4120, heat exchanger 4014, and a second fluid reservoir 4122. A second working fluid 4124 is present in second fluid reservoir 4122. Second working fluid 4124 is a fluid such as water that has a boiling point higher than that of first working fluid 4112.

A second closure wall 4126 that is made of an insulating material is provided in second chamber 4104 to provide a structure to second chamber 4104. A second fill tube 4128 is provided on sixth surface 4120. Second fill tube 4128 is provided to create a low pressure inside second chamber 4104. The low pressure allows second working fluid 4124 to evaporate at temperatures less than room temperature.

A normal vapor diode has only one working fluid such as water that boils at 100 degrees centigrade at ambient pressure. The boiling point of the working fluid is preferably decreased to improve conductance at low temperatures. Therefore, first working fluid 4112 and second working fluid 4124 are maintained at low pressure to decrease their boiling points. At a reduced pressure of 20 milli Torr, water boils at 20 degrees centigrade. However, when the operating temperature of a single stage vapor diode with water as the working fluid is reduced to 20 degrees centigrade to 30 degrees centigrade, the forward thermal conductance of the single stage vapor diode becomes low. If the pressure in the chamber of the single stage vapor diode is further reduced, the temperature of the water approaches its triple point and there is no liquid state water for capillary action in the sintered surfaces. Thus, the forward conductance of the single stage vapor diode becomes very low and it is generally not useful in practical applications.

In an embodiment of the present invention, mixed fluid vapor diode 4100 is an asymmetric diode. A first end surface 4130 is attached to a thermoelectric device, and a second end surface 4132 is attached to heat exchanger 4014. Mixed fluid vapor diode 4100 permits conduction of heat in the forward direction, i.e., from first end surface 4130 to second end surface 4132. First end surface 4130 conducts the heat rejected by the thermoelectric device and distributes it to third surface 4106 and fifth surface 4118. Second end surface 4132 conducts the heat from fourth surface 4108 and sixth surface 4120 to heat exchanger 4014. Mixed fluid vapor diode 4100 has very high forward conduction over a wide range of temperatures e.g. 0 degrees centigrade to 100 degrees centigrade. At low temperatures, second chamber 4104 with second working fluid 4124 provides the high forward conduction while at high temperatures first chamber 4103 with first working fluid 4112 provides high forward conduction. Therefore, higher forward conductance is achieved at all temperatures.

Having a mixed fluid in a single vapor diode is often very difficult because the two fluids generally need to be in a frozen state before filling, otherwise, they start evaporating at a low pressure. Therefore, it is advantageous to use two vapor diodes in parallel, one with water as the working fluid and the other with alcohol as the working fluid. In an embodiment of the present invention, mixed fluids, for example, water and alcohol, are used in first small vapor diode 4101, and ammonia and water in second small vapor diode 4102.

In an embodiment of the present invention, first small vapor diode 4101 and second small vapor diode 4102 can be joined in parallel to form a symmetric mixed fluid vapor diode.

Figure 42:
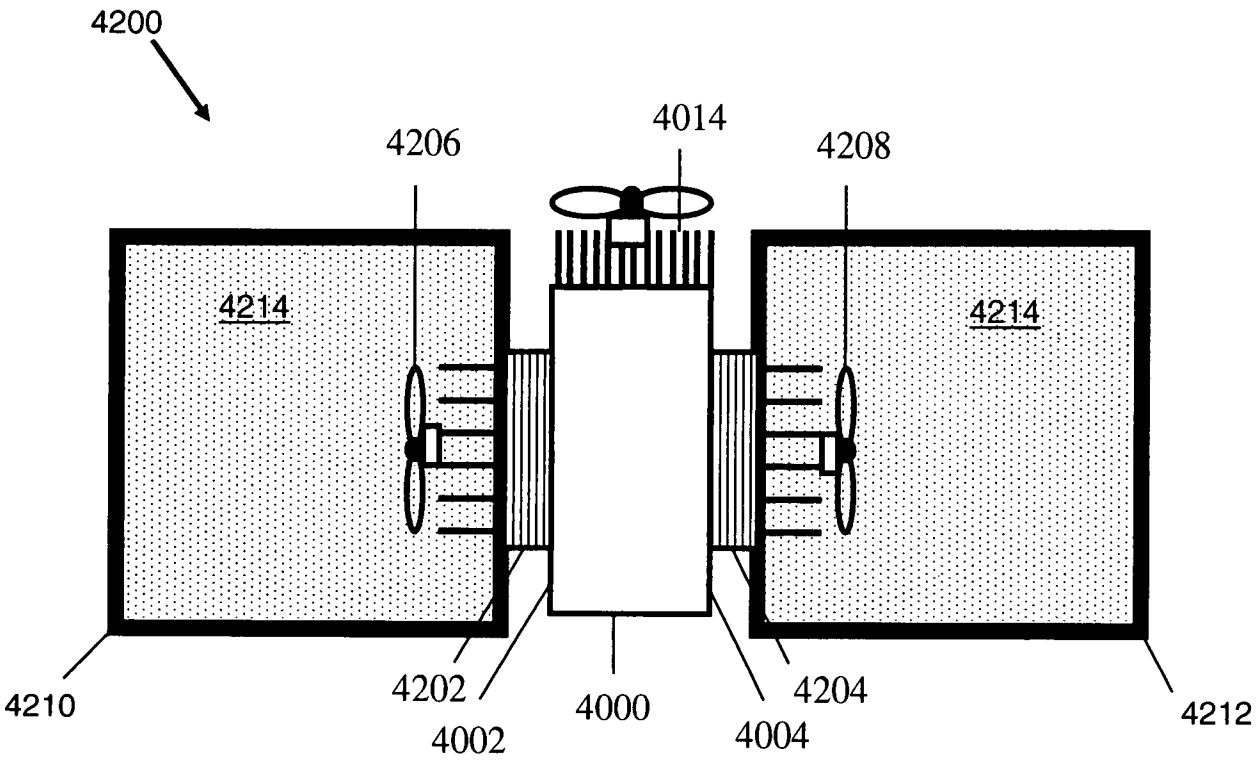
FIG. 42 illustrates a cross-sectional view of a cooling system, in accordance with an embodiment of the present invention.

FIG. 42 illustrates a cross-sectional view of a thermoelectric cooling device 4200, in accordance with an embodiment of the present invention.

Thermoelectric cooling device 4200 contains symmetric vapor diode 4000 that has first surface 4002, second surface 4004, and heat exchanger 4014. First surface 4002 is connected to the hot side of a first thermoelectric device 4202 and second surface 4004 is connected to the hot side of a second thermoelectric device 4204. First thermoelectric device 4202 is connected to a first cooling chamber 4210 and second thermoelectric device 4204 is connected to a second cooling chamber 4212. First thermoelectric device 4202 cools first cooling chamber 4210 and second thermoelectric device 4204 cools second cooling chamber 4212.

First cooling chamber 4210 and second cooling chamber 4212 contain a fluid 4214 that needs to be cooled. In an embodiment of the present invention, first cooling chamber 4210 and second cooling chamber 4212 are cooling chambers of a refrigerator. First cooling chamber 4210 has a first cold fan 4206, and second cooling chamber 4212 has a second cold fan 4208. Cold fans 4206 and 4208 help in transferring heat from fluid 4214 to first thermoelectric device 4202 and second thermoelectric device 4204, respectively. Furthermore, cold fans 4206 and 4208 help in maintaining a uniform temperature within cooling chambers 4210 and 4212, respectively.

When first thermoelectric device 4202 is switched on, the hot side of first thermoelectric device 4202 is at a temperature that is higher than the ambient temperature present at heat exchanger 4014. In this case, heat transferred from first cooling chamber 4210 by first thermoelectric device 4202 is conducted to symmetric vapor diode 4000 through first surface 4002. Symmetric vapor diode 4000 transfers this heat to the ambient through heat exchanger 4014. Similarly, when second thermoelectric device 4204 is switched on, the hot side of second thermoelectric device 4204 is at a temperature that is higher than ambient temperature present at heat exchanger 4014. In this case, heat transferred from second cooling chamber 4212 by second thermoelectric device 4204 is conducted to symmetric vapor diode 4000 through second surface 4004. Symmetric vapor diode 4000 transfers this heat to the ambient through heat exchanger 4014.

When first thermoelectric device 4202 is switched off, the temperature of first surface 4002 becomes approximately equal to the temperature of first cooling chamber 4210 that is less than the ambient temperature present at heat exchanger 4014. However, since working fluid 4012 of symmetric vapor diode 4000 is not in contact with heat exchanger 4014, it is unable to transfer heat from heat exchanger 4014 to cooling chambers 4210 and 4212. Furthermore, insulating section 4008 of symmetric vapor diode 4000 has a thin cross section that thermally isolates heat exchanger 4014 from evaporation section 4006. This prevents backflow of heat from the ambient to cooling chambers 4210 and 4212.

Figure 43:
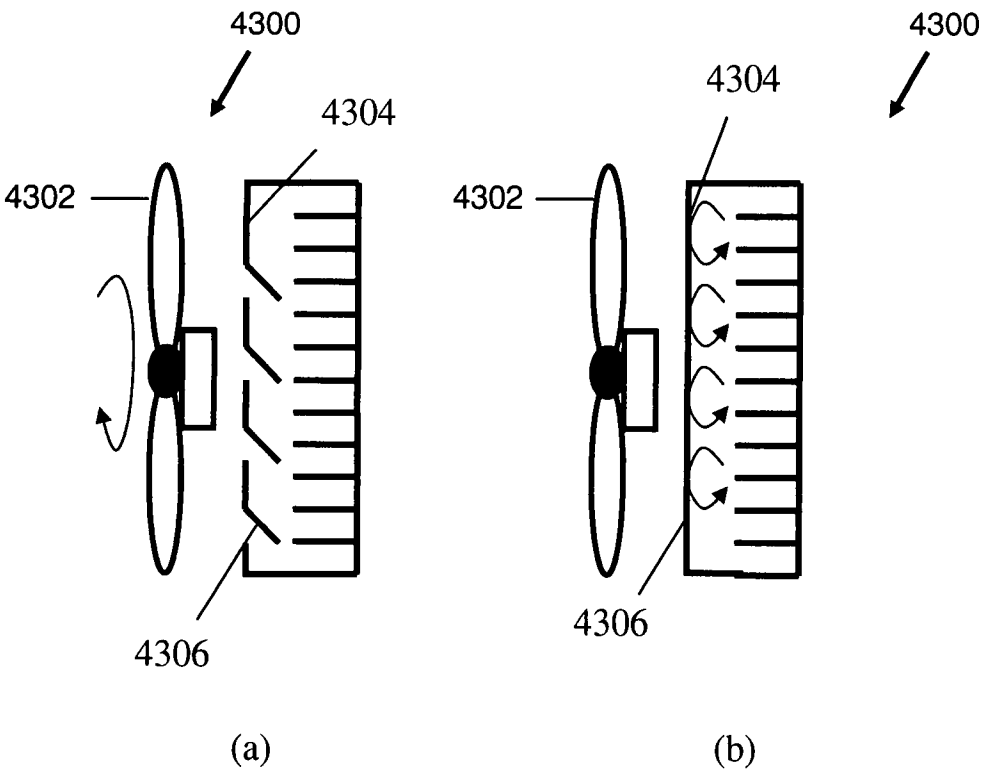
FIG. 43 illustrates a cross-sectional view of a louvred heat sink, in accordance with an embodiment of the present invention.

FIG. 43 illustrates a cross-sectional view of a louvred heat sink 4300, in accordance with an embodiment of the present invention.

Louvred heat sink 4300 contains a fan 4302, a frame 4304, and louvres 4306. The left side figure marked as (a) depicts louvred heat sink 4300 with louvres 4306 open to allow conduction of heat. The right side figure marked as (b) depicts louvred heat sink 4300 with louvres 4306 closed to prevent conduction of heat.

Louvred heat sink 4300 is used mainly with primary thermoelectric device 1502 of a thermoelectric cooling system. When primary thermoelectric device 1502 is switched on, fan 4302 is also switched on. When primary thermoelectric device 1502 is switched off, fan 4302 is also switched off. Thermal resistance of louvred heat sink 4300 varies as fan 4302 is switched on and off. When fan 4302 is switched on, louvers 4306 are open and thermal resistance of louvred heat sink 4300 is low. When fan 4302 is switched off, louvers 4306 are shut and the thermal resistance of louvred heat sink 4300 is very high. When louvers 4306 are shut, they trap the air near the surface of louvred heat sink 4300 and do not allow free (natural) air convection currents. Hence the thermal resistance of louvred heat sink 4300 further increases much higher than that of the conventional heat sink/fan assembly without louvres. In an embodiment, louvres 4306 are opened and closed by mechanisms such as electromagnetic actuators, pressure drop in air flow, and gravitational forces.

In an embodiment of the present invention, louvres 4306 are in the form of light curtains present on frame 4304. These louvres 4306 are made of thermally insulating films such as polyimide or kapton films. When fan 4302 is switched on, louvres 4306 get lifted because of the pressure on louvres 4306 due to the air flow. In this state, air can pass through louvred heat sink 4300. When fan 4302 is switched off, louvres 4306 fall back to a normal state that isolates the air close to louvred heat sink 4300. In this state, convection air flow through louvred heat sink 4300 is prevented, thus increasing thermal resistance of louvred heat sink 4300.

Figure 44:
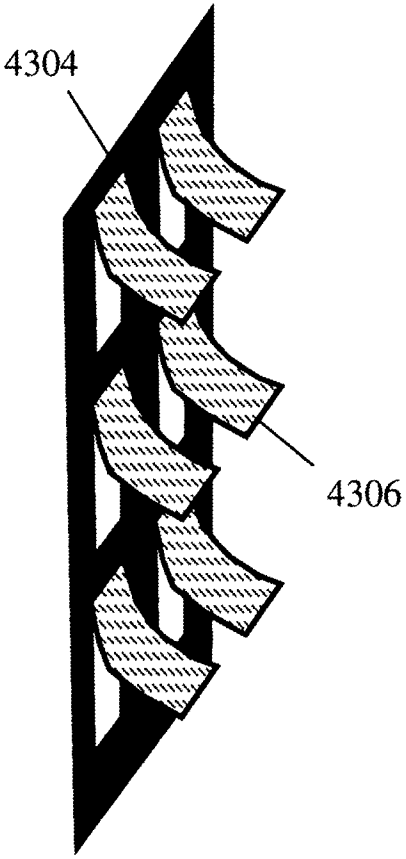
FIG. 44 illustrates a side view of a frame of a louvred heat sink, in accordance with an embodiment of the present invention.

FIG. 44 illustrates a perspective view of frame 4304 of louvred heat sink 4300, in accordance with an embodiment of the present invention. In an embodiment of the present invention, frame 4304 is a plastic frame with windows corresponding to louvres 4306 cut in it. Louvres 4306 are made of thin polyimide film and are attached to each such window in frame 4304. In an embodiment of the present invention, the windows corresponding to louvres 4306 are squares of side length one centimeter.

Figure 45:
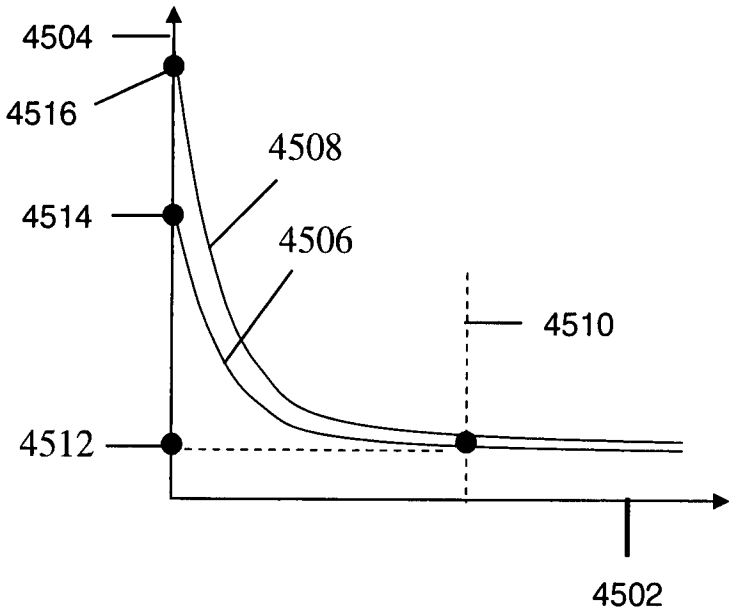
FIG. 45 illustrates a graph depicting variations in thermal resistance of a fan with air flow for a cooling system, in accordance with an embodiment of the present invention.

FIG. 45 illustrates a graph depicting variations in thermal resistance of a fan with air flow for a thermoelectric cooling system, in accordance with an embodiment of the present invention.

The graph plots thermal resistance of louvred heat sink 4300 vs. air flow during the process of cooling of a fluid using primary thermoelectric device 1502, in accordance with an embodiment of the present invention. In the graph, air flow (in meters per second) is represented on a horizontal axis 4502, and thermal resistance (in ° C./W), is represented on a vertical axis 4504.

In the graph, a first curved line 4506 shows variations in thermal resistance of a heat sink without louvres 4306. A second curved line 4508 shows variations in thermal resistance of louvred heat sink 4300. A first dotted line 4510 marks the air flow when fan 4302 is switched on. A first point 4512 marks thermal resistance when fan 4302 is switched on. A second point 4514 marks thermal resistance of the sink without louvres when fan 4302 is off. A third point 4516 represents thermal resistance of louvred heat sink 4300 when fan 4302 is off.

As shown in the graph, when fan 4302 is off, thermal resistance of the heat sink is high. For a heat sink that does not have louvres 4306, thermal resistance ($R_{OFF}$) is represented by second point 4514. For louvred heat sink 4300, this thermal resistance ($R_{OFF}$-louvred) is represented by third point 4516. $R_{OFF}$-louvred is greater than $R_{OFF}$ since louvres 4306 present in louvred heat sink 4300 prevent free (natural) convection of air by trapping air inside louvred heat sink 4300. The only heat transfer in this case takes place through static thermal conductivity of air.

As air flow increases, thermal resistance of the heat sink decreases. Thermal resistance ($R_{ON}$) of louvred heat sink 4300 and a heat sink without louvres after fan 4302 is switched on is represented by first point 4512. Thus, $R_{ON}$ is nearly the same for louvred heat sink 4300 and a heat sink without louvres because air flow is taking place in both the cases.

Diodicity (γ) of a heat sink is defined as follows:

$$\gamma = \frac{Kon}{Koff} = \frac{Roff}{Ron}$$

where, $K_{on}$ is thermal conductance of the heat sink when fan 4302 is switched on;

$K_{off}$ is thermal conductance of the heat sink when fan 4302 is switched off;

$R_{off}$ is thermal resistance of the heat sink when fan 4302 is switched off; and $R_{on}$ is thermal resistance of the heat sink when fan 4302 is switched on.

In an embodiment of the present invention, diodicity of the heat sink without louvres is in the range of 7 to 10, while that of louvred heat sink 4300 is in the range of 20 to 25. Diodicity can be further varied by changing air flow through fan 4302. High air flow achieves high diodicity and low air flow achieves low diodicity. To increase diodicity, a low value of $K_{off}$ (and therefore high value of $R_{OFF}$) is needed. In louvred heat sink 4300, air is trapped very close to the heat sink and the free (natural) convection is minimal when louvres 4306 are closed. The only heat transfer in this case takes place through static conduction and no external air enters louvred heat sink 4300. Thus, $R_{OFF}$ is high in this case (shown at third point 4516).

Louvred heat sink 4300 acts as a thermal diode, and thus enhances the performance of a vapor diode. Generally, louvred heat sink 4300 is used along with a vapor diode. However, in an embodiment of the present invention, louvred heat sink 4300 is used without the vapor diode. In an embodiment of the present invention, louvred heat sink 4300 is used with a hot fan of a thermoelectric cooling device and traps hot air on one side of the hot fan. In another embodiment of the present invention, louvred heat sink 4300 is used with a cold fan of a thermoelectric cooling device and traps cold air on one side of the cold fan.

The cooling system of the present invention has several advantages. In various embodiments of the present invention, water has been used as a fluid. Since water has a high-specific heat capacity as compared with other liquids, it helps in maintaining a constant temperature in first chamber 102. The high-specific heat capacity of first fluid 110 clamps the rise in the temperature of the heat sink of thermoelectric device 106, and reduces the total temperature differential across thermoelectric device 106. The cooling efficiency of a thermoelectric device is inversely related to the total temperature differential across its ends. Therefore, a fall in the total temperature differential enhances the cooling efficiency of the thermoelectric device. This temperature clamping property is generally not possible in a conventional design. The use of water as a fluid also makes the cooling system environment friendly.

In various embodiments of the present invention, first body 108 has a property of directional flow of heat and it acts as a thermal diode. First body 108 is a good thermal conductor when the temperature of the heat sink of thermoelectric device 106 is higher than that of first fluid 110. Alternatively, first body 108 acts as a thermal insulator and prevents the transfer of heat into second fluid 124 when thermoelectric device 106 is turned off. This unique property prevents the backflow of heat into second fluid 124 and the temperature of second fluid 124 does not rises abruptly. This enables control of the temperature of second fluid 124 within the desired temperature range and keeps the device turned off for long periods of time. This reduction in the backflow of heat is generally not possible in a conventional design. In addition, since the cooling system is a solid state device, it is reliable, vibration free, and light in weight.

According to the various other embodiments of the invention, the cooling system uses phase change materials in the first and second chamber to decrease the temperature differential across the first and second chamber, thereby increasing the efficiency of the cooling system. To spread the heat efficiently, the cooling system may use heat pipes in the first chamber and the second chamber, thereby maintaining a constant temperature throughout the reservoirs. The first body can also be placed in the cold side of the thermoelectric device thus increasing design flexibility. In systems where a fluid pump is already present, exemplary embodiments of the invention employ the pump and a fluid loop in a particular arrangement to act as a thermal diode, thereby increasing the efficiency of cooling. Such an arrangement provides design flexibility in terms of placement of the fluid chambers.

It will be apparent to a person skilled in the art that although the present invention is explained in conjunction with a thermoelectric cooling device for the purpose of this description, the method and apparatus of the invention described above can be applied to vapor compressor systems and other refrigeration techniques as well.

While the various embodiments of the present invention have been illustrated and described, it will be clear that the invention is not limited to these embodiments only. Numerous modifications, changes, variations, substitutions, and equivalents will be apparent to those skilled in the art without departing from the spirit and scope of the invention.

What is claimed is:

1. A cooling system comprising: a chamber, the chamber comprising a fluid; a primary thermoelectric device connected to the chamber, the primary thermoelectric device being configured to cool the fluid; a circuit, the circuit switching the primary thermoelectric device ON and OFF based on a temperature of the fluid; a heat exchanger, the heat exchanger configured to transfer heat extracted from the fluid to the ambient; a primary thermal diode, the primary thermal diode configured to allow unidirectional transfer of heat extracted from the fluid by the primary thermoelectric device to the heat exchanger, wherein the primary thermal diode comprises: a first conductor, the first conductor receiving heat from the primary thermoelectric device; a second conductor; a fluid reservoir for storing a working fluid, the working fluid enabling the transfer of heat from the first conductor to the second conductor; and one or more insulating sections to prevent transfer of heat from the second conductor to the first conductor; and a secondary thermoelectric device connected to the chamber to produce a cooling effect to compensate for heat leakage into the fluid.

2. The cooling system of claim 1, wherein the primary thermal diode comprises one or more heat pipes in communication with the first conductor.

3. The cooling system of claim 2, wherein the heat pipes are made of copper.

4. The cooling system of claim 3, wherein the heat pipes further comprise fins.

5. The cooling system of claim 1, wherein the secondary thermoelectric device remains continuously in an ON state to cool the fluid at a predefined rate.

6. The cooling system of claim 1 further comprising a secondary thermal diode, the secondary thermal diode being connected to the secondary thermoelectric device to allow unidirectional transfer of heat extracted from the fluid by the secondary thermoelectric device to the heat exchanger.

7. The cooling system of claim 6, wherein the circuit switches the secondary thermoelectric device ON and OFF based on the temperature of the fluid.

8. The cooling system of claim 6, wherein the secondary thermal diode comprises one or more heat pipes.

9. The cooling system of claim 1, wherein a thermal capacitor is attached to the primary thermal diode to maintain the primary thermal diode at a constant temperature.

10. The cooling system of claim 1, wherein the primary thermoelectric device and the secondary thermoelectric device comprise multistage thermoelectric coolers.

11. The cooling system of claim 1, wherein a fan is connected to the chamber to transfer heat to the ambient, the fan being switched ON and OFF by the circuit based on the temperature of the fluid.

12. The cooling system of claim 1, wherein the circuit supplies a pulse-width modulated current.

13. The cooling system of claim 1, wherein the fluid is water.

14. A method for operating a thermoelectric cooling system, the thermoelectric cooling system comprising: a chamber, the chamber comprising a fluid; a primary thermoelectric device in thermal communication with the chamber, the primary thermoelectric device being configured to cool the fluid; a circuit, the circuit switching the primary thermoelectric device ON and OFF based on the temperature of the fluid; a heat exchanger, the heat exchanger configured to transfer heat extracted from the fluid to an ambient environment; a primary thermal diode, the primary thermal diode configured to allow unidirectional transfer of heat extracted from the fluid by the primary thermoelectric device to the heat exchanger, wherein the primary thermal diode comprises: a first conductor, the first conductor receiving heat from the primary thermoelectric device a second conductor; a fluid reservoir for storing a working fluid, the working fluid enabling the transfer of heat from the first conductor to the second conductor; and one or more insulating sections to prevent transfer of heat from the second conductor to the first conductor; and a secondary thermoelectric device connected to the chamber to produce a cooling effect to compensate for heat leakage into the fluid, the method comprising: switching ON the primary thermoelectric device when the temperature of the fluid is equal to or more than an upper limit of the temperature; switching OFF the primary thermoelectric device when the temperature of the fluid is equal to or less than a lower limit of the temperature; and compensating for heat leakage into the fluid using the secondary thermoelectric device.

15. The method of claim 14, wherein the primary thermal diode comprises one or more heat pipes in communication with the first conductor.

16. The method of claim 15, further comprising the step of blowing air onto the chamber.

* * * * *